US009318815B2

(12) United States Patent
Mitose et al.

(10) Patent No.: US 9,318,815 B2
(45) Date of Patent: Apr. 19, 2016

(54) CRIMP TERMINAL, CONNECTION STRUCTURAL BODY AND METHOD FOR PRODUCING THE SAME

(71) Applicants: FURUKAWA ELECTRIC CO., LTD., Tokyo (JP); FURUKAWA AUTOMOTIVE SYSTEMS INC., Shiga (JP)

(72) Inventors: Kengo Mitose, Tokyo (JP); Naoya Takashima, Tokyo (JP); Yukihiro Kawamura, Shiga (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 54 days.

(21) Appl. No.: 13/914,313

(22) Filed: Jun. 10, 2013

(65) Prior Publication Data

US 2013/0273787 A1 Oct. 17, 2013

Related U.S. Application Data

(63) Continuation of application No. PCT/JP2011/078383, filed on Dec. 8, 2011.

(30) Foreign Application Priority Data

Dec. 8, 2010 (JP) ..... 2010-273141
Dec. 8, 2010 (JP) ..... 2010-273142

(51) Int. Cl.
*H01R 4/18* (2006.01)
*H01R 43/16* (2006.01)

(Continued)

(52) U.S. Cl.
CPC ..... *H01R 4/183* (2013.01); *C23C 18/54* (2013.01); *C25D 11/022* (2013.01); *C25D 11/04* (2013.01); *C25D 11/08* (2013.01); *C25D 11/246* (2013.01); *H01R 4/185* (2013.01); *H01R 13/03* (2013.01); *H01R 43/048* (2013.01); *H01R 43/16* (2013.01); *H01R 13/111* (2013.01); *Y10T 29/4921* (2015.01); *Y10T 29/49218* (2015.01)

(58) Field of Classification Search
CPC ..... H01R 43/048; H01R 4/18; H01R 4/01; H01R 4/2495; H01R 4/184; H01R 9/0518; H01R 12/69; H01R 13/5808; C23C 18/54; C25D 11/022
USPC ..... 439/839, 882, 878
See application file for complete search history.

(56) References Cited

U.S. PATENT DOCUMENTS 2,480,280 A * 8/1949 Bergan ..... H01R 4/203 219/118
3,383,188 A * 5/1968 Michelson ..... C22C 21/00 174/126.1

(Continued)

FOREIGN PATENT DOCUMENTS

JP 52-005487 A 1/1977
JP 09-055279 A 2/1997

(Continued)

OTHER PUBLICATIONS

International Search Report issued in Application No. PCT/JP2011/078383, mailed Mar. 13, 2013 (2 pages).

*Primary Examiner* — Amy Cohen Johnson
*Assistant Examiner* — Oscar C Jimenez
(74) *Attorney, Agent, or Firm* — Osha Liang LLP

(57) ABSTRACT

An insulating body-forming part is formed on a border between a surface of a crimp terminal formed of an aluminum material and a conductive contact body provided on the surface and containing a nobler metal material than the aluminum material.

5 Claims, 24 Drawing Sheets

(51) Int. Cl.

| | |
|---|---|
| ***H01R 43/048*** | (2006.01) |
| ***H01R 13/03*** | (2006.01) |
| ***C25D 11/04*** | (2006.01) |
| ***C25D 11/08*** | (2006.01) |
| ***C25D 11/24*** | (2006.01) |
| ***C23C 18/54*** | (2006.01) |
| ***C25D 11/02*** | (2006.01) |
| ***H01R 13/11*** | (2006.01) |

(56) References Cited

U.S. PATENT DOCUMENTS

| | | | | |
|---|---|---|---|---|
| 5,468,163 | A * | 11/1995 | Egenolf | 439/839 |
| 6,024,612 | A * | 2/2000 | Myer | H01R 13/113 439/744 |
| 6,093,064 | A * | 7/2000 | Callen et al. | 439/783 |
| 6,942,529 | B2 * | 9/2005 | Fujimoto | H01R 13/03 439/886 |
| 7,207,850 | B2 * | 4/2007 | Takayama | 439/852 |
| 2002/0111082 | A1 * | 8/2002 | Murakami et al. | 439/884 |
| 2006/0208700 | A1 * | 9/2006 | Kim | H01M 2/0262 320/128 |
| 2010/0067224 | A1 * | 3/2010 | Wu | 362/235 |

FOREIGN PATENT DOCUMENTS

| | | | |
|---|---|---|---|
| JP | 2003-338334 | A | 11/2003 |
| JP | 2004-193073 | A | 7/2004 |
| JP | 2004-199934 | A | 7/2004 |
| JP | 2009-152052 | A | 7/2009 |

* cited by examiner

EXAMPLE2L1

EXAMPLE2L2

EXAMPLE2M1

EXAMPLE2M2

EXAMPLE2M3

EXAMPLE2S1

EXAMPLE2S2

EXAMPLE2S3

CRIMP TERMINAL, CONNECTION STRUCTURAL BODY AND METHOD FOR PRODUCING THE SAME

TECHNICAL FIELD

The present invention relates to a crimp terminal attachable to, for example, a connector or the like for connection of a wire harness for an automobile, a connection structural body including the same, and a method for producing the same; and in more detail, to a crimp terminal connectable to a wire harness and formed of an aluminum material, a connection structural body including the same, and a method for producing the same.

BACKGROUND ART

Today, carbon dioxide emissions from automobiles are required to be reduced. Since reduction of weight of vehicles greatly influences improvement of fuel efficiency, the weight of wire harnesses for connecting electrical components are also required to be reduced. Therefore, it has been studied to, for example, replace copper-based materials which are conventionally used for electric wires or the like used for the wire harnesses with an aluminum material and such an aluminum material has been used for some electric wires.

A terminal usable for connecting electric wires to each other or for connecting an electric wire to an assisting part or component is usually formed of a nobler metal material than aluminum.

However, a connection structural body, obtained by stripping a tip of an insulated wire of a conductor cover to expose a tip of an aluminum conductor and pressure-bonding the tip of the aluminum conductor to the above-mentioned terminal, has a problem that the aluminum conductor formed of an aluminum material less noble than the metal material used to form the terminal is corroded as a result of contact of the aluminum conductor and the terminal; namely, has a problem of galvanic corrosion.

The above-mentioned galvanic corrosion is a phenomenon that when water as an electrolytic solution is attached to a site at which a nobler metal material and a less noble metal material contact each other, a corrosion current is generated, and as a result, the less noble metal material is, for example, corroded, dissolved, or extinguished. In the case of a connection structural body mentioned above, the following problem occurs. The aluminum conductor of the insulated wire is pressure-bonded to a pressure-bonding section of the terminal formed of a nobler metal material than aluminum, and as a result, the aluminum conductor is corroded, dissolved, or extinguished. Therefore, the electric resistance is raised. This causes a problem that the connection structural body cannot exhibit a sufficient conducting function.

In order to prevent galvanic corrosion of such an aluminum conductor used in a connection structural body in which different types of metal materials, namely, a terminal formed of a nobler metal material than aluminum and the aluminum conductor of the insulated wire are connected to each other, Patent Documents 1 and 2, for example, propose the following technology on a crimp terminal. A main body of the crimp terminal is formed of an aluminum material, and an elastic piece for supporting a contact of a terminal, which is to be electrically connected to the crimp terminal, is formed of an iron-based material.

It is described in the above-identified publications that since the wire conductor and a substrate of the main body of the terminal are both formed of an aluminum material and thus have an equal potential, even when the aluminum conductor is connected to the main body of the terminal, the aluminum conductor is prevented from being corroded.

However, the crimp terminal proposed in each of Patent Documents 1 and 2 has a structure in which the elastic piece is assembled to the main body of the terminal formed of a different metal material from that of the elastic piece. Thus, the problem of galvanic corrosion occurs between the main body of the terminal and the elastic piece.

This will be described in more detail. The aluminum material used to form the main body of the terminal is less noble than the iron-based material used to form the elastic piece. Therefore, when an electrolytic solution such as water or the like is attached, the main body of the terminal itself is corroded. This causes pitting corrosion or the like, and as a result, the elasticity of the elastic piece, and the mechanical strength and the like of the terminal itself cannot be maintained. In addition, the conductor is corroded in the pressure-bonging section, which increases the electric resistance, and as a result, the conductor may undesirably lose functions thereof.

In addition, the technology proposed in Patent Documents 1 and 2 is difficult to be applied to the conventional processing procedure for producing a terminal, namely, a continuous procedure of punching out the substrate of the terminal with a press and bending the substrate. Thus, it is difficult to mass-produce the terminal with the technology proposed in Patent Documents 1 and 2.

Meanwhile, in the case where the crimp terminal is entirely formed of an aluminum material, the crimp terminal is usually treated as follows for the purpose of providing a good electric connection with a component to which the crimp terminal is to be connected or pressure-bonded. For example, at least a surface of a connection section or a pressure-bonding section of the crimp terminal is covered with a conductive contact body having high electric connectability and containing a nobler metal material than the aluminum material, for example, is plated with, for example, tin, gold, a copper alloy or the like.

However, when an electrolytic solution is attached to a contact part where the crimp terminal formed of an aluminum substrate and the conductive contact body containing a nobler metal material than the aluminum material, there occurs a problem that galvanic corrosion occurs to the contact part of the crimp terminal formed of the aluminum substrate, which undesirably decreases the conductivity with the other conductive members.

In addition, in the case where a terminal to which the connection section is to be connected is an aluminum terminal, or in the case where a wire conductor to which the pressure-bonding section is to be pressure-bonded is an aluminum terminal, there occurs a problem that the above-mentioned conductive contact body used to cover at least the surface of the connection section or the pressure-bonding section of the crimp terminal causes galvanic corrosion of the aluminum wire conductor and the aluminum terminal.

CITATION LIST

Patent Literature

Patent Document 1: Japanese Laid-Open Patent Publication No. 2004-199934

Patent Document 2: Japanese Laid-Open Patent Publication No. 2003-338334

SUMMARY OF INVENTION

Technical Problem

The present invention has an object of providing a crimp terminal, a connection structural body, and a method for producing the same, which prevent galvanic corrosion of a contact part where an aluminum substrate and a conductive contact body formed of a nobler metal material than an aluminum material and thus provide high conductivity with another conductive member.

Solution to Problem

The present invention is directed to a crimp terminal, which is formed of an aluminum substrate of an aluminum material and includes a connection section and a pressure-bonding section including a wire barrel section and an insulating barrel section, the connection section, the wire barrel section and the insulating barrel section being located in this order. A conductive contact body containing a nobler metal material than the aluminum material is provided on a contact part of a surface of the aluminum substrate where the aluminum substrate contacts another conductive member; and an insulating body-forming part is formed on a border between the aluminum substrate and the conductive contact body along an outer periphery of the conductive contact body.

Since exposed surfaces of the conductive contact body and the aluminum substrate are not directly adjacent to each other and are distanced from each other, the resistance of the corrosion current, which is in proportion to the distance, can be increased. Thus, generation of galvanic corrosion can be prevented or delayed.

The aluminum material encompasses an aluminum material and an aluminum alloy material.

The crimp terminal encompasses both of a male crimp terminal and a female crimp terminal.

The nobler metal material than the aluminum material refers to a metal material having a smaller ionization tendency than the aluminum substrate formed of the aluminum material, for example, copper, tin or the like.

The connection section may be, for example, a male tab of a male terminal or a box section of a female terminal.

The contact part may be, for example, a part of the contact section that is to be electrically connected to the male tab, such as a contact piece having elasticity so as to be in contact with the male tab of the male terminal which is to be inserted into the box section, or a bead part having a contact convex part; or a part of a pressure-bonding section that is to be electrically connected with the aluminum conductor of the insulated wire such as a wire barrel section to be pressure-bonded with the aluminum conductor.

In an embodiment of the invention, the insulating body-forming part may be an anodized part formed as a result of anodization performed on the surface of the aluminum substrate.

The insulating body-forming part is an anodized part formed as a result of anodization performed on the surface of the aluminum substrate. Owing to this, the electrolytic solution can be prevented from being directly attached to the surface of the aluminum substrate.

This will be described in more detail. Even if the electrolytic solution is, for example, attached to the border between the aluminum substrate and the conductive contact body along the outer periphery of the conductive contact body and thus is present between the surface of the aluminum substrate and the conductive contact body, if the anodized part is formed on the border between the aluminum substrate and the conductive contact body along the outer periphery of the conductive contact body, namely, at least on the outer periphery of the contact part on the surface of the aluminum substrate, the electrolytic solution can be prevented from directly contacting the surface of the aluminum substrate and thus generation of galvanic corrosion of the aluminum substrate can be prevented.

Thus, generation of galvanic corrosion of the aluminum substrate can be prevented, and high conductivity with another conductive member can be provided.

The conductive contact body is formed of a material on a surface of which an anodized part can be formed. Owing to this, the anodized part can be formed on the surface of the aluminum substrate and also, for example, a surface of a part of the conductive contact body provided on the contact part that is protruded from the contact part and exposed outside.

As described above, the anodized part is formed on the surface of the conductive contact body. This is preferable because the conductive contact body including the part exposed outside can be protected by the anodized part, and the electrolytic solution is further prevented from being present between the aluminum substrate and the conductive contact body and thus causing galvanic corrosion.

In an embodiment of the invention, the anodized part may be formed on the entirety of the surface of the aluminum substrate except for a part having the conductive contact body formed thereon.

Owing to the above-described structure, the electrolytic solution can be prevented from being present between the aluminum substrate and the conductive contact body and thus causing galvanic corrosion with certainty.

The crimp terminal according to the present invention encompasses a crimp terminal having the anodized part on the entirety of the aluminum substrate except for the press-sheared edge thereof generated as a result of press shearing.

Owing to the structure in which the anodized part is formed on the entirety of the aluminum substrate except for the press-sheared edge thereof, the exposed surfaces of the conductive contact body and the aluminum substrate are not directly adjacent to each other and are distanced from each other. Therefore, the resistance of the corrosion current, which is in proportion to the distance, can be increased. Thus, generation of galvanic corrosion can be prevented or delayed.

In an embodiment of the invention, the anodized part may be formed on the aluminum substrate including a press-sheared edge thereof generated as a result of press shearing.

Even if an oxidized film is formed on the surface of the aluminum substrate before press shearing, the oxidized film is not formed, after press shearing, on a part along which the aluminum plate is press-sheared, namely, the press-sheared edge. When the electrolytic solution is attached to the press-sheared edge on which the oxidized film is not formed, the electrolytic solution is directly attached to the surface of the aluminum substrate.

When the electrolytic solution is present between the press-sheared edge and the conductive contact body, galvanic corrosion occurs especially to the press-sheared edge of the aluminum substrate.

In the case where the anodized part is formed on the aluminum substrate including the press-sheared edge, galvanic corrosion does not occur from the press-sheared edge. Thus, galvanic corrosion can be prevented from being caused to any part of the aluminum substrate.

In an embodiment of the invention, at least the anodized part may be obtained as a result of hole sealing by which a plurality of holes at a surface of the anodized part is sealed.

The plurality of holes at the at a surface of the anodized part is sealed. Therefore, the electrolytic solution is prevented from entering the plurality of holes. This can improve the corrosion resistance and also the mechanical strength of the anodized part.

Hole sealing is performed on a non-anodized part of the surface of the aluminum substrate. As a result, the part is covered with a boehmite film and thus can be further insulated.

Hole sealing using, for example, water vapor or boiled deionized water having a temperature of 90 to 100° C. is performed as follows, for example. The aluminum substrate is immersed in, and exposed to, vapor or boiled deionized water pressurized to have an atmospheric pressure of 1 to 5 for 0.5 to 30 minutes.

Hole sealing using, for example, silicic acid is performed as follows, for example. The aluminum substrate is immersed in a bath of sodium silicate at a bath temperature of 80 to 100° C. for 20 to 30 minutes.

In an embodiment of the invention, at least the anodized part may be obtained as a result of water-repelling treatment.

Water-repelling treatment performed on the anodized part makes it difficult for the electrolytic solution such as water or the like to be attached to the surface of the anodized part. As compared with the case where only hole sealing is performed on the anodized part, generation of galvanic corrosion of the aluminum substrate is prevented with more certainty, and thus the corrosion resistance of the anodized part can be further improved.

The surface of the anodized film which is not treated with hole sealing has minute roughness. Water-repelling treatment makes it difficult for water to enter such minute roughness and can further prevent galvanic corrosion.

The present invention is directed to a connection structural body comprising the above-described the crimp terminal; and an insulated wire. The conductive member is the insulated wire having an aluminum conductor tip part which is obtained as a result of stripping a tip of a conductive cover for covering an aluminum conductor to expose a tip of the aluminum conductor; the contact part is provided in the wire barrel section to which the aluminum conductor tip part is pressure-bonded; the aluminum conductor tip part is connected to the wire barrel section by pressure bonding; and the anodized part is formed on the aluminum conductor tip part.

As described above, the anodized part is formed on the aluminum conductor tip part as well as the crimp terminal. Owing to this, the electrolytic solution can be prevented from being attached to the surface of the aluminum conductor tip part.

Therefore, in the connection structural body in which the insulated wire is connected to the crimp terminal, even if the electrolytic solution is present between the conductive contact body provided on the wire barrel section and containing a nobler metal material than the aluminum material and the surface of the aluminum conductor tip part, galvanic corrosion of the surface of the aluminum conductor tip part can be prevented.

The present invention is directed to a crimp terminal, which is formed of an aluminum substrate of an aluminum material and includes a connection section and a pressure-bonding section including a wire barrel section and an insulating barrel section, the connection section, the wire barrel section and the insulating barrel section being located in this order. A conductive contact body containing a nobler metal material than the aluminum material is provided on a contact part of a surface of the aluminum substrate where the aluminum substrate contacts another conductive member; and an insulating cover formed of an insulating resin is formed on a border between the aluminum substrate and the conductive contact body along an outer periphery of the conductive contact body.

As described above, the insulating cover is formed on the border between the aluminum substrate and the conductive contact body along an outer periphery of the conductive contact body. Owing to this, galvanic corrosion of the conductive contact body and the aluminum substrate can be prevented.

This will be described in more detail. The aqueous solution of electrolyte can be distanced from the exposed surfaces of the conductive contact body and the aluminum substrate with certainty. Therefore, even if a circuit of a corrosion cell is formed by the aqueous solution of electrolyte, the circuit resistance can be made high and thus galvanic corrosion can be prevented. Alternatively, the exposed surfaces can be distanced from each other with certainty. Therefore, the aqueous solution of electrolyte is not attached in a continuous manner but merely in the shape of discrete drops. This blocks the corrosion cell circuit, and thus can prevent galvanic corrosion.

Therefore, galvanic corrosion of the aluminum substrate can be prevented, and the crimp terminal can have a high conducting function with another conductive member.

In an embodiment of the invention, the insulating cover may be formed on the aluminum substrate including a press-sheared edge thereof generated as a result of press shearing.

Even if an oxidized film is formed on the surface of the aluminum substrate before press shearing, the oxidized film is not formed, after press-shearing, on a part along which the aluminum plate is press-sheared, namely, the press-sheared edge. When the electrolytic solution is attached to the press-sheared edge on which the oxidized film is not formed, the electrolytic solution is directly attached to the surface of the aluminum substrate.

When the electrolytic solution is present between the press-sheared edge and the conductive contact body, galvanic corrosion occurs especially to the press-sheared edge of the aluminum substrate.

In the case where the insulating cover is formed on the aluminum substrate including the press-sheared edge, galvanic corrosion does not occur from the press-sheared edge. Thus, galvanic corrosion can be prevented from being caused to any part of the aluminum substrate.

In an embodiment of the invention, the insulating cover may be formed on an area of the aluminum substrate that is exposed outside the outer periphery of the conductive contact body from the outer periphery of the conductive contact body.

The insulating cover can be formed so as to overlap the surface of the conductive contact body as well as on the surface of the aluminum substrate. Therefore, generation of galvanic corrosion can be prevented with certainty.

This will be described in more detail. In the case where the insulating cover is formed only on the surface of the aluminum substrate without overlapping the surface of the conductive contact body, there is a possibility that the aqueous solution of electrolyte enters the interface between the conductive contact body and the aluminum substrate. When this occurs, galvanic corrosion may undesirably occur to the aluminum substrate/conductive contact body interface.

By contrast, according to the above-described structure, the insulating cover can be formed so as to overlap the surface of the conductive contact body as well as on the surface of the aluminum substrate. Therefore, the aqueous solution of electrolyte can be prevented from entering the interface between the conductive contact body and the aluminum substrate with more certainty.

Thus, generation of galvanic corrosion can be prevented with certainty.

In an embodiment of the invention, the insulating cover may include an aluminum substrate insulating cover located on the surface of the aluminum substrate; and a conductive contact body insulating cover located on a surface of the conductive contact body; and the aluminum substrate insulating cover and the conductive contact body insulating cover may be formed integrally as striding over the border between the aluminum substrate and the conductive contact body along the outer periphery of the conductive contact body.

According to the above-described structure, the insulating cover can be integrally formed on an area from the outer periphery of the conductive contact body to an area of the aluminum substrate outside the conductive contact body. Therefore, the aqueous solution of electrolyte can be prevented from entering the interface between the conductive contact body and the aluminum substrate with more certainty.

Thus, generation of galvanic corrosion can be prevented with more certainty.

In the case where the insulating cover is formed only on the surface of the aluminum substrate without overlapping the surface of the conductive contact body, there is a possibility that the aqueous solution of electrolyte enters the interface between the conductive contact body and the aluminum substrate. When this occurs, galvanic corrosion may undesirably occur to the aluminum substrate/conductive contact body interface. By contrast, owing to the above-described structure, the insulating cover can be formed so as to overlap the surface of the conductive contact body as well as on the surface of the aluminum substrate. Therefore, the aqueous solution of electrolyte can be prevented from entering the interface between the conductive contact body and the aluminum substrate with more certainty.

Thus, generation of galvanic corrosion can be prevented with more certainty.

In an embodiment of the invention, the conductive member may be a connectable aluminum conductive member connected to the connection section and formed of an aluminum material; and the contact part may be provided on the connection section.

In a structure in which the connectable aluminum conductive member is connected to the connection section, the contact part formed of a nobler material than the aluminum material can be confined in the connection section so as not to be exposed outside, so that galvanic corrosion is prevented. Alternatively, even if the contact part is slightly exposed, corrosion of the connectable aluminum conductive member which is less noble can be minimized because the contact part has a minute area size.

The connectable aluminum conductive member may be, for example, an aluminum terminal which can be connected to the crimp terminal, for example, a component, device or electric wire.

In an embodiment of the invention, the conductive member may be the insulated wire having an aluminum conductor tip part which is obtained as a result of stripping a front part of a conductive cover for covering an aluminum conductor to expose a front part of the aluminum conductor; and the contact part may be provided in the wire barrel section to which the aluminum conductor tip part is pressure-bonded.

The aluminum conductor tip part is formed of an aluminum material which is less noble than the material of the conductive contact body. Therefore, in the case where the aluminum conductor tip part is pressure-bonded to the wire barrel section, when the electrolytic solution is attached to the contact part, the aluminum conductor tip part is corroded.

However, according to the above-described structure, in the crimp terminal having the aluminum conductor tip part pressure-bonded to the pressure-bonding section, the contact part formed of a nobler material than the aluminum material is confined in the pressure-bonding section so as not to be exposed outside. Owing to this, galvanic corrosion can be prevented. Alternatively, even if the contact part is slightly exposed, corrosion of the aluminum conductor tip part which is less noble can be minimized because the contact part has a minute area size.

The present invention is directed to a connection structural body comprising the above-described crimp terminal; and the above-described insulated wire. The aluminum conductor tip part is connected to the wire barrel section by pressure bonding.

The insulating cover is formed on the border between the aluminum substrate and the conductive contact body along the outer periphery of the conductive contact body. Owing to this, the aqueous solution of electrolyte can be distanced from the exposed surfaces of the conductive contact body and the aluminum substrate with certainty. In addition, the aqueous solution of electrolyte can be distanced from the exposed surfaces of the conductive contact body and the aluminum conductor tip part.

Therefore, in the connection structural body, galvanic corrosion of the interface between the aluminum conductor tip part of the aluminum wire and the conductive contact body containing a nobler metal material than the aluminum material can be prevented.

The present invention is directed to a method for producing a crimp terminal, the crimp terminal being formed of an aluminum substrate of an aluminum material and including a connection section and a pressure-bonding section including a wire barrel section and an insulating barrel section, the connection section, the wire barrel section and the insulating barrel section being located in this order, the method comprising a conductive contact body-forming step of forming a conductive contact body, containing a nobler metal material than the aluminum material, on a contact part of a surface of the aluminum substrate where the aluminum substrate is to contact another conductive member; an anodization step of anodizing a border between the aluminum substrate and the conductive contact body along an outer periphery of the conductive contact body to form an anodized part, the anodization step being performed after the conductive contact body-forming step; and a punching-out step of punching out the aluminum substrate into a developed shape of the crimp terminal, and a bending step of bending the developed shape into a three-dimensional shape, which are performed in this order.

According to the method for producing a crimp terminal, the anodization step is performed before the aluminum substrate is punched out into the developed shape of the crimp terminal in the punching-out step. Owing to this, the anodized part can be formed on the entirety of the pre-punching-out aluminum substrate including areas corresponding to a plurality of crimp terminal except for the conductive contact bodies. Therefore, the anodization step can be performed quickly and efficiently.

In an embodiment of the invention, the punching-out step may be performed prior to the anodization step instead of between the anodization step and the bending step.

According to the method for producing the crimp terminal, the punching-out step is performed before the anodization step. Owing to this, the anodized part can be formed on the surface of the aluminum substrate which is punched out into the developed shape of the crimp terminal and includes the press-sheared edge generated as a result of punching-out.

Therefore, galvanic corrosion does not occur from the press-sheared edge, and galvanic corrosion can be prevented from being caused to any part of the surface of the aluminum substrate.

The punching-out step may be performed before or after the conductive contact body-forming step as long as being performed before the anodization step.

In an embodiment of the invention, the method may further comprise a hole sealing step, performed on at least a surface of the anodized part, of sealing a plurality of holes at the surface of the anodized part.

Owing to the hole sealing step, a plurality of holes at the surface of the anodized part can be sealed. Thus, the electrolytic solution is prevented from entering the plurality of holes. This can improve the corrosion resistance and also the mechanical strength of the anodized part.

The hole sealing is performed on a non-anodized part of the surface of the aluminum substrate. As a result, the part is covered with a boehmite film and thus can be further insulated.

The present invention is directed to a method for producing a connection structural body, by which an insulated wire having an aluminum conductor tip part which is obtained as a result of stripping a tip of a conductive cover for covering an aluminum conductor to expose a tip of the aluminum conductor is connected to a crimp terminal which is formed of an aluminum substrate of an aluminum material and including a connection section and a pressure-bonding section including a wire barrel section and an insulating barrel section, the connection section, the wire barrel section and the insulating barrel section being the located in this order. The crimp terminal is produced by any of the above-described methods.

According to the above-described production method, in the anodization step, the anodized part is formed on the aluminum conductor tip part as well as on the aluminum substrate of the crimp terminal. Owing to this, the electrolytic solution can be prevented from being directly attached to the surface of the aluminum conductor tip part.

Therefore, even if the electrolytic solution is present between the conductive contact body and the surface of the aluminum conductor tip part, galvanic corrosion of the surface of the aluminum conductor tip part can be prevented.

Especially according to the above-described production method, the anodization step is performed on the crimp terminal before the aluminum conductor tip part is pressure-bonded to the crimp terminal. Owing to this, the aluminum conductor tip part does not disturb the anodization step, and the anodized part can be formed on prescribed areas of the crimp terminal except for the contact part, with certainty and smoothly.

The anodized part may be or may not be formed also on the aluminum conductor tip part before the aluminum conductor tip part is pressure-bonded to the crimp terminal. From the viewpoint of preventing galvanic corrosion with more certainty, it is preferable that the anodized part is formed also on the prescribed areas of the aluminum conductor tip part before the aluminum conductor tip part is pressure-bonded to the crimp terminal.

The present invention is directed to a method for producing a connection structural body, by which an insulated wire having an aluminum conductor tip part which is obtained as a result of stripping a tip of a conductive cover for covering an aluminum conductor to expose a tip of the aluminum conductor is connected to a crimp terminal which is formed of an aluminum substrate of an aluminum material and including a connection section and a pressure-bonding section including a wire barrel section and an insulating barrel section, the connection section, the wire barrel section and the insulating barrel section being located in this order, the method comprising a conductive contact body-forming step of forming a conductive contact body, containing a nobler metal material than the aluminum material, on a contact part of a surface of the aluminum substrate where the aluminum substrate is to contact another conductive member; a punching-out step of punching out the aluminum substrate into a developed shape of the crimp terminal, and a bending step of bending the developed shape into a three-dimensional shape, the conductive contact body-forming step, the punching-out step and the bending step being performed in any order; a pressure-bonding step of pressure-bonding the pressure-bonding section of the crimp terminal to the aluminum conductor tip part; and an anodization step of forming an anodized part on a border between the aluminum substrate and the conductive contact body along an outer periphery of the conductive contact body and an exposed conductor part of the aluminum conductor tip part that is not pressure-bonded to the wire barrel section and exposed outside.

As described above, in the anodization step, the anodized part is formed on the aluminum conductor tip part as well as on the aluminum substrate of the crimp terminal. Owing to this, the electrolytic solution can be prevented from being directly attached to the surface of the aluminum conductor tip part.

Therefore, even if the electrolytic solution is present between the conductive contact body and the surface of the aluminum conductor tip part, galvanic corrosion of the surface of the aluminum conductor tip part can be prevented.

Especially according to the above-described production method, the anodization step is performed on the aluminum substrate and on the exposed conductor part of the aluminum conductor tip part at the same time after the pressure-bonding step. Owing to this, there is no undesirable possibility that in the bending step or the pressure-bonding step, the anodized part is cracked and thus is delaminated from the aluminum substrate. Thus, galvanic corrosion of the aluminum substrate and the aluminum conductor tip part can be prevented.

This will be described in more detail. The anodized part is easily cracked when being supplied with a load. For example, when the bending step is performed on the crimp terminal, the edge of the crimp terminal may be undesirably cracked. When the pressure-bonding step is performed, the pressure-bonding part or the surrounding area may be undesirably cracked. When this occurs, the anodized part of the cracked part is delaminated to expose the surface of the aluminum substrate, which may undesirably cause galvanic corrosion.

In the case where the anodization step is performed on the aluminum substrate and on the exposed conductor part of the aluminum conductor tip part at the same time after the pressure-bonding step as according to the above-described production method, there is no undesirable possibility that the anodized part is cracked in the pressure-bonding step to expose the surface of the aluminum substrate used to form the crimp terminal, unlike in the case where the anodized part is formed before the pressure-bonding step. The anodized part can be formed to cover the aluminum substrate and the exposed conductor part of the aluminum conductor tip part with certainty.

Therefore, galvanic corrosion of the aluminum substrate and the aluminum conductor tip part can be prevented.

In the above-described production method, the anodization step may be performed before the pressure-bonding step, or before and after the pressure-bonding step.

In the case where the anodization step is performed before and after the pressure-bonding step as described above, the anodization step can be performed each time when the bending step or the pressure-bonding step, which may easily crack the anodized part, is finished.

Therefore, even if the anodized part is cracked by the bending step or the pressure-bonding step and the surface of the crimp terminal or the aluminum conductor tip part is exposed, such an exposed part can be covered with the anodized part. Therefore, generation of galvanic corrosion can be prevented with certainty.

In an embodiment of the invention, the method may further comprise a hole sealing step, performed on at least the anodized part, of sealing a plurality of holes at a surface thereof.

Owing to the hole sealing step, a plurality of holes at the surface of the anodized part of the connection structural body can be sealed. Thus, the electrolytic solution is prevented from entering the plurality of holes. This can improve the corrosion resistance and also the mechanical strength of the anodized part.

The hole sealing step is performed on non-anodized parts of the crimp terminal and the aluminum conductor tip part of the connection structural body. As a result, such parts are covered with a boehmite film and thus can be further insulated.

The present invention is directed to a method for producing a crimp terminal, the crimp terminal being formed of an aluminum substrate of an aluminum material and including a connection section and a pressure-bonding section including a wire barrel section and an insulating barrel section, the connection section, the wire barrel section and the insulating barrel section being located in this order, the method comprising a conductive contact body-forming step of forming a conductive contact body, containing a nobler metal material than the aluminum material, on a contact part of a surface of the aluminum substrate where the aluminum substrate is to contact another conductive member; an insulating cover-forming step of forming an insulating cover of an insulating resin on a border between the aluminum substrate and the conductive contact body along an outer periphery of the conductive contact body, which is performed before or after the conductive contact body-forming step; and a punching-out step of punching out the aluminum substrate into a developed shape of the crimp terminal, and a bending step of bending the developed shape into a three-dimensional shape, which are performed in this order.

The above-described method for producing a crimp terminal provides an effect that galvanic corrosion of the aluminum substrate is prevented and high conductivity with another conductive member is provided.

In an embodiment of the invention, the conductive contact body-forming step and the insulating cover-forming step may be performed in this order; and the insulating cover-forming step may include the step of forming an aluminum substrate insulating cover of an insulating resin on the surface of the aluminum substrate, and the step of forming a conductive contact body insulating cover of the insulating resin on a surface of the conductive contact body. The aluminum substrate insulating cover and the conductive contact body insulating cover may be formed integrally as striding over the border between the aluminum substrate and the conductive contact body along the outer periphery of the conductive contact body.

According to the above-described production method, the aluminum substrate insulating cover and the conductive contact body insulating cover can be formed integrally as striding over the border between the aluminum substrate and the conductive contact body along the outer periphery of the conductive contact body.

The border between the aluminum substrate and the conductive contact body along the outer periphery of the conductive contact body can be covered with the insulating resin with no gap. Therefore, there is no undesirable possibility that the aqueous solution of electrolyte enters via the interface between the conductive contact body and the aluminum substrate by the capillary phenomenon, and generation of galvanic corrosion can be prevented with certainty.

In a heat treating step, heat treatment may be performed on the crimp terminal at a temperature higher than a melting temperature of the insulating resin. Owing to this, even if the insulating cover is delaminated or cracked by a step during the production of the crimp terminal such as the punching-out step or the bending step, such a defective part can be sealed with the melted insulating cover.

Advantageous Effects of Invention

The present invention provides a crimp terminal, a connection structural body, and a method for producing the same, which, even when an electrolytic solution is directly attached to a surface of an aluminum substrate so that the electrolytic solution is present between the aluminum substrate and a conductive contact body containing a nobler metal material than an aluminum material, prevent galvanic corrosion of the aluminum substrate and thus provide high conductivity with another conductive member.

DESCRIPTION OF EMBODIMENTS

Figure 1A:
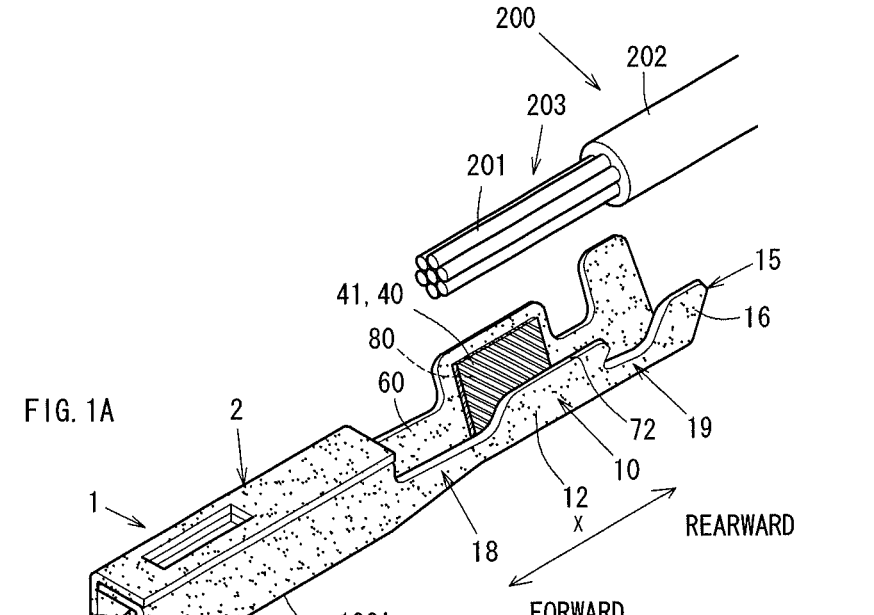
FIGS. 1A and 1B each show a crimp terminal and a connection structural body in Embodiment 1.

Hereinafter, in embodiments of the present invention, a crimp terminal 1 formed of an aluminum substrate 100A which is formed of an aluminum material and including a box section 2 and a pressure-bonding section which includes a wire barrel section 10 and an insulation barrel section 15 will be described with reference to the drawings. The box section 2, the wire barrel section 10 and the insulation barrel section 15 are located in this order.

First, in Embodiments 1 through 3, a crimp terminal 1 including an anodized film 60 which is formed as an insulating body-forming part at least on a border, as seen in a plan view, between a plated part 40 and the aluminum substrate 100A on a surface of the aluminum substrate 100A will be described, and also a connection structural body 1*a* including the crimp terminal 1 will be described.

The "border, as seen in a plan view, between the plated part 40 and the aluminum substrate 100A" refers to a part which is a border between the plated part 40 and the aluminum substrate 100A when the aluminum substrate 100A is seen in a plan view, and is a border between the aluminum substrate 100A and the plated part 40 along an outer periphery of the plated part 40.

The expression "as seen in a plan view" as used in the "border, as seen in a plan view" refers to a state where the plated part 40 in the aluminum substrate 100A is seen from above in a vertical direction.

Embodiment 1

FIG. 1 shows isometric views of the crimp terminal 1 and the connection structural body 1*a* in Embodiment 1. FIG. 2 shows the crimp terminal 1, and FIG. 3 shows a plate-like aluminum plate 100 used to form the crimp terminal 1.

Figure 1B:
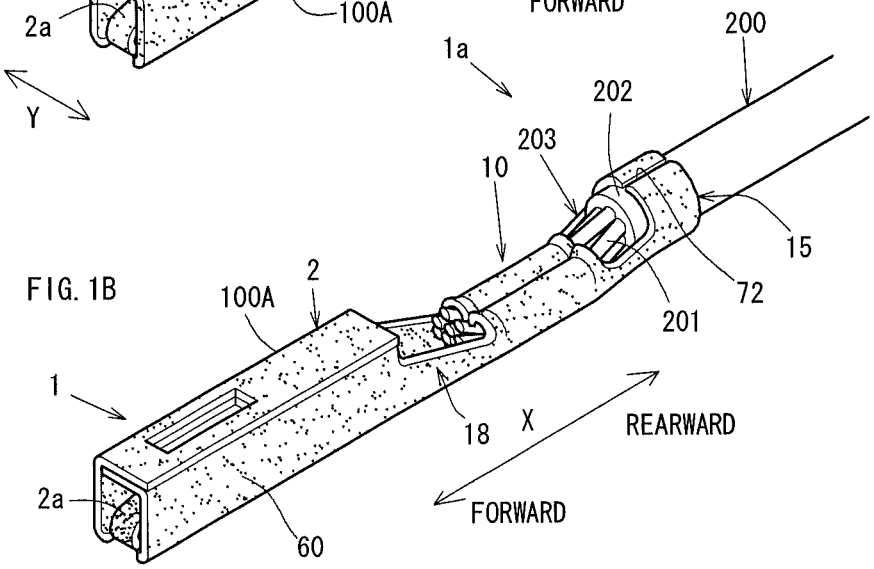

In more detail, FIG. 1A is an isometric view of the crimp terminal 1 and an insulated wire 200 which is before pressure-bonded to the crimp terminal 1 in Embodiment 1. FIG. 1B is an isometric view of the connection structural body 1*a*.

Figure 2A:
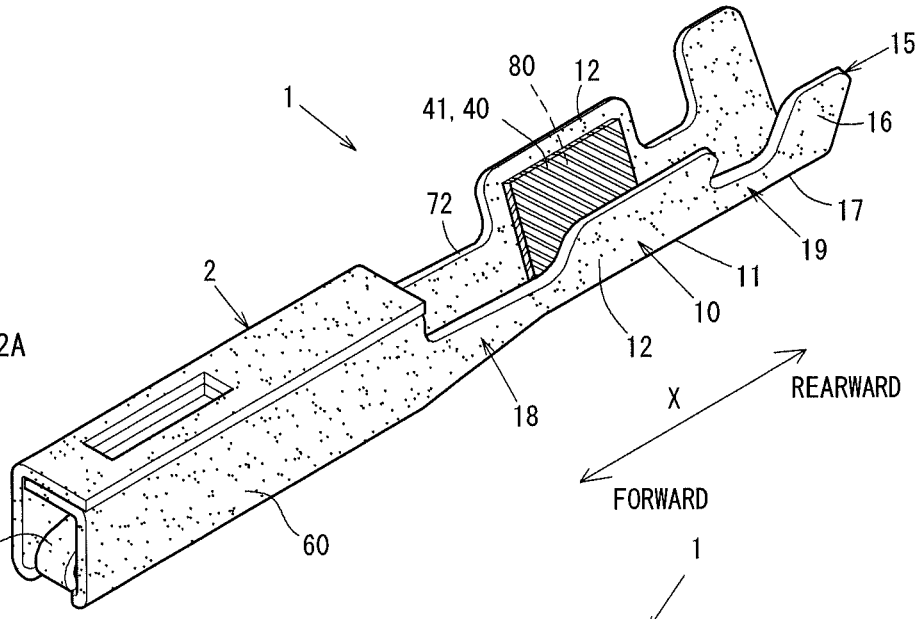
FIGS. 2A through 2C each show the crimp terminal in Embodiment 1.
Figure 2B:
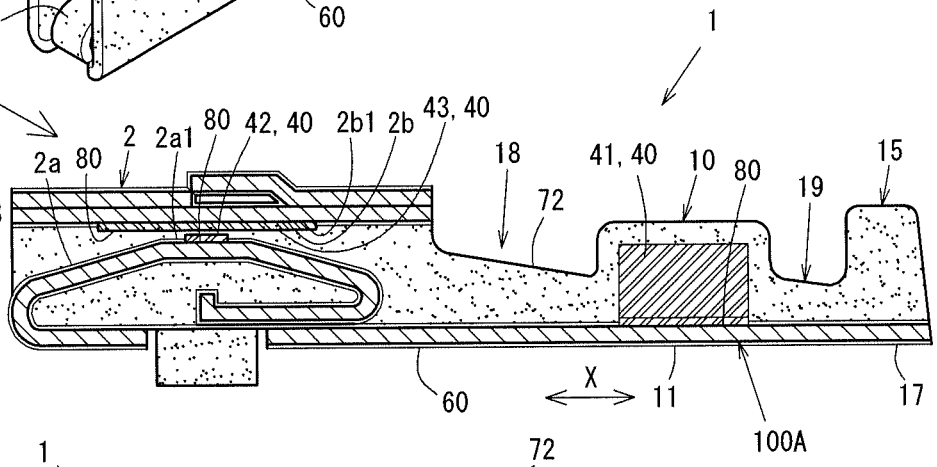
Figure 2C:
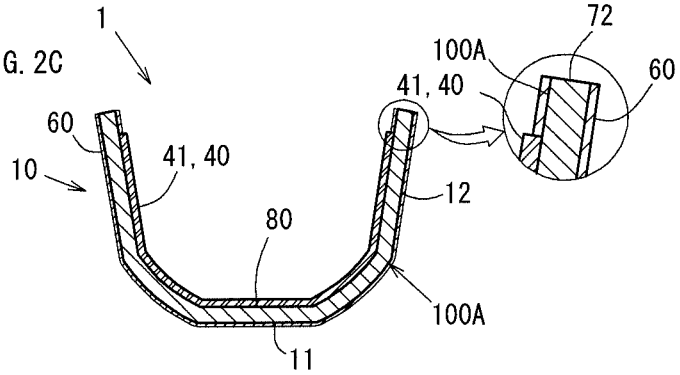

FIG. 2A is an isometric view of the crimp terminal 1. FIG. 2B is a vertical cross-sectional view of the crimp terminal 1 taken along a line extending in a longitudinal direction at an intermediate position in a width direction Y. FIG. 2C is a cross-sectional view of the wire barrel section 10 of the crimp terminal 1 taken along a line extending perpendicularly to the longitudinal direction.

Figure 3A:
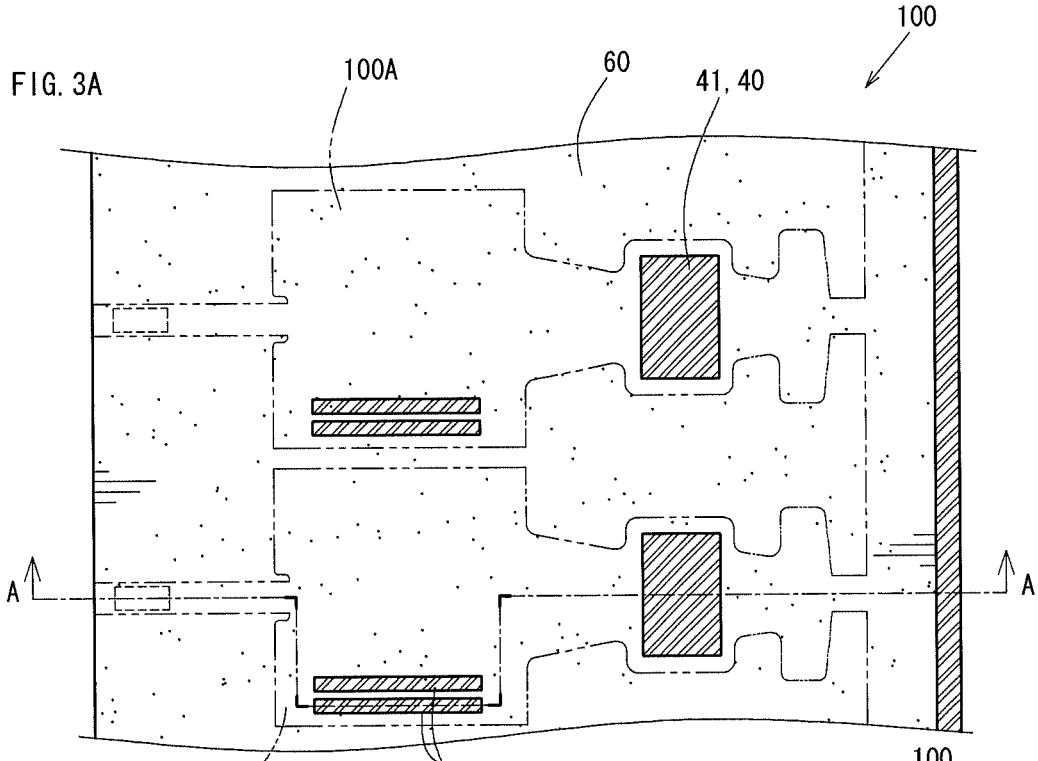
FIGS. 3A and 3B each show an aluminum substrate before a shape of the crimp terminal in Embodiment 1 is punched out.
Figure 3B:
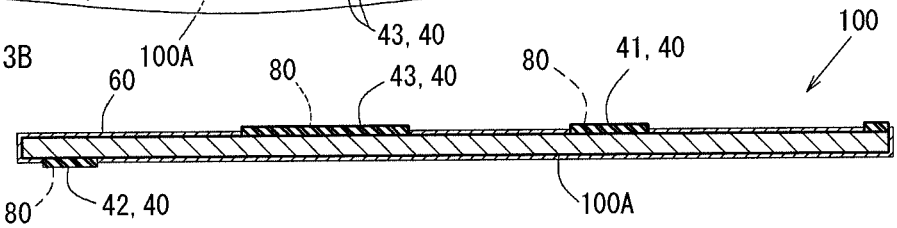

FIG. 3A is a partial plan view of the plate-like aluminum plate 100 which is to be processed into the crimp terminal 1, and FIG. 3B is a cross-sectional view taken along line A-A of FIG. 3A.

The connection structural body 1*a* includes the crimp terminal 1 and the insulated wire 200 connected to the crimp terminal 1 by pressure bonding. The insulated wire 200 includes, for example, an aluminum conductor 201, which is a core wire having a composition of ECAI (JIS A1060 or A1070 for an aluminum alloy line material for power transmission cables), and a conductor cover 202 for covering the aluminum conductor 201. A tip part of the conductor cover 202 is peeled off to expose a tip part of the aluminum conductor 201. The exposed tip part is an aluminum conductor tip part 203.

This will be described in more detail. The insulated wire 200 includes the aluminum conductor 201 formed of twisted aluminum wires and the conductor cover 202 formed of an insulating resin for covering the aluminum conductor 201. The aluminum conductor 201 may be formed of, for example, 11 twisted wires and have a conductor cross-sectional area size of 0.75 $mm^2$.

The crimp terminal 1 in Embodiment 1 is a female terminal corresponding to a tab width of 0.64 mm. The crimp terminal 1 includes, from a forward end to a rearward end in the longitudinal direction X thereof, the box section 2 for allowing insertion of a male tab of a male terminal (not shown), the wire barrel section 10 located rearward to the box section 2 with a first transition 18 of a prescribed length interposed therebetween, and the insulation barrel section 15 located rearward to the wire barrel section 10 with a second transition 19 of a prescribed length interposed therebetween. The box section 2, the wire barrel section 10 and the insulation barrel section 15 are integrally formed.

The box section 2 is formed of a hollow quadrangular prism. The box section 2 accommodates a contact piece 2*a* which is bent rearward in the longitudinal direction X and has a contact convex part 2*a*1, which is to be in contact with the male tab of the male terminal to be inserted, and a bead part 2*b* having a contact convex part 2*b*1.

As shown in FIG. 2A, the wire barrel section 10 in a pre-pressure-bonding state includes a barrel bottom 11 and wire barrel pieces 12 extending in oblique outer upper directions from both sides of the barrel bottom 11 in the width direction Y. The wire barrel section 10 is U-shaped when seen in a rear view. Similarly, the insulation barrel section 15 in a pre-pressure-bonding state includes a barrel bottom 17 and insulation barrel pieces 16 extending in oblique outer upper directions from both sides of the barrel bottom 17 in the width direction Y. The insulation barrel section 15 is U-shaped when seen in a rear view.

The above-described crimp terminal 1 includes the aluminum substrate 100A formed of an aluminum material and obtained by punching out the plate-like aluminum plate 100 into a shape of the terminal, the plated part 40 provided on contact parts 80 of a surface of the aluminum substrate 100A that are to be in contact with other conductors, and an anodized film 60 obtained by anodizing at least an outer periphery of the plated part 40 on the aluminum substrate 100A.

As shown in FIG. 2B, the plated part 40 is formed of tin, which is nobler than the aluminum material, and includes a wire barrel-side plated part 41, a contact piece-side plated part 42 and a bead part-side plated part 43.

The wire barrel-side plated part 41 is formed on a part which is to be in contact with the aluminum conductor tip part 203, namely, on an inner surface of the wire barrel section 10.

The contact piece-side plated part 42 and the bead part-side plated part 43 are formed on parts which are to be in contact with the male tab of the male terminal when the male terminal is inserted into the box section 2. In more detail, the contact piece-side plated part 42 is formed on the contact convex part 2*a*1 of the contact piece 2*a*, and the bead part-side plated part 43 is formed on the contact convex part 2*b*1 of the bead part 2*b*.

The anodized film 60 is formed on the entirety of the aluminum substrate 100A used to form the crimp terminal 1 except for the contact parts 80 and a press-sheared edge 72 (see a partial enlarged view in FIG. 2C). The anodized film 60 is formed to have a thickness of 1 to 10 μm and a Vickers hardness of Hv 300-600.

Now, a method for producing the above-described crimp terminal 1 in Embodiment 1 will be described. As the aluminum plate 100, an aluminum alloy strip is prepared.

A preferable material of the aluminum plate 100 is, for example, of alloy No. A6022 and temper designation T4. Any material having a composition and temper designation which can be molded into the terminal is usable. There is no specific limitation on the thickness of the plate, but the aluminum plate 100 is preferably thin to a certain extent because a compact terminal has a small tab width. A preferable thickness is 0.1 to 0.3 mm.

The crimp terminal 1 is produced by a plating step of forming the plated part 40, an anodization step, a press step (punching out, bending), and a hole sealing step which are performed on the surface of the plate-like aluminum plate 100 in this order.

In a pre-plating process, the surface of the plate-like aluminum plate 100, which is a base material, is zincated to be plated with an underlying material. Then, the plating step is performed to form a plurality of layers of tin.

In the plating step, tin plating is performed in a spot-like manner. Specifically, parts of the surface of the aluminum plate 100 that correspond to the contact parts 80, namely, the contact convex part 2*a*1 of the contact piece 2*a*, the contact convex part 2*b*1 of the bead part 2*b*, and the inner surface of the wire barrel section 10 are plated.

In a pre-anodization step, degreasing, electrolytic polishing, smut removal are performed. For degreasing, the aluminum plate 100 is immersed in sulfuric acid having a concentration of 5 to 25% at a bath temperature of 60 to 100° C. for 60 to 180 seconds. The electrolytic polishing is performed in phosphoric acid having a concentration of 15% at a temperature of 60° C. and a current density of 30 to 50 A/dm$^2$ for 5 to 20 seconds. In the anodization step, generated bubbles do not need to be washed away by vibration. For smut removal, the aluminum plate 100 is immersed in nitric acid having a concentration of about 30% at room temperature for 20 to 30 seconds.

For the anodization step, an electrolytic bath may be of, for example, phosphoric acid, sulfuric acid, oxalic acid, chromic acid, ammonium tartrate, tartrate, borate, a mixed aqueous solution of boric acid and sodium borate, citric acid, maleic acid, glycolic acid or the like. The following conditions may each be set to an appropriate value in the following ranges: the temperature of the electric field bath for anodization: 0 to 100° C.; the electrolytic voltage: 10 to 450 V; and the anodization time: 1 to 100 minutes.

The anodization step using, for example, sulfuric acid is performed as follows, for example. The aluminum plate 100 is immersed in an electrolytic bath having a sulfuric acid concentration of 15% to form a positive electrode, and a DC voltage of 15 V is applied between the positive electrode and a negative electrode, obtained by separate immersion, at a bath temperature of 10° C.

The anodization step using, for example, phosphoric acid is performed as follows, for example. The aluminum plate 100 is immersed in an electrolytic bath having a phosphoric acid concentration of 4%, and a DC voltage of 20 V is applied between the aluminum plate 100 and a negative electrode, obtained by separate immersion, at a bath temperature of 24° C.

The anodization step using, for example, oxalic acid is performed as follows, for example. The aluminum plate 100 is immersed in an electrolytic bath having an oxalic acid concentration of 3 to 5%, and a DC voltage of 40 to 200 V is applied between the aluminum plate 100 and a negative electrode, obtained by separate immersion, at a bath temperature of 0 to 10° C.

In the press step (punching out, bending), the aluminum plate 100 is punched out into a developed shape of the terminal, and the obtained aluminum substrate 100A is bent into a three-dimensional shape.

The press step is performed after the anodized film 60 is formed on the surface of the aluminum plate 100 by the anodization step. Therefore, the press-sheared edge 72 of the aluminum substrate 100A obtained by punching-out is an end surface which does not have the anodized film 60 formed thereon.

The above-described hole sealing step is performed on at least the anodized film 60 on the surface of the crimp terminal 1. The hole sealing step using, for example, water vapor or boiled deionized water having a temperature of 90 to 100° C. is performed as follows, for example. The aluminum substrate 100A is immersed in, and exposed to, vapor or boiled deionized water pressurized to have an atmospheric pressure of 1 to 5 for 0.5 to 30 minutes.

The hole sealing step using, for example, silicic acid is performed as follows, for example. The aluminum substrate 100A is immersed in a bath of sodium silicate at a bath temperature of 80 to 100° C. for 20 to 30 minutes. As a result, a part of the surface of the aluminum substrate 100A that does not have the anodized film 60 formed thereon, namely, the press-sheared edge 72 is coated with a boehmite film.

The crimp terminal 1 is produced by the above-described method. The wire barrel section 10 of the crimp terminal 1 and the aluminum conductor tip part 203 of the insulated wire 200 are located to be parallel to, and to face, each other as shown in FIG. 1A, and are caulked by use of a pressure-bonding applicator (not shown) to pressure-bond the aluminum conductor tip part 203 to the wire barrel section 10. In addition, the insulation barrel section 15 and the conductor cover 202 of the insulated wire 200 are caulked to pressure-bond the conductor cover 202 to the insulating barrel section 105. As a result, as shown in FIG. 1B, the connection structural body 1*a* in which the crimp terminal 1 is connected to the insulated wire 200 is obtained.

The crimp terminal 1 and the connection structural body 1*a* described above provide the following various functions and effects.

As described above, the crimp terminal 1 is formed of the aluminum substrate 100A of an aluminum material, and includes the box section 2, and the pressure-bonding section which includes the wire barrel section 10 and the insulation barrel section 15. The box section 2, the wire barrel section 10 and the insulation barrel section 15 are located in this order. The plated part 40 provided on the contact parts 80 of the surface of the aluminum substrate 100A that are to be in contact with other conductors such as the male tab of the male terminal and the aluminum conductor tip part 203 of the insulated wire 200 is formed of tin, which is nobler than the aluminum material. The anodized film 60 is formed at least along the outer periphery of the plated part 40, as seen in a plan view, on the surface of the aluminum substrate 100A.

As described above, the anodized film 60 is formed on at least along the outer periphery of the plated part 40 on the surface of the aluminum substrate 100A. Owing to this, an electrolytic solution is prevented from being directly attached to the surface of the aluminum substrate 100A. Therefore, even if the electrolytic solution attached to at least the outer periphery of the plated part 40 on the surface of the aluminum substrate 100A is present between the surface of the aluminum substrate 100A and the plated part 40, galvanic corrosion of the surface of the aluminum substrate 100A can be prevented.

In the meantime, the contact parts 80 do not have the anodized film 60 formed thereon. Therefore, when the contact parts 80 on the surface of the aluminum substrate 100A contact the other conductive members via the plated part 40, high conductivity can be provided therebetween with certainty.

At least the anodized film 60 on the surface of the aluminum substrate 100A is treated with hole sealing. Owing to this, a plurality of holes at the surface of the anodized film 60 can be sealed.

This will be described in more detail. There are a plurality of holes at the surface of the anodized film 60. Therefore, when the electrolytic solution is attached to the plated part 40, the electrolytic solution enters the plurality of holes and thus may undesirably cause corrosion from the periphery of the plurality of holes.

By treating the anodized film 60 with hole sealing, the plurality of holes at the surface of the anodized film 60 are sealed and the entrance of the electrolytic solution into the plurality of holes is prevented. As a result, the corrosion resistance and also the mechanical strength of the anodized film 60 can be improved.

A part of the surface of the aluminum substrate 100A that does not have the anodized film 60 formed thereon, namely, the press-sheared edge 72 is treated with hole sealing. Owing to this, the part is covered with a boehmite film and thus can be further insulated.

The crimp terminal 1 described above is produced by forming the plated part 40 and the anodized film 60 on the plate-like aluminum plate 100 before plate-like aluminum plate 100 is punched out. Therefore, as compared with the case where the plated part 40 and the anodized film 60 are formed on a post-punching-out reel terminal 90 including a plurality of crimp terminals connected by a carrier 91, the posture of the aluminum plate 100 is more stable in the plating step and the anodization step. Therefore, the plated part 40 and the anodized film 60 can be accurately formed.

Hereinafter, crimp terminals 1A, 1B and 1C and connection structural bodies 1Aa and 1Ba in other embodiments will be described.

Regarding the crimp terminals 1A, 1B and 1C and connection structural bodies 1Aa and 1Ba described below, the elements which are the same as those of the crimp terminal 1 and the connection structural body 1*a* will bear identical reference signs thereto and descriptions thereof will be omitted.

Embodiment 2

As shown in FIG. 4 and FIG. 5, the crimp terminal 1A in Embodiment 2 includes the anodized film 60 formed also on the press-sheared edge 72 of the aluminum substrate 100A obtained as a result of press shearing.

The connection structural body 1Aa in Embodiment 2 includes the crimp terminal 1A connected to the insulated 200 in substantially the same manner as in Embodiment 1.

Figure 4A:
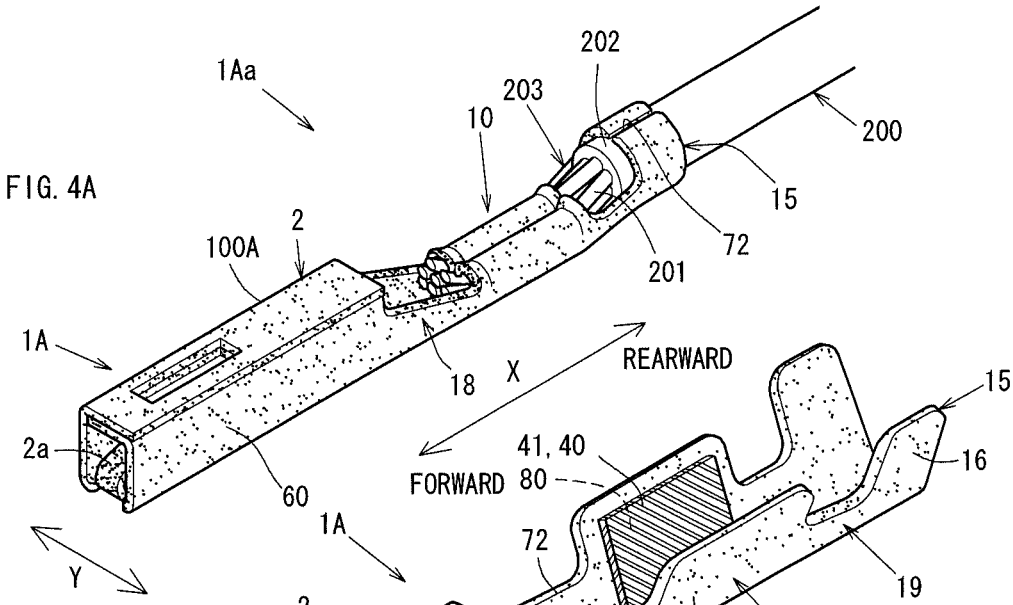
FIGS. 4A through 4C each show a crimp terminal and a connection structural body in Embodiment 2.
Figure 4B:
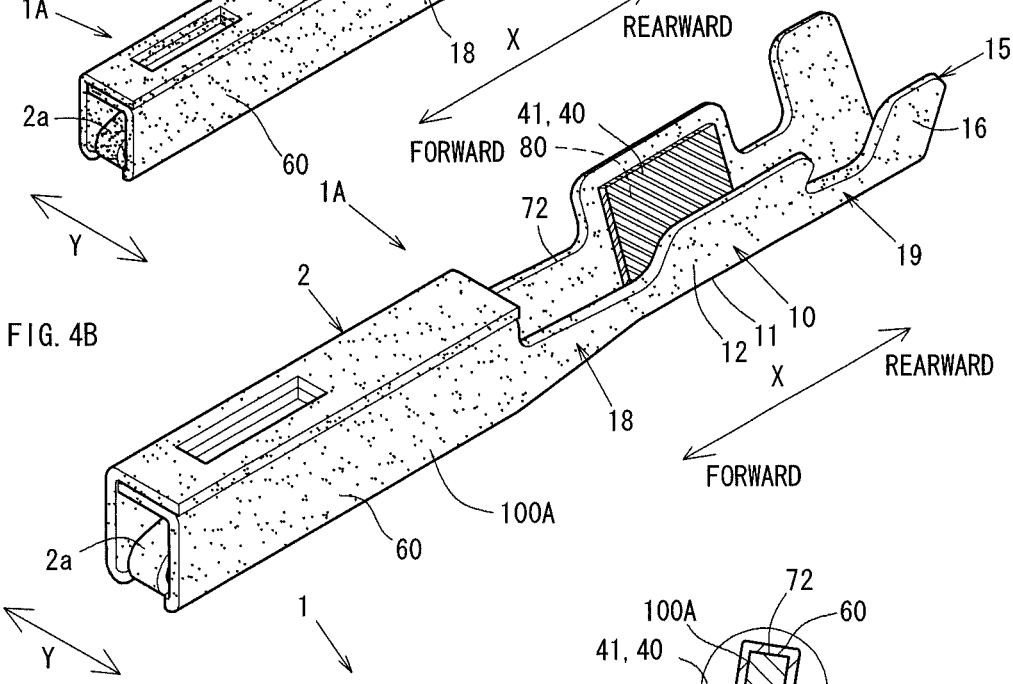
Figure 4C:
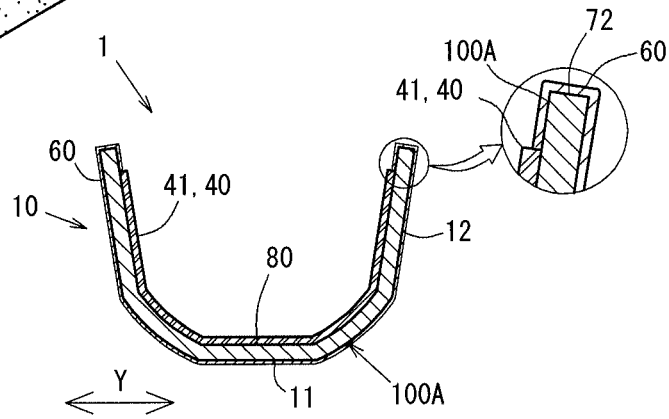
Figure 5A:
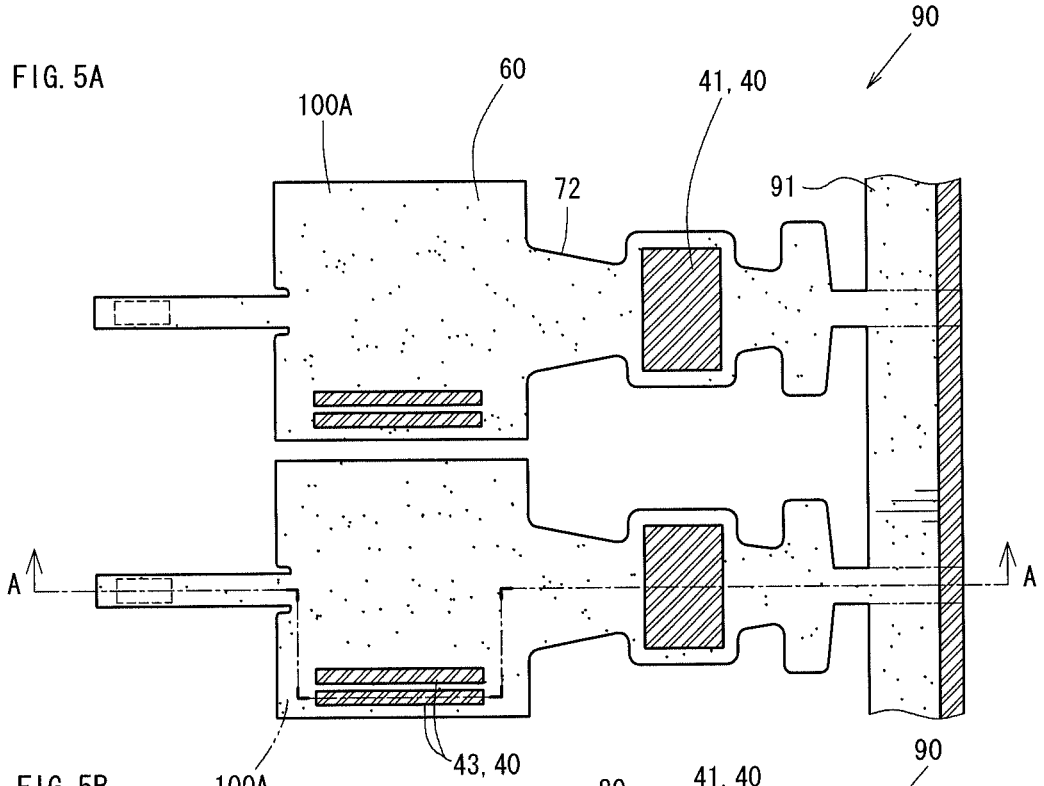
FIGS. 5A and 5B each show an aluminum substrate used to form the crimp terminal in Embodiment 2.
Figure 5B:
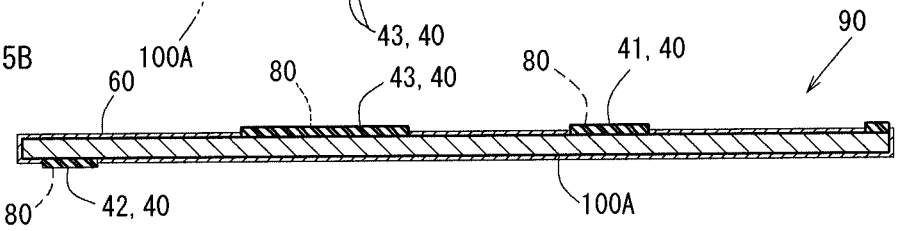
Figure 6:
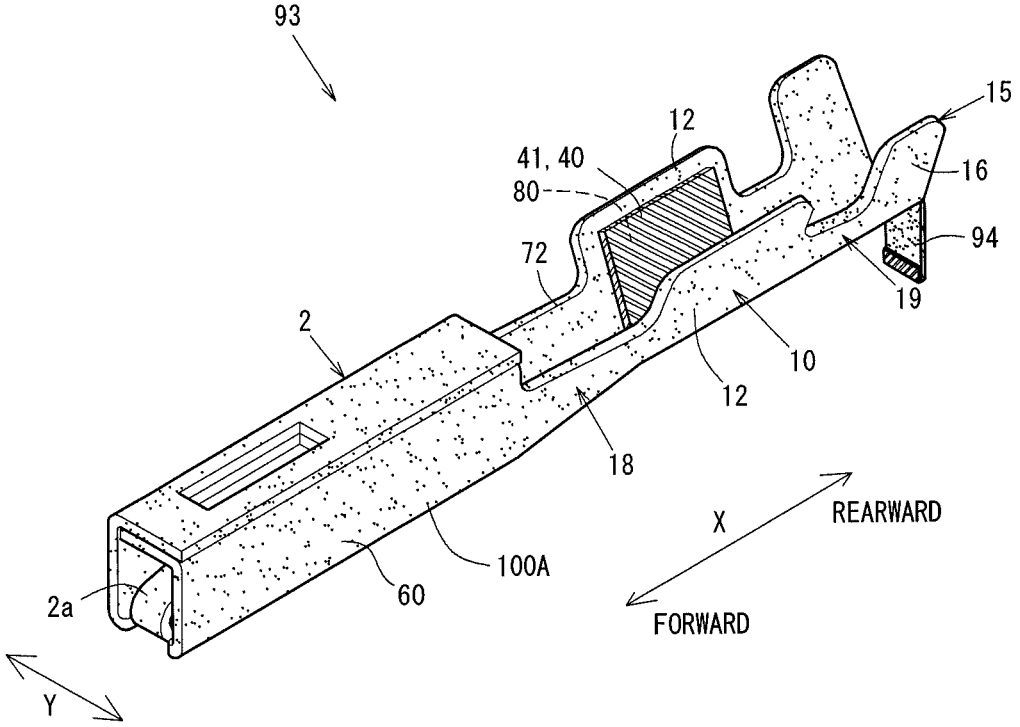
FIG. 6 shows a method for producing the crimp terminal in Embodiment 2.

FIG. 4A is an isometric view of the connection structural body 1Aa in Embodiment 2, FIG. 4B is an isometric view of the crimp terminal 1A in Embodiment 2, and FIG. 4C is a cross-sectional view of the wire barrel section 10 of the crimp terminal 1A taken along a line extending perpendicularly to the longitudinal direction. FIG. 5 shows a step of a method for producing the crimp terminal 1A. In more detail, FIG. 5A is a plan view of the reel terminal 90 described later, and FIG. 5B is a cross-sectional view taken along line A-A of FIG. 5A. FIG. 6 shows a step of another method for producing the crimp terminal 1A. In more detail, FIG. 6 is an isometric view of a small piece-attached crimp terminal 93 described later.

The crimp terminal 1A is produced by a plate press step, a plating step, an anodization step, a terminal reel press step (punching out, bending), and a hole sealing step which are performed in this order on the plate-like aluminum plate 100.

In the plate press step, the aluminum plate 100 is punched out to form the reel terminal 90 having a shape of a plurality of crimp terminals connected in a chain-like manner by the carrier 91.

The plating step and the anodization step are performed in substantially the same manner as on the crimp terminal 1 in Embodiment 1 except for being performed on the reel terminal 90 instead of the aluminum plate 100.

In the terminal reel press step (punching out, bending), the reel terminal 90 already treated with the plating step and the anodization step is punched out into a developed shape of the terminals, and each obtained aluminum substrate 100A is bent into a three-dimensional shape.

The hole sealing step is the same as that performed in the method for producing the crimp terminal 1 in Embodiment 1.

The crimp terminal 1A and the connection structural body 1Aa described above provide the following various functions and effects.

The anodization step is performed on the reel terminal 90. Owing to this, as shown in FIGS. 5A and 5B, anodization is performed on the surface of the aluminum substrate 100A including the crimp terminals 1A via the carrier 91, and thus the anodized film 60 can be formed also on the press-sheared edge 72.

Therefore, the crimp terminal 1A and the connection structural body 1A1 have the anodized film 60 formed also on the press-sheared edge 72 of the aluminum substrate 100A obtained as a result of press shearing. Thus, galvanic corrosion can be prevented from being caused to any part of the crimp terminal 1A.

This will be described in more detail. When the anodized film 60 is formed on the surface of the aluminum plate 100 before the aluminum plate 100 is press-sheared, the anodized film is not formed, after press shearing, on a part along which the aluminum plate 100 is press-sheared, namely, the press-sheared edge 72.

When an electrolytic solution is attached to the press-sheared edge on which the anodized film 60 is not formed, the electrolytic solution is directly attached to the surface of the aluminum substrate 100A. Thus, the electrolytic solution is present between the press-sheared edge 72 and the plated part 40. As a result, galvanic corrosion occurs to the press-sheared edge 72 of the aluminum substrate 100A.

In the case where the anodized film 60 is formed on the crimp terminal 1A including the press-sheared edge 72, galvanic corrosion does not occur from the press-sheared edge 72. Thus, galvanic corrosion can be prevented from being caused to any part of the crimp terminal 1A.

The crimp terminal 1A in Embodiment 2, namely, the crimp terminal including the anodized film 60 formed on the entire surface of the aluminum substrate 100A including the press-sheared edge 72 may be produced by another method instead of the above-described method.

For example, in the plate press step, the aluminum plate 100 or the reel terminal 90 may be punched out to form a plurality of small piece-attached crimp terminals 93, and the plating step and the anodization step may be performed on these plurality of small piece-attached crimp terminals 93.

As shown in FIG. 6, the "small piece-attached crimp terminal 93" includes a carrier small piece 94, obtained by dividing the carrier 91 into small pieces, attached to a base end of the insulation barrel section 15.

Namely, in the anodization step, anodization is performed on the crimp terminal via the carrier small piece 94 of the small piece-attached crimp terminal 93. Thus, the anodized film 60 can be formed also on the press-sheared edge 72.

Embodiment 3

Figure 7A:
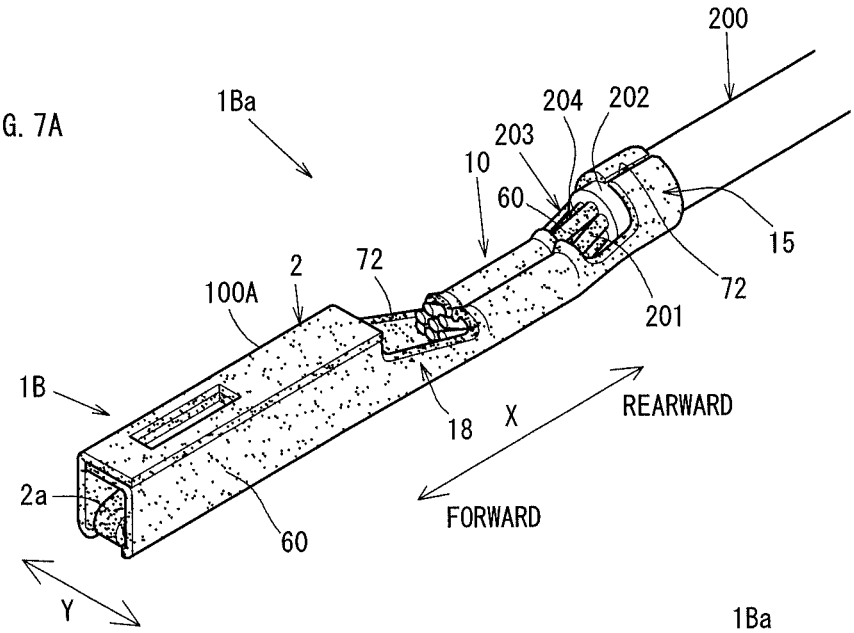
FIGS. 7*a* and 7B each show a connection structural body in Embodiment 3.
Figure 7B:
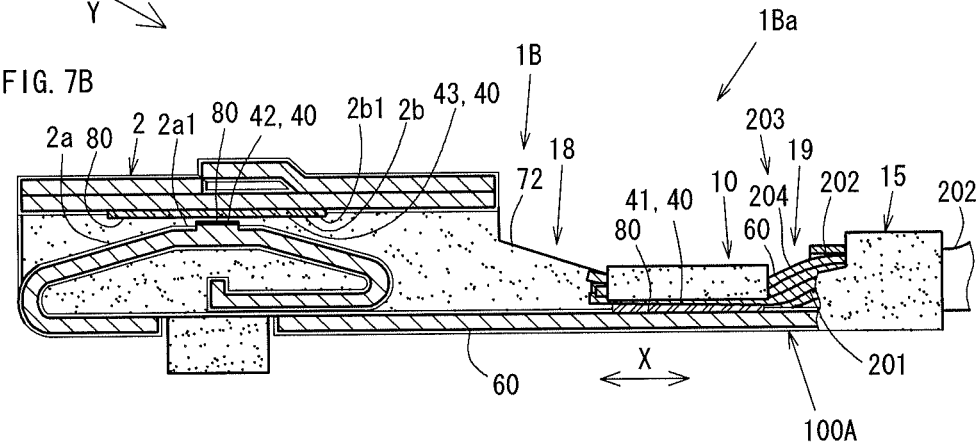

As shown in FIG. 7A and FIG. 7B, the connection structural body 1Ba in Embodiment 3 includes a crimp terminal 1B which is substantially the same as the crimp terminal 1A in Embodiment 2 and the insulated wire 200. The aluminum conductor tip part 203 of the insulated wire 200 is connected to the wire barrel section 10 of the crimp terminal 1B by pressure bonding. The anodized film 60 is formed on the crimp terminal 1B including the press-sheared edge 72 but excluding the contact parts 80 and on the aluminum conductor tip part 203.

FIG. 7A is an external view of the connection structural body 1Ba in Embodiment 3, and FIG. 7B is a vertical cross-sectional view taken along a line extending in the longitudinal direction at an intermediate position of the connection structural body 1Ba in the width direction.

The connection structural body 1Ba in Embodiment 3 is not limited to having the structure in which the crimp terminal 1A in Embodiment 2 is connected to the insulated wire 200, and may have a structure in which the crimp terminal 1 in Embodiment 1 is connected to the insulated wire 200.

A method for producing the connection structural body 1Ba will be described.

Like in the method for producing the crimp terminal 1A in Embodiment 2, the aluminum plate 100 is punched out in the plate press step to form the reel terminal 90. Next, the plating step is performed on the reel terminal 90, but the anodization step is not performed. A plurality of crimp terminals coupled to the carrier 91 and bent to have a three-dimensional shape are connected to the insulated wires 200.

Owing to this, a plurality of connection structural bodies 1Ba coupled to each other by the carrier 91 are produced. On such connection structural bodies 1Ba, the anodization step is performed via the carrier 91. As a result, the anodized film 60 can be formed on the crimp terminal 1B including the press-sheared edge 72 and on the aluminum conductor tip part 203 connected to the crimp terminal 1B by pressure bonding.

Namely, the anodized film 60 can be formed at least on the border, as seen in a plan view, between the plated part 40 and the aluminum substrate 100A on the surface of the aluminum substrate 100A, and also on an exposed conductor part 204 of the aluminum conductor tip part 203 that is not pressure-bonded to the wire barrel section 10 and exposed outside.

Then, the plurality of connection structural bodies 1Ba coupled to each other by the carrier 91 are cut away from the carrier 91 to remove the carrier 91. Thus, the Connection structural bodies 1Ba are formed.

As described above, the connection structural body 1Ba has the anodized film 60 formed on the crimp terminal 1B and also on the aluminum conductor tip part 203. Owing to this, a surface of the aluminum conductor tip part 203 which is exposed as a result of being stripped of the conductor cover 202 can have a high level of corrosion resistance with certainty.

In another embodiment, the connection structural body 1Ba in Embodiment 3 may be produced by another method instead of the above-described method.

For example, the aluminum plate 100 does not need to be punched out in the plate press step to form the reel terminal 90 shown in FIG. 5. Alternatively, as shown in FIG. 6, the small piece-attached crimp terminal 93 may be formed and connected to the insulated wire 200 to form the connection structural body 1Ba. The anodization step may be performed on the connection structural body 1Ba thus produced.

Even the connection structural body 1Ba produced by such a method has the anodized film 60 formed on the aluminum conductor tip part 203 and also on the crimp terminal 1B including the press-sheared edge 72.

The crimp terminal and the connection structural body according to the present invention are not limited to having a structure of any of the crimp terminals 1, 1A and 1B and the connection structural bodies 1*a*, 1Aa and 1Ba in Embodiments 1 through 3 described above, and may be implemented in any of various embodiments.

For example, for producing the connection structural body 1*a*, 1Aa, 1Ba, the wire barrel section 10 of the crimp terminal 1, 1A, 1B and the aluminum conductor tip part 203 are pressure-bonded to each other. In this step, a part of the wire barrel-side plated part 41 formed on the wire barrel section 10 protrudes outside from the contact port 80 to be an exposed plated part (not shown).

Since the exposed plated part is exposed outside, an electrolytic solution is easily present between the exposed plated part and the surface of the aluminum substrate 100A. As a result, galvanic corrosion easily occurs to the surface of the aluminum substrate 100A.

Therefore, it is preferable that the plating material used to form the wire barrel-side plated part 41 contains a metal material on a surface of which the anodized film 60 can be formed, in addition to being nobler than the aluminum material.

In the case where the plated part 40 is formed of such a plating material, the anodized film 60 can be formed on the aluminum substrate 100A of the crimp terminal, the aluminum conductor tip part 203, and also a surface of the exposed plated part, which is a part of the wire barrel-side plated part 41 that is exposed outside from the contact part 80, by the anodization step performed on the connection structural body 1*a*.

By forming the anodized film 60 on the exposed plated part, the corrosion resistance of the crimp terminal 1, 1A, 1B and the connection structural body 1*a*, 1Aa, 1Ba can be further improved.

The exposed plated part is not limited to being formed in a part of the wire barrel-part plated part 41. When the male tab is fit to the crimp terminal, an exposed plated part may be formed in a part of the contact piece-side plated part 42, and the anodized film 60 may be formed on the exposed plated part.

In still another embodiment, any of various measures may be taken so that the anodized film 60 is not formed by the anodization step on the contact parts 80, where the crimp terminal contacts the other conductive members.

This will be described in more detail. The contact piece 2*a* including the contact convex part 2*a*1 and the bead part 2*b* including the contact convex part 2*b*1 respectively have the contact parts 80 where the contact piece 2*a* and the bead part 2*b* contact the male tab of the male terminal. The wire barrel section 10 has the contact part 80 where the wire barrel section 10 contacts the aluminum conductor tip part 203 of the insulated wire 200.

In the case where the plating step is performed before the anodization step, in order not to form the anodized film 60 on the contact parts 80 by the anodization step, the contact parts 80 may be plated with a plating material containing a metal material on which the anodized film 60 is not easily formed. Owing to this, the anodized film 60 can be prevented from being unintentionally formed on the contact parts 80.

In the case where the plated part 40 is formed of a plating material containing a metal material on which the anodized film 60 is not easily formed as described above, the aluminum substrate 100A having the plated part 40 formed thereon may be treated with the anodization step, and then the plated part 40 may be covered with a plating material on which the anodized film 60 is easily formed.

Owing to this, the anodized film 60 is formed on the outer surface of the plated part 40. Therefore, the corrosion resistance of the plated part 40 can be further improved.

Alternatively, in order not to form the anodized film 60 on the contact parts 80 by the anodization step, the contact parts 80 may be masked before the plated part 40 is formed thereon. Owing to the masking, the plated part can be formed in the plating step on the contact parts 80 which are protected so as not to be unintentionally anodized. Thus, after anodization, the aluminum substrate 100A or the like can be plated when necessary.

The contact convex part 2*a*1 of the contact piece 2*a* inside the box section 2 and the contact convex part 2*b*1 of the bead part 2*b* also inside the box section 2 are contact parts 80 where the contact piece 2*a* and the bead part 2*b* contact the male tab of the male terminal. Therefore, the contact convex parts 2*a*1 and 2*b*1, for example, may be masked so as not to be unintentionally anodized.

In this case, the electrolytic polishing is performed in the pre-anodization step as described above. The electrolytic polishing polishes a non-masked area other than the contact parts 80. As a result, the masked contact parts 80 project over the surrounding area. Then, anodization is performed to form the anodized film 60 on the area other than the masked contact parts 80, and the mask is removed and the contact parts 80 are plated to form the contact piece-side plated part 42.

Figure 8:
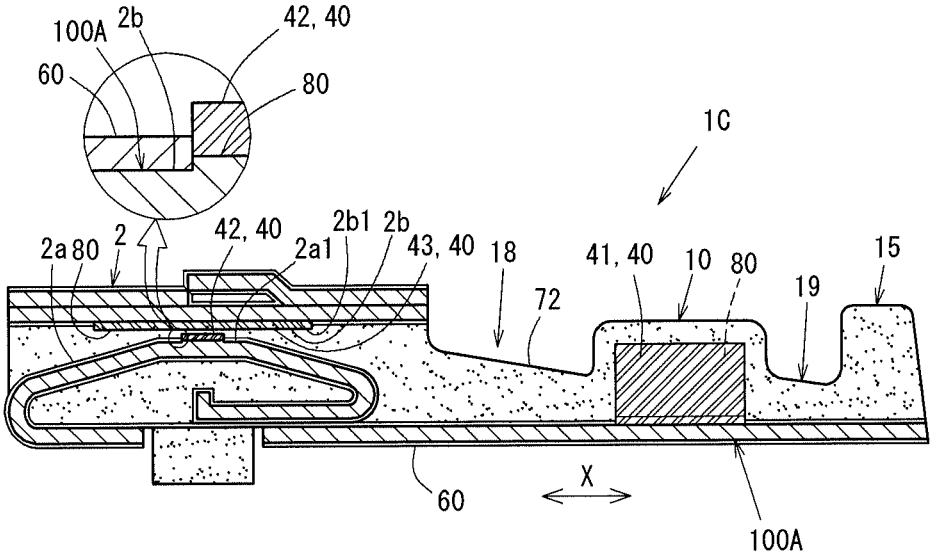
FIG. 8 shows a crimp terminal in another embodiment.

As a result of such treatments, as shown in FIG. 8 and a partial enlarged view in FIG. 8, the crimp terminal 1C has a structure in which the contact convex parts 2*a*1 and 2*b*1, which are contact parts 80 of the contact piece 2*a* and the bead part 2*b*, project over the surrounding area. Therefore, when the male tab of the male terminal is fit to the crimp terminal 1C, the male tab can contact the contact piece-side plated part 42 and the bead part-side plated part 43 with more certainty. Thus, the electric conductance is enhanced and the connection reliability can be improved.

In addition, as shown in the partial enlarged view in FIG. 8, the crimp terminal 1C includes the anodized film 60 formed on the surface of the aluminum substrate 100A so that an electrolytic solution which is present between the contact piece-side plated part 42 and the aluminum substrate 100A is not attached to the surface of the aluminum substrate 100A. Therefore, a high level of corrosion resistance can be provided with certainty.

In still another embodiment, in the crimp terminal 1, 1A, 1B, 1C and the connection structural bodies 1*a*, 1Aa, 1Ba, at least the anodized film 60 may be subjected to water-repelling treatment.

In more detail, the water-repelling treatment may be performed as follows. The anodized film 60 is coated with an aqueous fluorine paint and then baked at a temperature of 100° C. for 10 to 30 seconds. Alternatively, a silane-based water-repelling agent is dissolved in an organic solvent, and the cycle of immersing the anodized film 60 in the resultant solution of 30 to 90° C. for 60 to 120 seconds and then drying the anodized film 60 is performed three times in repetition.

Usable silane-based water-repelling agents include, for example, perfluorooctylethyltriethoxysilane, fluoroalkylsilane, hexyltrimethoxysilane, dimethyldichlorosilane and the like.

The plated part 40 may be formed of a plating material containing a nobler metal material than the aluminum material such as, for example, copper, gold, zinc, nickel or the like as well as tin described above. The surface of the aluminum substrate 100A may be plated by a single layer as well as multiple layers.

Now, effect confirmation tests performed on the crimp terminal and the connection structural body according to the present invention exemplified by the crimp terminals 1, 1A, 1B and 1C and the connection structural bodies 1*a*, 1Aa and 1Ba will be described.

(Effect Confirmation Test 1)

For performing effect confirmation test 1, test samples of the following examples (1) through (3) were produced. In addition, a test sample in a comparative example was produced with the anodization step not being performed on the aluminum substrate 100A.

These test samples were connection structural bodies each including a crimp terminal and a core wire attached thereto by pressure bonding. The core wire was formed of an aluminum wire having a conductor cross-sectional area size of 0.75 $mm^2$ and a length of 11 cm (composition of the aluminum wire: ECAI; 11 wires being twisted). The terminal included in each test sample was formed of a 0.2 mm-thick plate of alloy No. 6022 and temper designation T4. An end of the core wire opposite to the end pressure-bonded to the crimp terminal was stripped of a cover by a length of 10 mm and immersed in a solder bath for aluminum (produced by Nihon Almit Co., Ltd.; T235, using flux) to solder a surface of the core wire. This was performed to minimize the resistance of the contact point with the probe at the time of measurement of the electric resistance. The length of the test samples of 11 cm and the soldering performed on the opposite end do not characterize the embodiments of the present invention, and are merely necessary for evaluations in the effect confirmation tests.

The specifications of the terminals of the test samples of examples (1) through (3) will be described.

The test sample of example (1) has substantially the same structure as the connection structural body 1*a* in Embodiment 1. In summary, the test sample is the connection structural body 1*a* in which the crimp terminal 1 is connected to the aluminum conductor tip part 203 of the insulated wire 200 by pressure bonding. The crimp terminal 1 includes the anodized film 60 formed on the entirety thereof except for the contact parts 80 on the surface of the aluminum substrate 100A where the crimp terminal 1 contacts the aluminum conductor tip part 203 and the like and also except for the press-sheared edge 72.

The test sample of example (2) has substantially the same structure as the connection structural body 1Aa in Embodiment 2. In summary, the test sample is the connection structural body 1Aa in which the crimp terminal 1A is connected to the aluminum conductor tip part 203 of the insulated wire 200 by pressure bonding. The crimp terminal 1A includes the anodized film 60 formed on the entirety thereof including press-sheared edge 72 except for the contact parts 80 on the surface of the aluminum substrate 100A where the crimp terminal 1A contacts the aluminum conductor tip part 203 and the like.

The test sample of example (3) has substantially the same structure as the connection structural body 1Ba in Embodiment 3. In summary, the test sample is the connection structural body 1Ba in which the crimp terminal 1B in Embodiment 3 is connected to the aluminum conductor tip part 203 of the insulated wire 200 by pressure bonding. The crimp terminal 1B includes the anodized film 60 formed on the entirety thereof including press-sheared edge 72 except for the contact parts 80 on the surface of the aluminum substrate 100A and also on the exposed conductor part 204 of the aluminum conductor tip part 203. The anodized film 60 is formed after the crimp terminal 1B is connected to the aluminum conductor tip part 203 by pressure bonding.

In the test samples of examples (1) through (3), at least the anodized film 60 is treated with hole sealing.

A plurality of samples treated with anodization were produced for each of examples (1) through (3), and a plurality of samples with no anodized film 60 were produced for the comparative example. Each sample was inserted into, and set in, a connector housing.

The connector housings each having a sample set therein were subjected to a corrosion test and immediately thereafter, to a moist heat test to measure the contact force between the male terminal and the female terminal (hereinafter, referred to as a "terminal contact force"), the strength of the pressure-bonding section of the terminal, and the resistance value at low voltage and low current.

The conditions for the corrosion test were as follows as defined by JIS Z2371. A test sample was suspended in a sealed tank, and saline water having a temperature of 35° C., a concentration of 5 mass % and a pH value of 6.5 to 7.2 was sprayed for 96 hours.

The conditions for the moist heat test were as follows. A connector was suspended in a moist bath having a temperature of 85±5° C. and a humidity of 90 to 95% RH such that falling water drops are not attached to the connector, and left for 96 hours. These tests were performed on 20 samples for each example and the comparative example, and the terminal contact force, the terminal pressure-bonding section strength, and the resistance value at low voltage and low current were measured on all the samples for evaluation. The corrosion state was also observed for all the samples.

The terminal contact force was measured as follows. The gap of the fitting part of the female terminal was measured by an inserted 0.01 mm-unit gauge or by a projector. The contact point spring part of the female terminal, namely, the contact piece 2*a* was pressed down (pulled up) by a planar jig. Thus, the relationship (spring characteristic) between the displacement and the force was measured by a displacement meter and a load cell.

The displacement rate was 0.3 to 3 mm/min., the measuring precision of the displacement meter was 0.01 mm, and the measuring precision of the load cell was 0.1 N or higher. From the displacement-load curve found as described above, the force at the time of insertion of the male tab (thickness of the male tab—gap) was found.

The terminal pressure-bonding section strength was measured as follows. A terminal having the insulated wire 200 having a length of about 350 mm pressure-bonded or pressure-contacted thereon was attached to a test apparatus. The insulated wire 200 was pulled in an axial direction at a constant rate of 25 to 100 mm/min. The load at the time when the insulated wire 200 was ruptured or pulled out from the pressure-bonding section (wire barrel section 10, the insulation barrel section 15) was measured.

The resistance value at low voltage and low current was measured as follows. A resistance meter (ACmΩHiTESTER3560; produced by Hioki E.E. Corporation) was used. The wire barrel section side of the box section 2 was set as a positive electrode, and the cover-stripped end of the core wire opposite to the end pressure-bonded to the crimp terminal was set as a negative electrode. The measurement was performed by a 4-terminal method.

The measured resistance value was considered to be a total of the resistances of the aluminum conductor 201, the terminal and the pressure-bonded contact parts. Since the resistance of the aluminum conductor 201 was not ignorable, the resistance value of the aluminum conductor 201 was subtracted from the measured resistance value and the resultant value was set as the resistance value of the pressure-bonding section at low voltage and low current.

The results of the terminal contact force were evaluated as follows. When all of the 20 samples had a terminal contact force of 3.0 N or greater, the evaluation result was "◎". When three or less of the 20 samples had a terminal contact force of 2.0 N or greater and less than 3.0 N and the remaining samples had a terminal contact force of 3.0 N or greater, the evaluation result was "○". When more than three of the 20 samples had a terminal contact force of 2.0 N or greater and less than 3.0 N and the remaining sample(s) had a terminal contact force of 3.0 N or greater, the evaluation result was "Δ". When at least one of the 20 samples had a terminal contact force of less than 2.0 N, the evaluation result was "x".

The results of the terminal pressure-bonding section strength were evaluated as follows. When all of the 20 samples had a strength of 70 N or greater, the evaluation result was "◎". When three or less of the 20 samples had a strength of 50 N or greater and less than 70 N and the remaining samples had a strength of 70 N or greater, the evaluation result was "○". When more than three of the 20 samples had a strength of 50 N or greater and less than 70 N and the remaining sample(s) had a strength of 70 N or greater, the evaluation result was "Δ". When at least one of the 20 samples had a strength of less than 50 N, the evaluation result was "x".

The results of the resistance value at low voltage and low current were evaluated as follows. When all of the 20 samples had a resistance increase of less than 1 mΩ, the evaluation result was "◎". When three or less of the 20 samples had a resistance increase of 1 mΩ or greater and less than 3 mΩ and the remaining samples had a resistance increase of less than 1 mΩ, the evaluation result was "○". When more than three of the 20 samples had a resistance increase of 1 mΩ or greater and less than 3 mΩ and the remaining sample(s) had a resistance increase of less than 1 mΩ, the evaluation result was "Δ". When at least one of the 20 samples had a resistance increase of 3 mΩ or greater, the evaluation result was "x".

The results of effect confirmation test 1 are shown in Table 1.

TABLE 1

| Test sample | | Terminal contact force | Terminal pressure-bonding section strength | Resistance value at low voltage and low current |
|---|---|---|---|---|
| Example | (1) | ○ | ◎ | ◎ |
| | (2) | ◎ | ◎ | ◎ |
| | (3) | ◎ | ◎ | ◎ |
| Comparative example | Non-treated | X | Δ | Δ |

The results of effect confirmation test 1 of the test sample of the comparative example are, as shown in Table 1, "x" in the terminal contact force and "Δ" in both of the terminal pressure-bonding section strength and the resistance value at low voltage and low current. It was confirmed that progress of corrosion on the crimp terminal formed of the aluminum substrate 100A and the aluminum conductor tip part 203 cannot be prevented.

By contrast, the results of the test samples according to the present invention are as follows. Although the result of the test sample of example (1) is "○" in the terminal contact force, the results of the test sample of example (1) in the other test items and the results of the test samples of examples (2) and (3) in all the test items are "◎".

In the test sample of example (1), the aluminum substrate 100A is exposed at the press-sheared edge 72 on the surface of the crimp terminal, but the surface of the crimp terminal is entirely covered with the thick anodized film 60 and can be insulated except for the press-sheared edge 72 and the contact parts 80. It was demonstrated from the test results that the effect of preventing corrosion is improved.

In the test sample of example (1), at least the anodized film 60 is treated with hole sealing. Since the plurality of holes present at the surface of the anodized film 60 are sealed, an electrolytic solution is not easily attached to the aluminum substrate 100A. In addition, the press-sheared edge 72 which is not covered with the anodized film 60 and thus exposes the aluminum substrate 100A is covered with boehmite. It was demonstrated that this prevents the electrolytic solution from being directly attached to the aluminum substrate 100A.

In each of the test samples of examples (2) and (3), the entire surface of the terminal is covered with the thick anodized film 60, and at least the anodized film 60 is treated with hole sealing. It was demonstrated that these test samples have high corrosion resistance.

Especially from the results of the test sample of example (3), it was demonstrated that when the crimp terminal connected to the aluminum conductor tip part 203 by pressure bonding is anodized, it is preferable to form the anodized film 60 on the aluminum conductor tip part 203 from the viewpoint of improving the corrosion resistance.

(Effect Confirmation Test 2)

Next, for performing effect confirmation test 2, test samples in the following examples (4) through (9) were produced.

The specifications of the test samples of examples (4) through (9) are will be described.

The test sample of example (4) is obtained by subjecting a connection structural body substantially the same as the connection structural body 1*a* in Embodiment 1, namely, the connection structural body 1*a* of example (1), with water-repelling treatment.

The test sample of example (5) is obtained by subjecting a connection structural body substantially the same as the connection structural body 1Aa in Embodiment 2, namely, the connection structural body 1Aa of example (2), with water-repelling treatment.

The test sample of example (6) is obtained by subjecting a connection structural body substantially the same as the connection structural body 1Ba in Embodiment 3, namely, the connection structural body 1Ba of example (2), with water-repelling treatment.

The test sample of example (7) is obtained by subjecting a connection structural body substantially the same as the connection structural body 1*a* in Embodiment 1 with no hole sealing being performed thereon, namely, the connection structural body 1*a* of example (1) with no hole sealing being performed thereon, with water-repelling treatment.

The test sample of example (8) is obtained by subjecting a connection structural body substantially the same as the connection structural body 1Aa in Embodiment 2 with no hole sealing being performed thereon, namely, the connection structural body 1Aa of example (2) with no hole sealing being performed thereon, with water-repelling treatment.

The test sample of example (9) is obtained by subjecting a connection structural body substantially the same as the connection structural body 1Ba in Embodiment 3 with no hole sealing being performed thereon, namely, the connection structural body 1Ba of example (3) with no hole sealing being performed thereon, with water-repelling treatment.

In effect confirmation test 2, the test samples of examples (4) through (9) were each inserted into a connector housing. The connector housing was subjected to a corrosion test and immediately thereafter, to a moist heat test to measure the terminal contact force, the terminal pressure-bonding section strength, and the resistance value at low voltage and low current. The test method and evaluation method are substantially the same as those in effect confirmation test 1.

The results of effect confirmation test 2 are shown in Table 2.

TABLE 2

| Test sample | | Terminal contact force | Terminal pressure-bonding section strength | Resistance value at low voltage and low current |
|---|---|---|---|---|
| Example | (4) | ◎ | ◎ | ◎ |
| | (5) | ◎ | ◎ | ◎ |
| | (6) | ◎ | ◎ | ◎ |
| | (7) | ○ | ○ | ○ |
| | (8) | ○ | ○ | ○ |
| | (9) | ○ | ◎ | ◎ |

The results of the test samples of examples (4) through (6) are "◎" in all the test items of the terminal contact force, the terminal pressure-bonding section strength, and the resistance value at low voltage and low current. It was demonstrated from the test results that the water-repelling treatment prevents galvanic corrosion of the aluminum substrate and thus improves the corrosion resistance.

In each of the test samples of examples (7) through (9), the surface of the anodized film 60 is not treated with hole sealing, and thus has minute roughness. It was demonstrated that when such a surface of the anodized film 60 is coated with a water-repelling agent for water-repelling treatment, an electrolytic solution such as water or the like is not easily attached to the surface and thus the corrosion resistance is improved as compared with the case where the water-repelling treatment is not performed.

(Effect Confirmation Test 3)

Next, for performing effect confirmation test 3, test samples of the following examples (1)' through (9)' were produced.

The test samples of examples (1)' through (9)' are respectively different from the test samples of examples (1) through (9) in that the aluminum conductor tip part 203 of the insulated wire 200 and the crimp terminal are connected to each other by pressure bonding such that the wire barrel-side plated part 41 formed on the wire barrel section 10 protrudes, by being pressure-bonded with the aluminum conductor tip part 203, from the contact part where the wire barrel section 10 and the aluminum conductor tip part 203 contact each other.

A plurality of samples having the plated part 40 protruding from the contact part of the wire barrel section 10 and the aluminum conductor tip part 203 were produced for each of examples (1)' through (9)'. Also, a plurality of samples with no anodized film 60 were produced for a comparative example, like the samples of the comparative example used in effect confirmation test 1. Each sample was inserted into, and set in, a connector housing.

The connector housing accommodating each sample was subjected to a corrosion test and immediately thereafter, to a moist heat test to measure the terminal pressure-bonding section strength, and the resistance value at low voltage and low current.

The test method and evaluation method are substantially the same as those in effect confirmation tests 1 and 2.

The results of effect confirmation test 3 are shown in Table 3.

TABLE 3

| Test sample | | Terminal pressure-bonding section strength | Resistance value at low voltage and low current |
|---|---|---|---|
| Example | (1)' | ○ | ○ |
| | (2)' | ◎ | ○ |
| | (3)' | ◎ | ◎ |
| | (4)' | ◎ | ○ |
| | (5)' | ◎ | ◎ |
| | (6)' | ◎ | ◎ |
| | (7)' | ○ | ○ |
| | (8)' | ○ | ○ |
| | (9)' | ◎ | ◎ |
| Comparative example | Non-treated | X | X |

As shown in Table 3, the results of the test sample of the comparative example are "x" in the terminal pressure-bonding section strength and the resistance value at low voltage and low current.

By contrast, the results of the test samples of examples (1)' through (9)' are "○" or "◎" or in the terminal pressure-bonding section strength and the resistance value at low voltage and low current.

It was demonstrated from the test results that even the structure of the test samples of examples (1)' through (9)', in which the wire barrel-side plated part 41 protrudes as an exposed plated part from the contact part of the wire barrel section 10 and the aluminum conductor tip part 203, provides high corrosion resistance when the anodized film 60 is formed on the exposed plated part as well as the aluminum substrate 100A used to form the crimp terminal and the aluminum conductor tip part 203.

Following Embodiments 1 through 3, Embodiments 4 and 5 will be described below. In Embodiments 4 and 5, a crimp terminal 501 and a connection structural body 501*a* including the crimp terminal 501 will be described. The crimp terminal 501 includes an insulating cover 560 in at least a part of the border, as seen in a plan view, between the plated part 40 and the aluminum substrate 100A. The insulating cover is formed of an insulating resin and is provided as an insulting body-forming part.

Embodiment 4

FIG. 9 provides isometric views of the crimp terminal 501 and the connection structural body 501*a* in Embodiment 4. FIG. 10 is a vertical cross-sectional view of the crimp terminal 501 in Embodiment 4 taken along a line extending in a longitudinal direction X at an intermediate position in a width direction Y. FIG. 11 shows the aluminum plate 100 used to form the crimp terminal 501 in Embodiment 4.

Figure 9A:
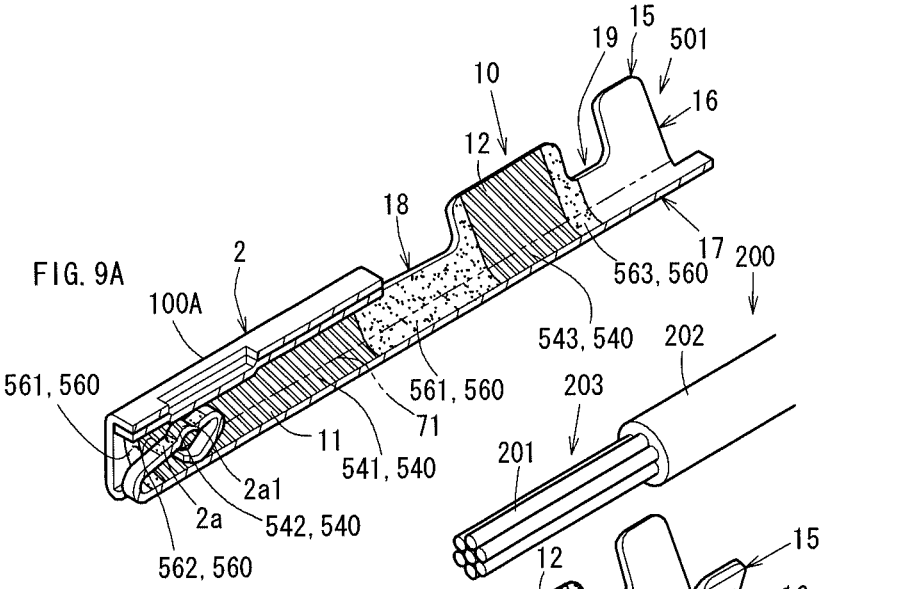
FIGS. 9A through 9C each show a crimp terminal and a connection structural body in Embodiment 4.
Figure 9B:
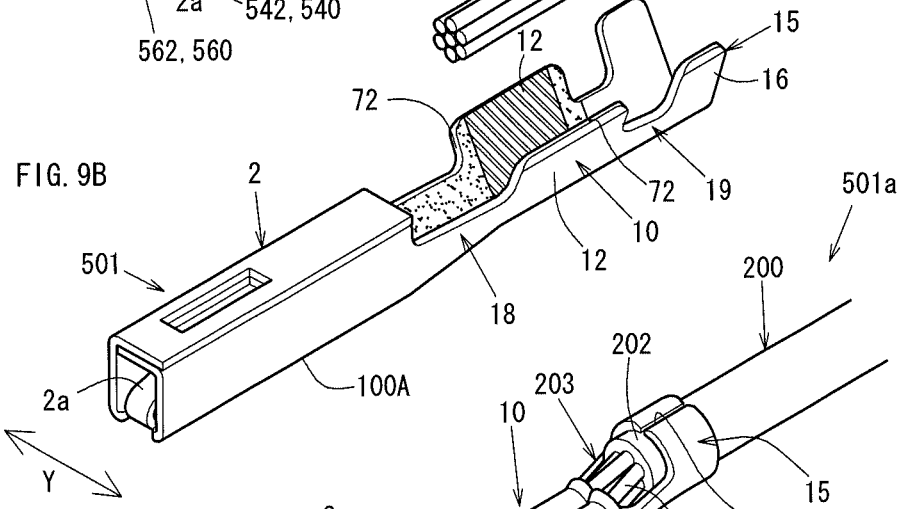
Figure 9C:
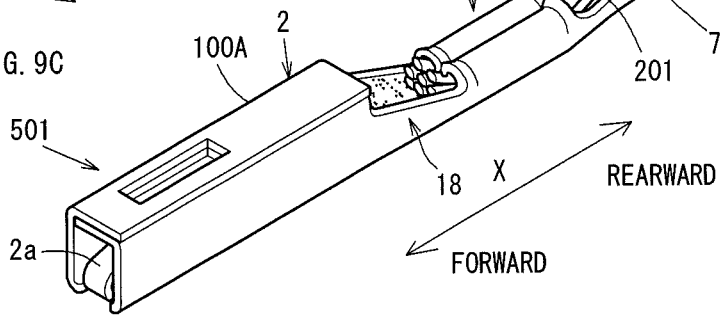
Figure 10:
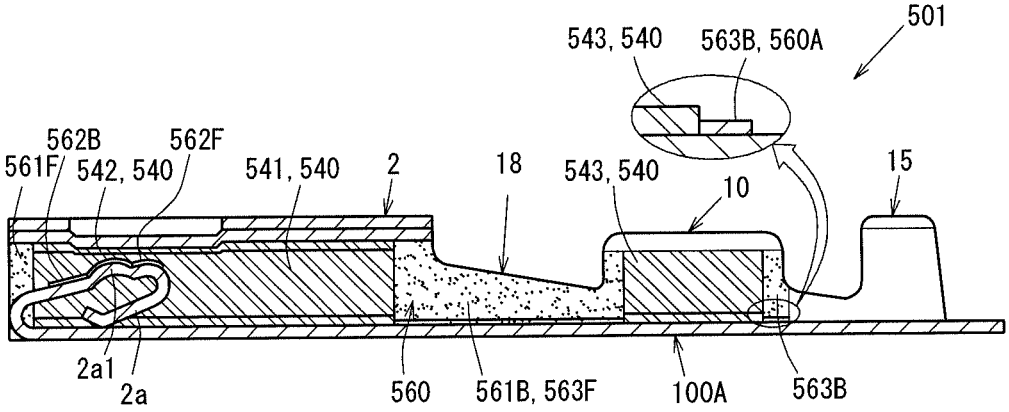
FIG. 10 is a cross-sectional view of the crimp terminal in Embodiment 4.

In more detail, FIG. 9A is an isometric view of a cross-section of the crimp terminal 501 in Embodiment 4 taken along the line extending in the longitudinal direction X at the intermediate position in the width direction Y. FIG. 9B is an isometric view of the crimp terminal 501 in Embodiment 4 before an insulated wire 200 is pressure-bonded thereto and the insulated wire 200. FIG. 9C is an isometric view of the connection structural body 501*a*.

Figure 11A:
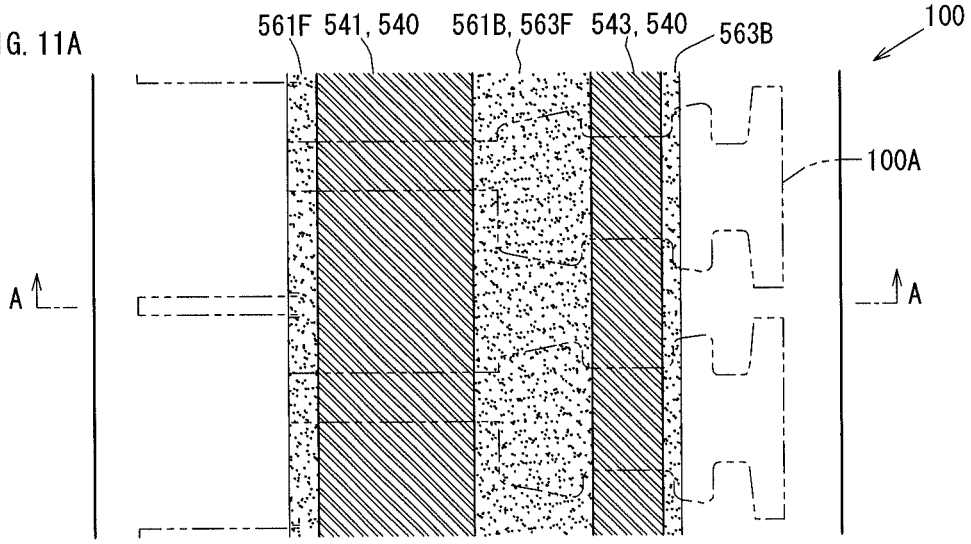
FIGS. 11A through 11C each show a substrate before a shape of the crimp terminal in Embodiment 4 is punched out.
Figure 11B:
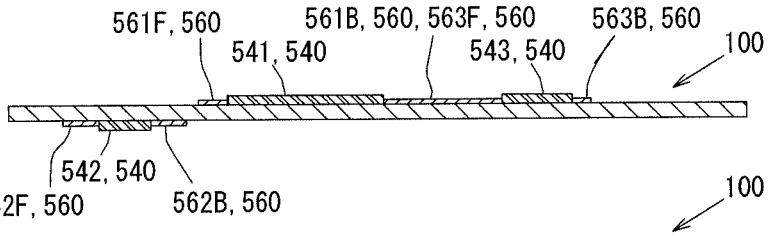
Figure 11C:
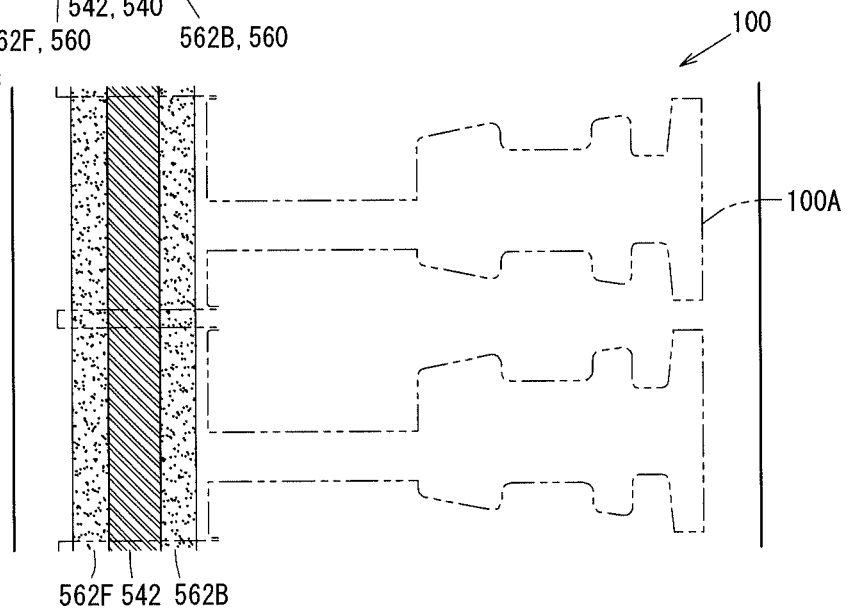

FIG. 11A is a partial plan view of the plate-like aluminum plate 100 which is to be processed into the crimp terminal 501. FIG. 11B is a cross-sectional view taken along line A-A of FIG. 11A. FIG. 11C is a partial bottom view of the aluminum plate 100.

The connection structural body 501*a* includes the crimp terminal 501 and the insulated wire 200 connected to the crimp terminal 501 by pressure bonding. The insulated wire 200 includes, for example, an aluminum conductor 201, which is a core wire having a composition of ECAI (JIS A1060 or A1070 for an aluminum alloy line material for power transmission cables), and a conductor cover 202 for covering the aluminum conductor 201. A tip part of the conductor cover 202 is peeled off to expose a tip part of the aluminum conductor 201. The exposed tip part is an aluminum conductor tip part 203.

This will be described in more detail. The insulated wire 200 includes the aluminum conductor 201 formed of twisted aluminum wires and the conductor cover 202 formed of an insulating resin. The aluminum conductor 201 may be formed of, for example, 11 twisted wires and have a conductor cross-sectional area size of 0.75 $mm^2$.

The crimp terminal 501 in Embodiment 4 is a female terminal. The crimp terminal 501 includes, from a forward end to a rearward end in the longitudinal direction X thereof, a box section 2 for allowing insertion of a male tab of a male terminal (not shown), a wire barrel section 10 located rearward to the box section 2 with a first transition 18 of a prescribed length interposed therebetween, and an insulation barrel section 15 located rearward to the wire barrel section 10 with a second transition 19 of a prescribed length interposed therebetween. The box section, the wire barrel section 10 and the insulation barrel section 15 are integrally formed.

The box section 2 is formed of a hollow quadrangular prism. The box section 2 accommodates a contact piece 2*a* which is bent rearward in the longitudinal direction X and has a contact convex part 2*a*1, which is to be in contact with the male tab of the male terminal to be inserted.

As shown in FIG. 9B, the wire barrel section 10 in a pre-pressure-bonding state includes a barrel bottom 11 and wire barrel pieces 12 extending in oblique outer upper directions from both sides of the barrel bottom 11 in the width direction Y. The wire barrel section 10 is U-shaped when seen in a rear view. Similarly, the insulation barrel section 15 in a pre-pressure-bonding state includes a barrel bottom 17 and insulation barrel pieces 16 extending in oblique outer upper directions from both sides of the barrel bottom 17 in the width direction Y. The insulation barrel section 15 is U-shaped when seen in a rear view.

The above-described crimp terminal 501 includes an aluminum substrate 100A formed of an aluminum material and obtained by punching out the plate-like aluminum plate 100 into a shape of the terminal, a plated part 540 provided on prescribed areas on a surface of the aluminum substrate 100A, and an insulating cover 560 obtained formed on a border between the aluminum substrate 100A and the plated part 540.

The plated part 540 is formed of a plating material containing a nobler metal material than the aluminum material, and includes a first plated part 541, a second plated part 542 and a third plated part 543 which are provided on the surface of the aluminum substrate 100A.

The first plated part 541 is formed on an inner surface of the box section 2, the second plated part 542 is formed on the contact convex part 2*b* of the contact piece 2, and the third plated part 543 is formed on an inner surface of the wire barrel section 10.

The first plated part 541 and the second plated part 542 are each formed on a part which is to be in contact with the male tab when the male tab is inserted. The third plated part 543 is formed on a part which is to be in contact with the aluminum conductor tip part 203.

The insulating cover 560 includes a first insulating cover 561, a second insulating cover 562 and a third insulating cover 563.

The first insulating cover 561 is formed at least on a border between the aluminum substrate 100A and the first plated part 541 on the surface of the aluminum substrate 100A. The second insulating cover 562 is formed at least on a border between the aluminum substrate 100A and the second plated part 542 on the surface of the aluminum substrate 100A. The third insulating cover 563 is formed at least on a border between the aluminum substrate 100A and the third plated part 543 on the surface of the aluminum substrate 100A.

As shown in FIG. 10, FIG. 11A and FIG. 11B, the first insulating cover 561, the second insulating cover 562 and the third insulating cover 563 are formed such that the overlapping amounts respectively with the first plated part 541, the second plated part 542 and the third plated part 543 are zero (see a partial enlarged view in FIG. 10).

As shown in FIGS. 11B and 11C, the first insulating cover 561 includes a front first insulating cover 561F provided on a front border between the aluminum substrate 100A and the first plated part 541 and a rear first insulating cover 561B provided on a rear border between the aluminum substrate 100A and the first plated part 541. The second insulating cover 562 includes a front second insulating cover 562F provided on a border between the aluminum substrate 100A and the second plated part 542 at a tip of the contact piece 2*a* and a rear second insulating cover 562B provided on a border between the aluminum substrate 100A and the second plated part 542 at a base of the contact piece 2*a*. The third insulating cover 563 includes a front third insulating cover 563F provided on a front border between the aluminum substrate 100A and the third plated part 543 and a rear third insulating cover 563B provided on a rear border between the aluminum substrate 100A and the third plated part 543.

In the crimp terminal 501 in Embodiment 4, the rear first insulating cover 561B and the front third insulating cover 563F are continuously and integrally formed between the first plated part 541 and the third plated part 543 in the longitudinal direction X.

Now, a method for producing the crimp terminal 501 in Embodiment 4 will be described. As the aluminum plate 100, an aluminum alloy strip is prepared.

A preferable material of the aluminum plate 100 is, for example, of alloy No. A6022 and temper designation T4. Any material having a composition and temper designation which can be molded into the terminal is usable. There is no specific limitation on the thickness of the substrate, but the aluminum plate 100 is preferably thin to a certain extent because a compact terminal has a small tab width. A preferable thickness is 0.1 to 0.3 mm. The crimp terminal 501 produced herein has a shape and a size which allow a male terminal having a tab width of 0.64 mm to be connected thereto.

The method for producing the crimp terminal 501 is roughly classified into a first production method of performing a resin application step on the plate-like aluminum plate 100 prior to a plating step, and a second first production method of performing the plating step prior to the resin application step.

In more detail, in the first production method, the resin application step, the plating step, and a press step (punching out, bending) are performed in this order. When necessary, a heat treating step may be performed after the press step.

In the second production method, the plating step, the resin application step, and the press step (punching out, bending) are performed in this order. When necessary, a heat treating step may be performed after the press step.

In the resin application step, for example, varnish (solid content: about 30%) of a polyamideimide (PAI) solution as an insulating resin having N-methyl 2-pyrrolidone as a solvent is applied to the entirety of prescribed areas or in stripes in the prescribed areas of the aluminum plate 100 by use of a slit die coater such that the post-baking thickness is 10 μm (±1 μm). Thus, the insulating cover 560 is formed.

According to another technique of the resin application step, for example, an ultraviolet-curable resin (e.g., acrylate-based resin; 3052C produced by ThreeBond Co., Ltd.) is applied such that the post-curing thickness is 50 μm and cured to form the insulating cover 560. According to still another technique of the resin application step, a hotmelt resin (Ever-Grip AS972 produced by Toagosei Co., Ltd.) is applied while being kept at a melting temperature thereof or higher, and then cured by decreasing the temperature.

In the plating step, for example, the surface of the aluminum alloy strip is degreased, washed with an acid, double-zincated, then, treated with electroless nickel plating, and finally treated with tin electroplating.

In the press step (punching out, bending), the aluminum plate 100 is punched out into a developed shape of the terminal and bent into a three-dimensional shape.

In the heat treating step, the obtained aluminum substrate 100A is kept at a temperature higher than the melting temperature of the insulating resin.

The first production method may be classified into the following 1-A method and 1-B method. The second production method may be classified into the following 2-A method and 2-B method.

The 1-A method is the same as the method described above as the first production method except for the resin application step. The resin application step is performed by separate resin application; namely, the insulating resin is applied to the aluminum plate 100 in a separate manner.

The 1-B method is the same as the method described above as the first production method except for the resin application step. In the resin application step, a masking sub-step, a resin coating sub-step and a mask removal sub-step are performed in this order.

In the masking sub-step, areas of the aluminum plate 100 on which the plated part 40 is to be formed are masked in a striped or discrete manner.

In the resin coating sub-step, the masked areas of the aluminum plate 100 and surrounding areas are coated with an ultraviolet-curable resin.

The 2-A method is the same as the method described above as the second production method except for the plating step and the resin application step. In the plating step, a masking sub-step, a plating sub-step and a mask removal sub-step are performed in this order. In the resin application step, a masking sub-step, a resin coating sub-step (ultraviolet-curable resin) and a mask removal sub-step are performed in this order.

In the masking sub-step in the plating step, at least areas surrounding the areas on which the plated part 540 is to be formed are masked.

In the masking sub-step in the resin application step, at least areas surrounding the areas on which the insulating cover 560 is to be formed are masked.

The 2-B method is the same as the method described above as the second production method except for the plating step and the resin application step. The plating step is performed by separate plating, and the resin application step is performed by separate resin application.

The crimp terminal 501 is produced by the above-described method. The wire barrel section 10 of the crimp terminal 501 in a pre-pressure-bonding state and the insulated wire 200 are located as shown in FIG. 9B, and are caulked by use of a pressure-bonding applicator (not shown) to pressure-bond the aluminum conductor tip part 203 of the insulated wire 200 to the wire barrel section 10. In addition, the insulation barrel section 15 and the insulated wire 200 are caulked to fix the insulated wire 200 to the insulation barrel section 15. As a result, as shown in FIG. 9C, the connection structural body 501*a* in which the crimp terminal 501 is attached to the insulated wire 200 is obtained.

The crimp terminal 501 and the connection structural body 501*a* described above provide the following various functions and effects.

As described above, the crimp terminal 501 is formed of the aluminum substrate 100A of an aluminum material, and includes the box section 2, and the pressure-bonding section which includes the wire barrel section 10 and the insulation barrel section 15. The box section 2, the wire barrel section 10 and the insulation barrel section 15 are located in this order. The plated part 540 (first plated part 541, second plated part 542 and third plated part 543) containing a nobler metal material than the aluminum material is provided on contact parts of the surface of the aluminum substrate 100A that are to be in contact with the male tab of the male terminal and the aluminum conductor tip part 203. The insulating cover 560 (first insulating cover 561, second insulating cover 562 and third insulating cover 563) of an insulating resin is formed at least on a border, as seen in a plan view, between the plated part 540 and the aluminum substrate 100A.

According to the above-described structure, the insulating cover 560 is formed at least on a part of the border, as seen in a plan view, between the plated part 540 and the aluminum substrate 100A. Owing to this, galvanic corrosion of the aluminum substrate 100A, the aluminum conductor tip part 203 and the plated part 540 containing a nobler metal material than the aluminum material is prevented.

Thus, galvanic corrosion of the aluminum substrate 100A and the aluminum conductor tip part 203 is prevented, and the crimp terminal 501 has a high conducting function with the other conductive members such as the male tab of the male terminal, the aluminum conductor tip part 203 of the insulated wire 200 and the like.

Therefore, even when the male tab of the male terminal or the aluminum conductor tip part 203 is formed of a metal material less noble than the plated part 540, the crimp terminal 501 can provide a high conducting function with the male tab of the male terminal or the aluminum conductor tip part 203.

The method for producing the crimp terminal 501 described above includes the plating step of providing the plated part 540 containing a nobler metal material than the aluminum material on contact parts where the surface of the aluminum substrate 100A contacts the male tab of the male terminal and the aluminum conductor tip part 203; and the resin application step of forming the insulating cover 560, formed of an insulating material, on an area of the surface of the aluminum substrate 100A that is at least outside the plated part 540. Either one of the plating step and the resin application step is performed prior to the other. The method further includes the press step, in which a punching-out step of punching out the aluminum plate 100 into a developed shape of the crimp terminal 501 and a bending step of bending the obtained aluminum substrate 100A into a three-dimensional shape are performed in this order. When necessary, the heat treating step may be performed on the crimp terminal 501. In the heat treating step, it is preferable that heat treatment is performed at a temperature higher than the melting temperature of the insulating resin.

According to the above-described method for producing the crimp terminal 501 including the heat treating step, galvanic corrosion of the aluminum substrate 100A and the aluminum conductor tip part 203 can be prevented with more certainty while high conductivity is maintained with the male tab of the male terminal and the aluminum conductor tip part 203.

This will be described in more detail. According to the above-described method for producing the crimp terminal 501, in an insulating cover-forming step, the insulating cover 560 is formed on the surface of the aluminum plate 100. Then, the aluminum plate 100 having the insulating cover 560 formed thereon is bent into a three-dimensional shape. Therefore, there is an undesirable possibility that the insulating cover 560 formed on an edge 71 (corner) (see FIG. 9A) of the crimp terminal 501 is delaminated or cracked.

In order to avoid this, in the heat treating step performed when necessary after the insulating cover-forming step, heat treatment is performed at a temperature higher than the melting temperature of the insulating resin. Owing to this, the insulating resin used to form the insulating cover 560 is melted at and around the edge 71 of the crimp terminal 501. The melted insulating resin fills gaps in the insulating cover 560 made by the delamination or cracking, and seals the gaps.

By sealing the gaps made at the edge (corner) of the crimp terminal 501 by the delamination or cracking of the insulating cover 560 during the production of the crimp terminal 501, an electrolytic solution is prevented from entering via the gaps and thus causing galvanic corrosion of the aluminum substrate 100A and the aluminum conductor tip part 203. Therefore, high conductivity with the male tab of the male terminal and the aluminum conductor tip part 203 can be provided with certainty.

Hereinafter, a crimp terminal and a connection structural body in another embodiment will be described.

Regarding the crimp terminal 501A and the connection structural body 501*a* described below, the elements which are the same as those of the crimp terminal 501 and the connection structural body 501*a* in Embodiment 4 will bear identical reference signs thereto and descriptions thereof will be omitted.

Embodiment 5

Figure 12:
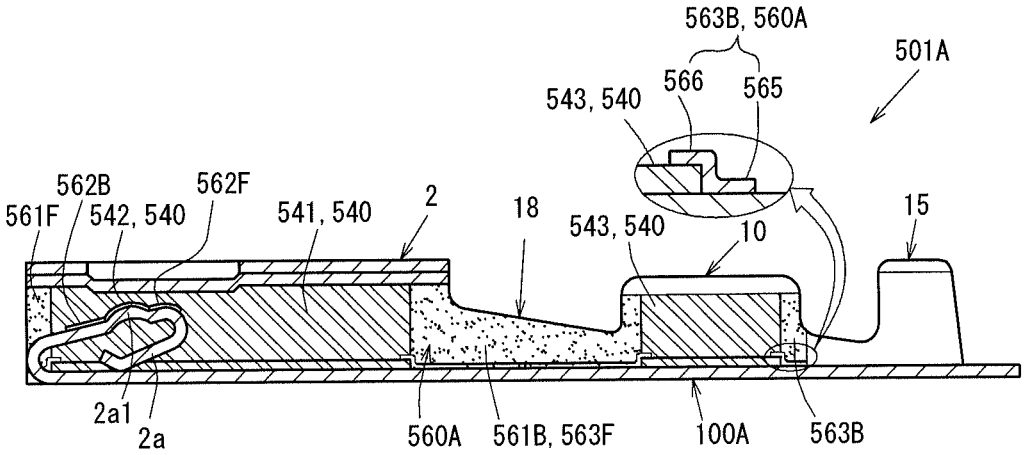
FIG. 12 is a cross-sectional view of a crimp terminal in Embodiment 5.
Figure 13A:
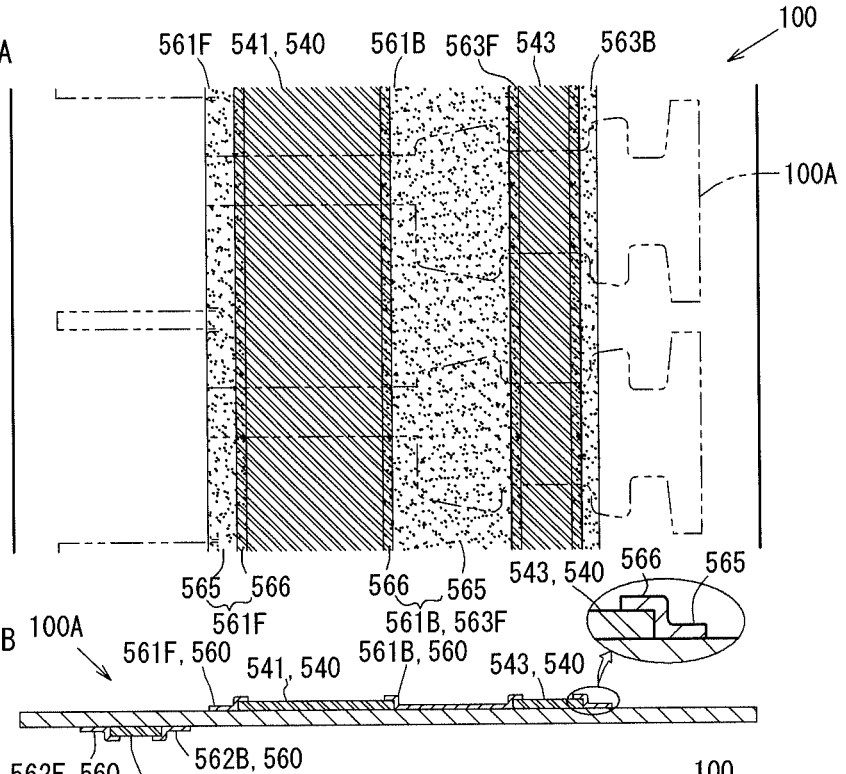
FIGS. 13A through 13C each show a substrate before a shape of the crimp terminal in Embodiment 5 is punched out.
Figure 13B:
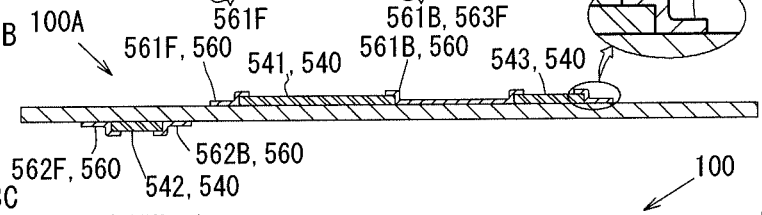
Figure 13C:
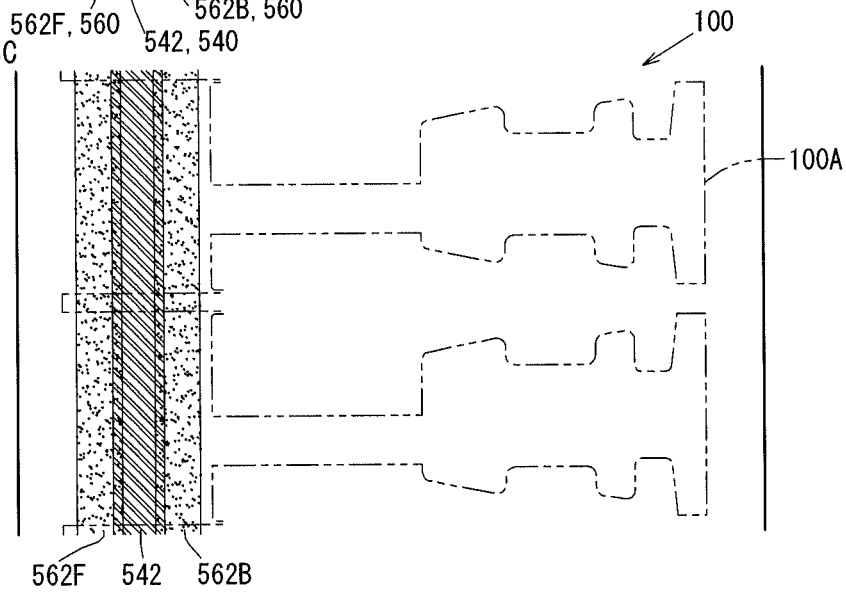

As shown in FIG. 12, especially in a partial enlarged view in FIG. 12, and FIG. 13, in the crimp terminal 501A and the connection structural body 501*a* in Embodiment 5, an insulating cover 560A includes an aluminum substrate insulating cover 565 located on the surface of the aluminum substrate 100A and a plated part insulating cover 566 located on a surface of the plated part 540. The aluminum substrate insulating cover 565 and the plated part insulating cover 566 are formed continuously and integrally while striding over the border between the aluminum substrate 100A and the plated part 540.

In the case where the insulating cover 560A is formed only on the surface of the aluminum substrate, an aqueous solution of electrolyte may enter an interface between the layer of the plated part 540 (plated layer) and the layer of the insulating cover 560A (insulating resin cover). When this occurs, there is an undesirable possibility that galvanic corrosion occurs to the aluminum substrate/plated part interface. According to above-described structure, the insulating cover 560A is formed to overlap the surface of the plated part 540 as well as on the surface of the aluminum substrate 100A. Owing to this, entrance of the aqueous solution of electrolyte into the interface between the plated layer and the insulating resin layer is prevented with more certainty, and thus galvanic corrosion is prevented with more certainty.

Now, effect confirmation tests performed on the crimp terminal and the connection structural body according to the present invention exemplified by the crimp terminals 501 and 501A and the connection structural body 501*a* will be described.

(Effect Confirmation Test 4)

The crimp terminals 501 which are varied in the positions, number and width of the insulating cover 560 were produced. Each terminal was pressure-bonded with an aluminum wire to form a connection structural body.

Each terminal was formed of a 0.2 mm-thick plate of alloy No. 6022 and temper designation T4. A core wire formed of an aluminum wire having a conductor cross-sectional area size of 0.75 $mm^2$ and a length of 11 cm (composition of the aluminum wire: ECAI; 11 wires being twisted) was attached to the terminal by pressure bonding to form a connection structural body. An end of the core wire opposite to the end pressure-bonded to the crimp terminal was stripped of a cover by a length of 10 mm and immersed in a solder bath for aluminum (produced by Nihon Almit Co., Ltd.; T235, using flux) to solder the surface of the core wire. This was performed to minimize the resistance of the contact point with the probe at the time of measurement of the electric resistance. The length of the test samples of 11 cm and the soldering performed on the opposite end do not characterize the embodiments of the present invention, and are merely necessary for evaluations in the effect confirmation tests.

The test results are shown in Table 4.

TABLE 4

| Test | Female terminal specifications | | Ppressure-bonding section | Corrosion state | | | | |
|---|---|---|---|---|---|---|---|---|
| | | | | Contact | Box | | Aluminum conductor | |
| sample | FIG | Terminal specifications | resistance | piece | section | Transitions | tip part | Press-sheared edge of terminal |
| Example 1A | FIG. 14 | Plated part: stripes<br>Insulating cover: stripes (contact part) | ○ | ○ | ○ | ○ | ○ | Pitting corrosion at Al plate end surface in contact with stripe Sn |
| Example 1B | FIG. 15 | Plated part: stripes<br>Insulating cover: stripes (barrel) | ◎ | ○ | ○ | ○ | ◎ | Pitting corrosion at Al plate end surface in contact with stripe Sn |
| Example 1C | FIG. 16 | Plated part: stripes<br>Insulating cover: stripes (contact part, barrel) | ◎ | ○ | ○ | ○ | ◎ | Pitting corrosion at Al plate end surface in contact with stripe Sn |
| Example 1D | FIG. 11 | Plated part: stripes<br>Insulating cover: stripes (contact part, barrel) | ◎ | ○ | ○ | ◎ | ◎ | Pitting corrosion at Al plate end surface in contact with stripe Sn |
| Example 1E | FIG. 17 | Plated part: stripes<br>Insulating cover: entire | ◎ | ◎ | ◎ | ◎ | ◎ | Pitting corrosion at Al plate end surface in contact with stripe Sn |
| Example 1F | FIG. 18 | Plated part: partial<br>Insulating cover: partial | ◎ | ○ | ○ | ○ | ◎ | No pitting corrosion observed |
| Example 1G | FIG. 19 | Plated part: partial<br>Insulating cover: entire | ◎ | ◎ | ◎ | ◎ | ◎ | No pitting corrosion observed |
| Comparative example 1 | FIG. 24 | Insulating cover: Absent | X | X | X | X | Δ | Significantly corroded and damaged |

For performing effect confirmation test 4, test samples of examples 1A through 1G and comparative example 1 were produced. Specifically, 10 samples were produced for each of examples 1A through 1G and comparative example 1. The aluminum female terminal of each sample was produced with the specifications shown in Table 1, and was connected to the aluminum conductor tip part 203 of the insulated wire 200 by pressure bonding to produce a connection structural body 501*a*.

Each of 10 connection structural bodies 501*a* produced for each of examples 1A through 1G and the comparative example was set in a female connector, and this was used for the test.

Hereinafter, the structure of the female terminal in the test sample of each of examples 1A through 1G and comparative example 1 will be described with reference to FIG. 11, FIGS. 14 through 19 and FIG. 24. Differences from the structure of the crimp terminal 501 in Embodiment 4 will be mainly described.

Figure 14A:
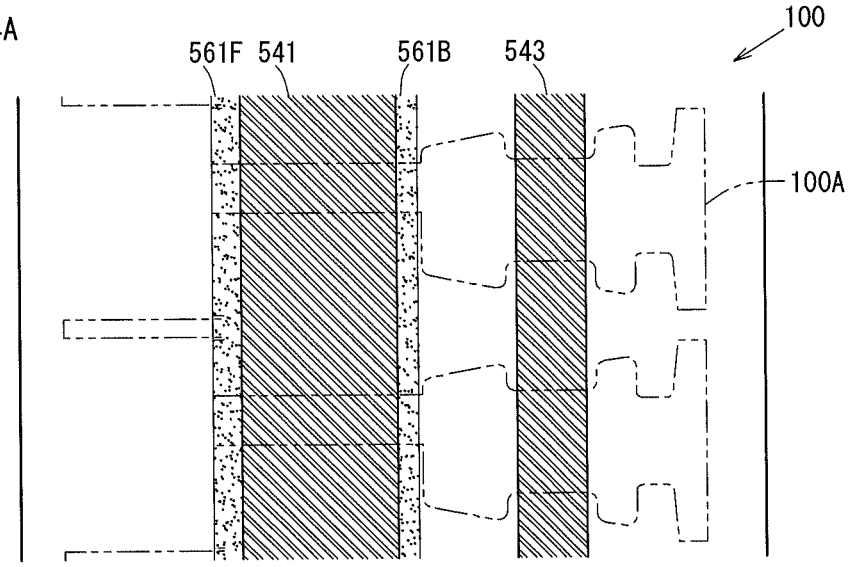
FIGS. 14A through 14C each show a substrate before a shape of the crimp terminal in another embodiment is punched out.
Figure 14B:
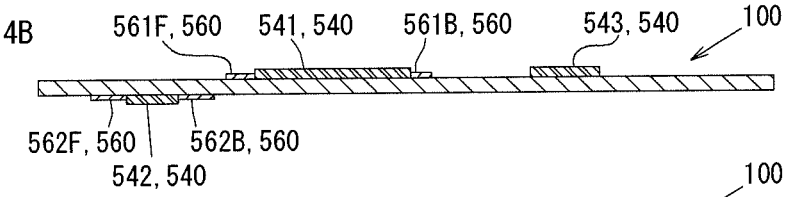
Figure 14C:
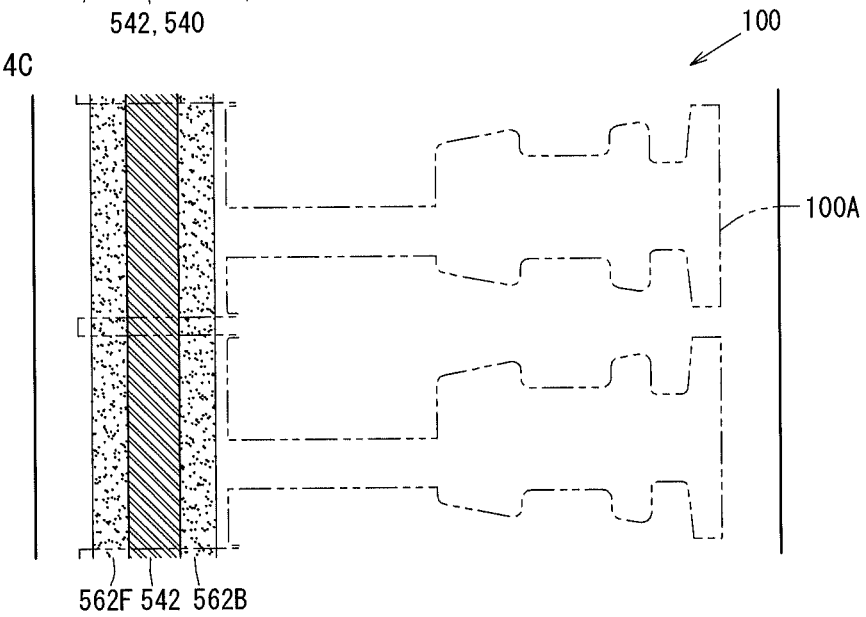

As shown in FIGS. 14A, 14B and 14C, in the female terminal of example 1A, the insulating cover 560 includes only the first insulating cover 561 and the second insulating cover 562 provided in stripes and does not include the third insulating cover 563.

Figure 15A:
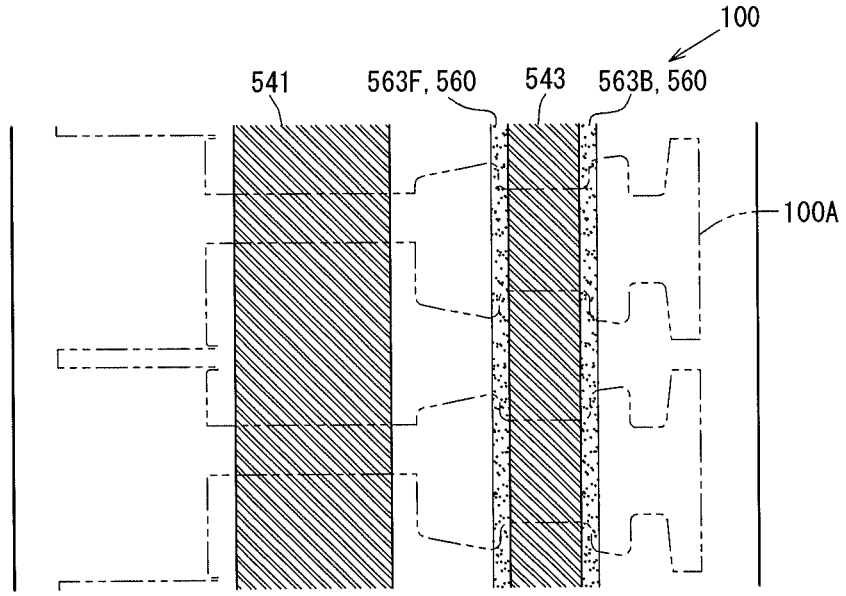
FIGS. 15A through 15C each show a substrate before a shape of the crimp terminal in still another embodiment is punched out.
Figure 15B:
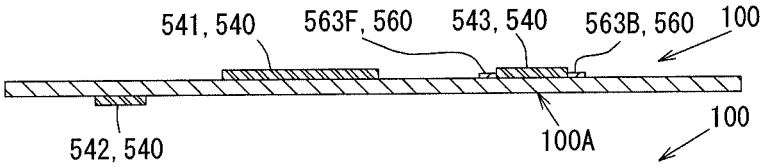
Figure 15C:
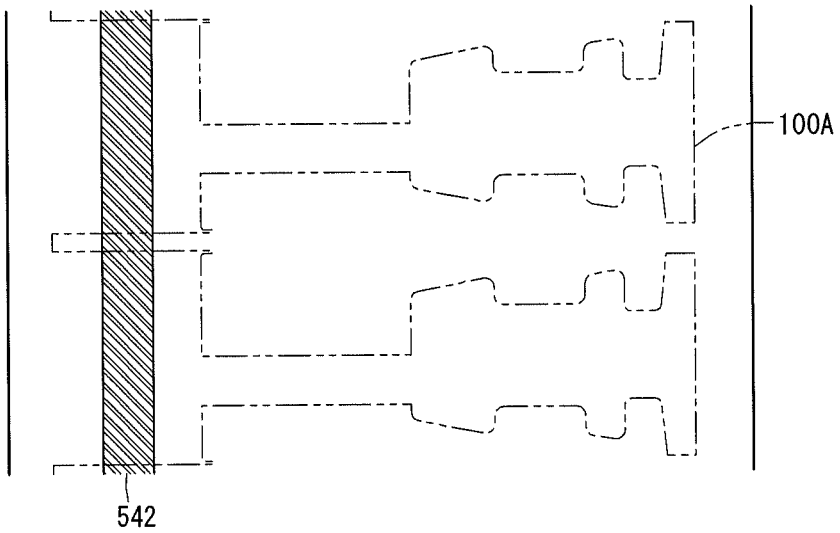

As shown in FIGS. 15A, 15B and 15C, in the female terminal of example 1B, the insulating cover 560 includes only the third insulating cover 563.

Figure 16A:
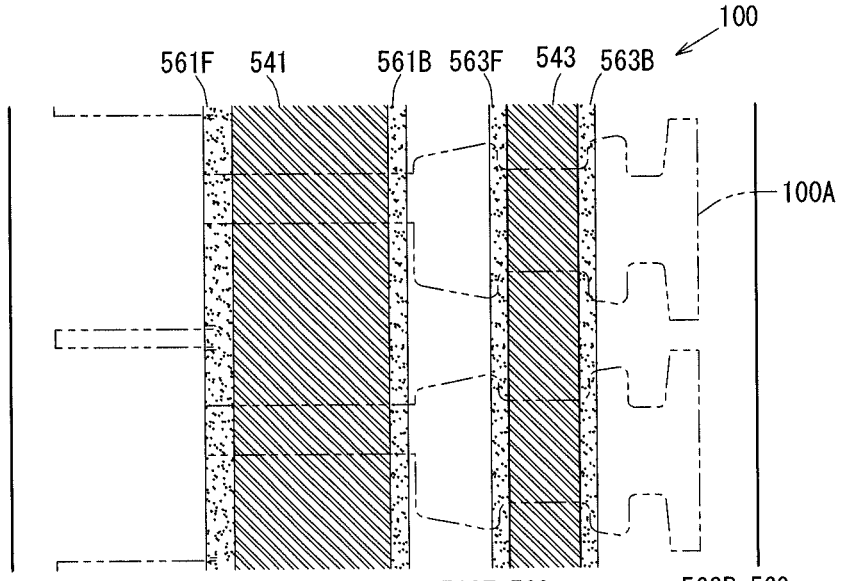
FIGS. 16A through 16C each show a substrate before a shape of the crimp terminal in still another embodiment is punched out.
Figure 16B:
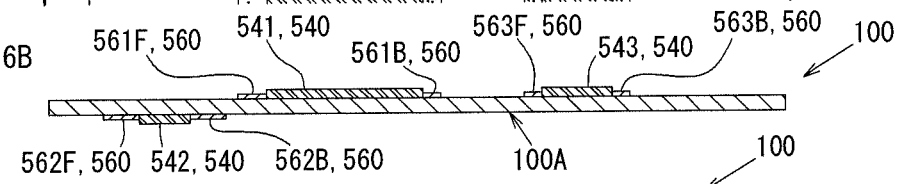
Figure 16C:
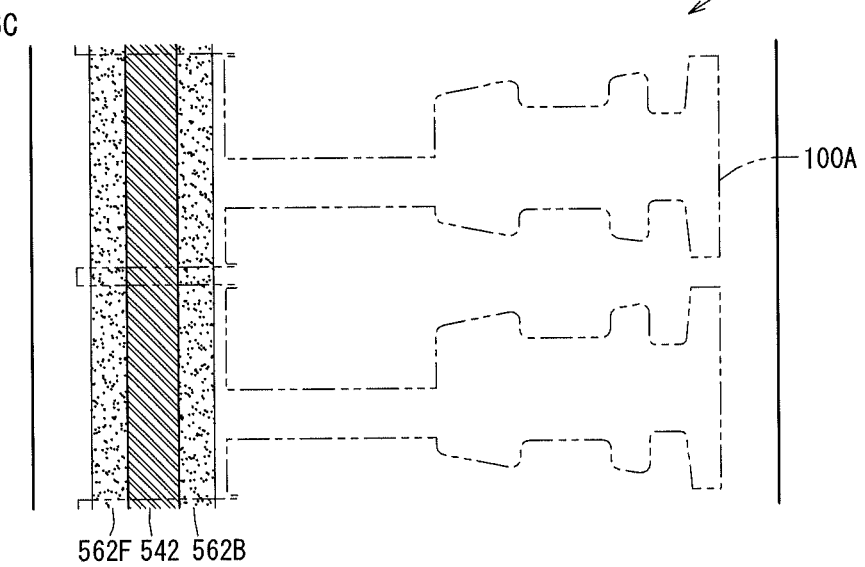

As shown in FIGS. 16A, 16B and 16C, in the female terminal of example 1C, the insulating cover 560 includes the first insulating cover 561, the second insulating cover 562 and the third insulating cover 563. Between the first plated part 541 and the third plated part 543, the rear first insulating cover 561B and the front third insulating cover 563F are not connected to each other.

The female terminal of example 1D has a structure shown in FIGS. 11A, 11B and 11C, which is substantially the same as that of the crimp terminal 501 in Embodiment 4.

Figure 17A:
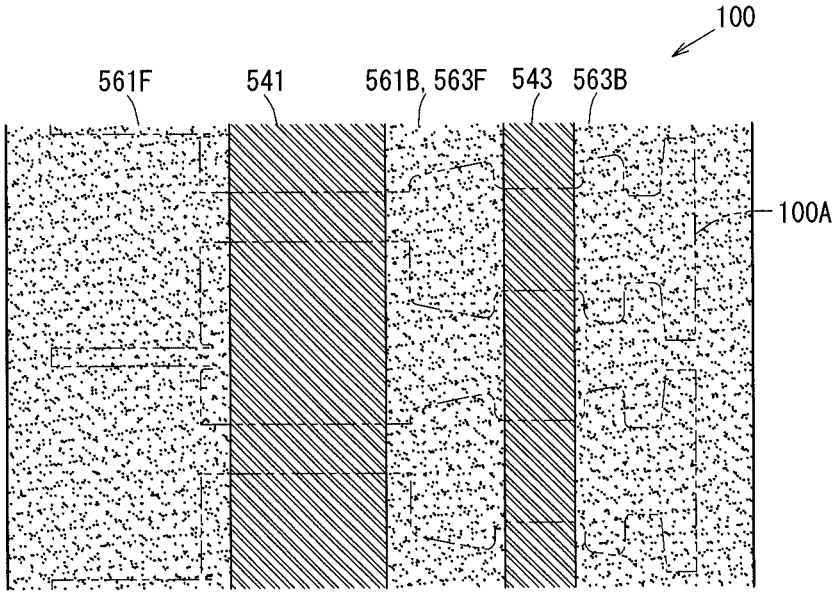
FIGS. 17A through 17C each show a substrate before a shape of the crimp terminal in still another embodiment is punched out.
Figure 17B:
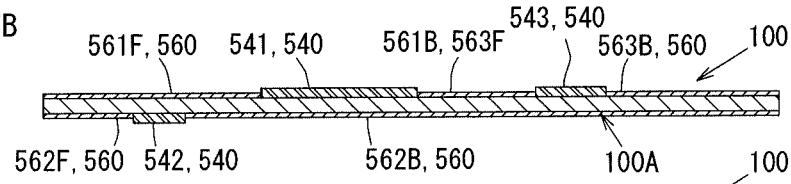
Figure 17C:
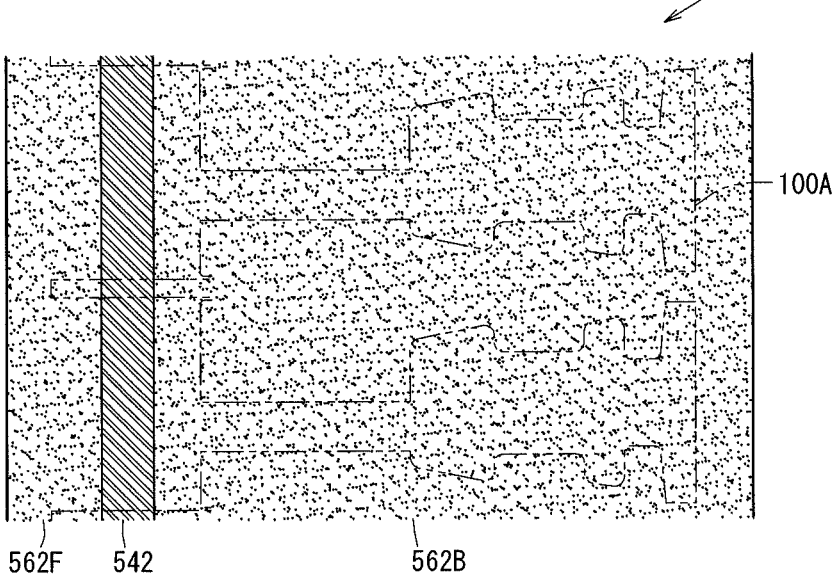

As shown in FIGS. 17A, 17B and 17C, in the female terminal of example 1E, the insulating cover 560 is formed on the entirely of the aluminum substrate 100A except for the plated part 540.

Figure 18A:
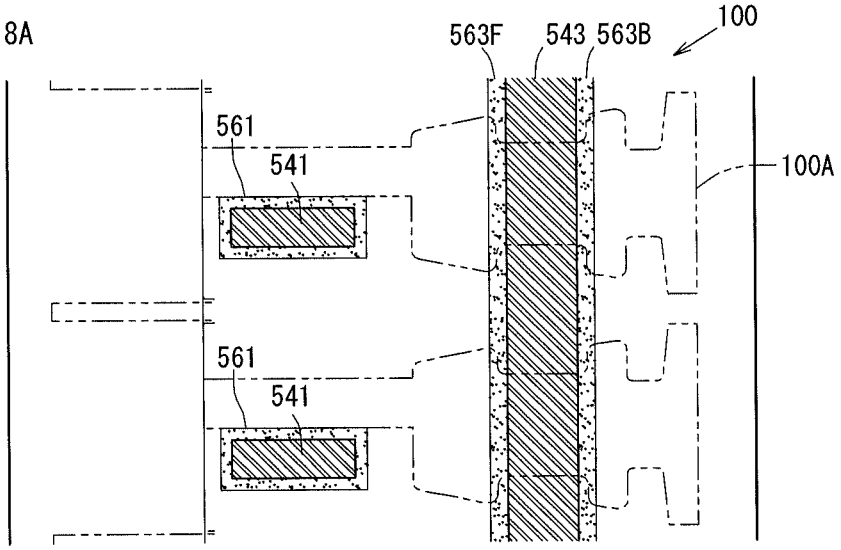
FIGS. 18A through 18C each show a substrate before a shape of the crimp terminal in still another embodiment is punched out.
Figure 18B:
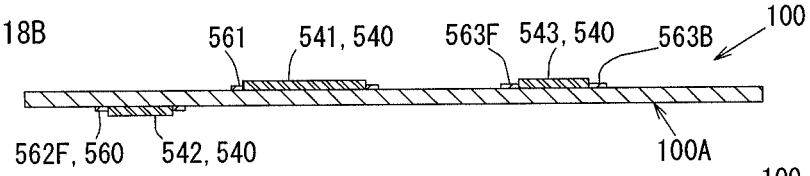
Figure 18C:
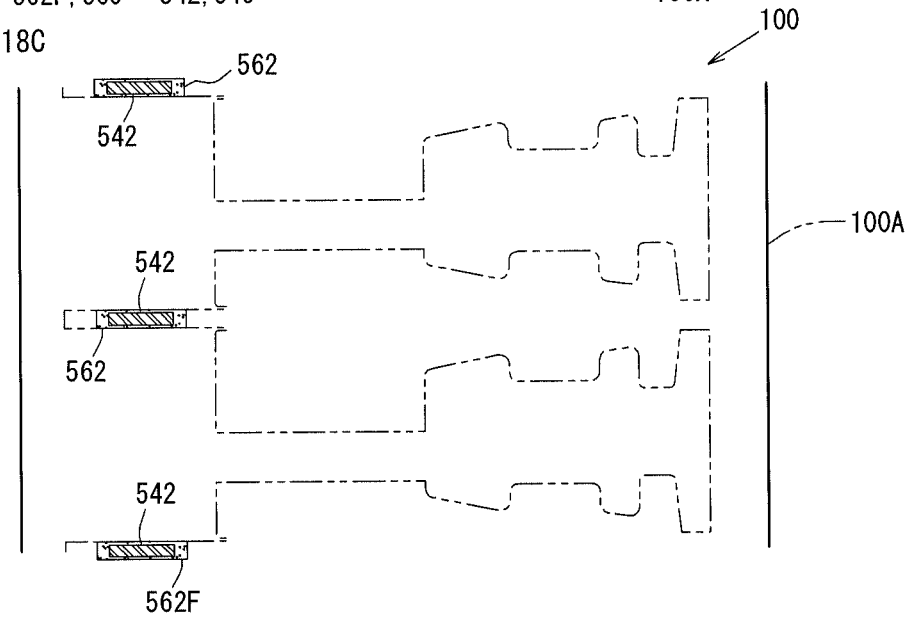

As shown in FIGS. 18A, 18B and 18C, in the female terminal of example 1F, the first plated part 541 is formed only on an area corresponding to an upper wall inside the box section 2 of the aluminum substrate 100A, and the second plated part 542 is formed only on an area corresponding to the contact convex part 2*b* of the aluminum substrate 100A. The first insulating cover 561 is formed along an outer periphery of the first plated part 541 on the aluminum substrate 100A. The second insulating cover 562 is formed along an outer periphery of the second plated part 542 on the aluminum substrate 100A.

Figure 19A:
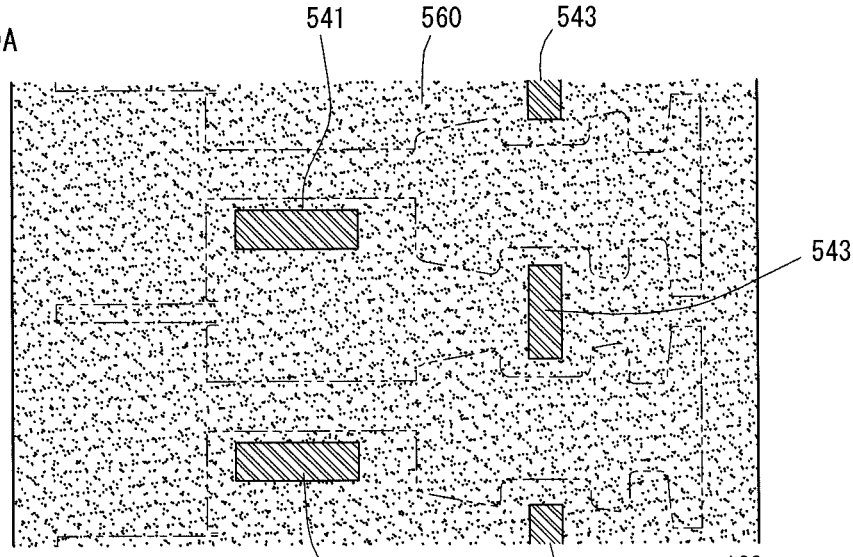
FIGS. 19A through 19C each show a substrate before a shape of the crimp terminal in still another embodiment is punched out.
Figure 19B:
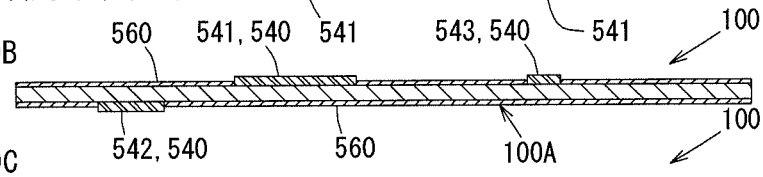
Figure 19C:
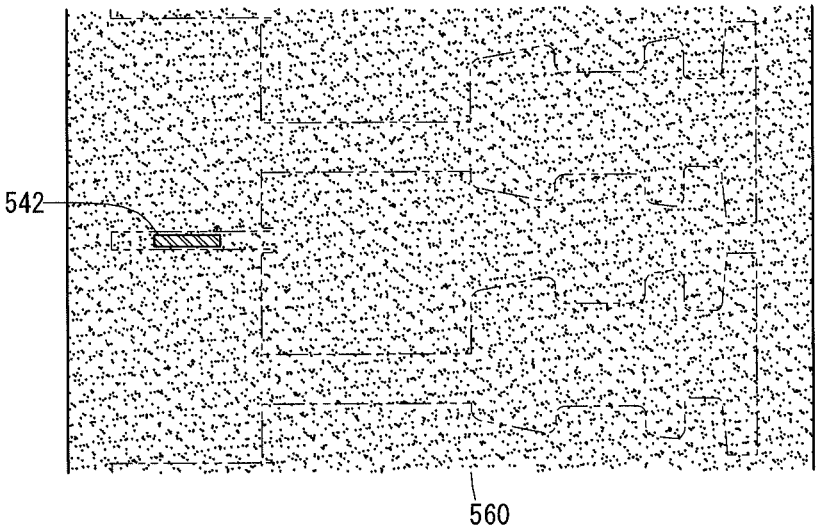

As shown in FIGS. 19A, 19B and 19C, in the female terminal of example 1G, the first plated part 541 is formed only on an area corresponding to an upper wall inside the box section 2 of the aluminum substrate 100A, and the second plated part 542 is formed only on an area corresponding to the contact convex part 2*b* of the aluminum substrate 100A. The third plated part 543 is formed only on an area corresponding to the wire barrel section 10. The insulating cover 560 is formed on the entirety of the aluminum substrate 100A except for the plated part 540.

Figure 24A:
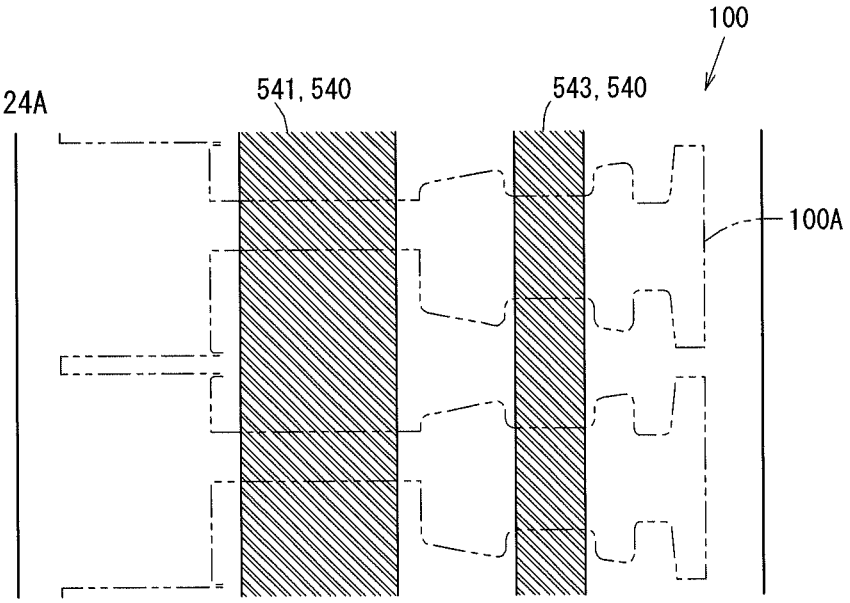
FIGS. 24A through 24C each show a substrate before a shape of a conventional crimp terminal is punched out.
Figure 24B:
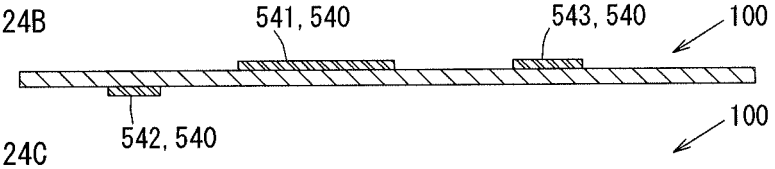
Figure 24C:
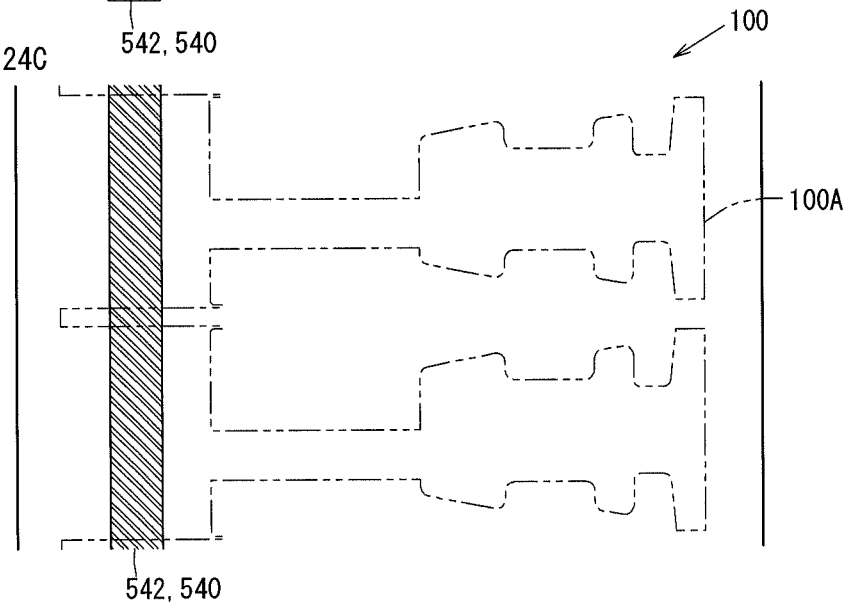

As shown in FIGS. 24A, 24B and 24C, the female terminal of comparative example 1 includes the plated part 540 formed on the aluminum substrate 100A and including the first plated part 541, the second plated part 542 and the third plated part 543, but does not include the insulating cover 560.

Effect confirmation test 4 was performed as follows. A test of spraying a 5% saline solution was performed for 96 hour on each test sample of examples 1A through 1G and comparative example 1. After the test, an increasing amount of the resistance value of the pressure-bonding section from before the test was measured.

In more detail, effect confirmation test 4 was performed as follows. The cover-stripped end of the core wire opposite to the end pressure-bonded to the crimp terminal was covered with a Telfon (registered trademark) tube (Teflon tube; produced by Nichias Corporation) and the tube was fixed with a PTFE tape to be waterproofed. The saline solution spray test defined by JIS Z2371 was performed as described above (5% by weight of saline solution of 35° C. was sprayed). After the test, the tube was made non-waterproofed, and the resistance value thereof was measured in substantially the same manner as the initial resistance value. For each sample, the initial resistance value was subtracted from the post-test value to calculate the post-spray resistance increasing value of the pressure-bonding section.

The resistance value was performed as follows. A resistance meter (ACmΩHiTESTER3560; produced by Hioki E.E. Corporation) was used. The wire barrel section side of the box section 2 was set as a positive electrode, and the cover-stripped end of the core wire opposite to the end pressure-bonded to the crimp terminal was set as a negative electrode. The measurement was performed by a 4-terminal method. The resistance values at the aluminum conductor 201 of the insulated wire 200, at the crimp terminal 501, and the pressure-bonding point of the wire barrel section 10 were summed up to find the measured resistance value.

The results of the resistance increasing values were evaluated as follows. When all of the 10 samples had a resistance increasing value of less than 2 mΩ, the evaluation result was "◎". When all of the 10 samples had a resistance increasing value of less than 5 mΩ, the evaluation result was "○". When all of the 10 samples had a resistance increasing value of less than 10 mΩ, the evaluation result was "Δ". When at least one of the 10 samples had a resistance increasing value of 10 mΩ or greater, the evaluation result was "x".

In effect confirmation test 4, the corrosion state of each part of the connection structural body 501*a* was evaluated. This will be described in more detail. An external appearance and a cross-section of each part of the connection structural body 501*a* were observed. In addition, the pitting corrosion state of the press-sheared edge 72 (see FIGS. 9B and 9C) was observed. Where the pitting corrosion occurred, the depth thereof was measured.

When slight discoloration of the surface occurred or no pitting corrosion occurred, the evaluation results was "◎". When discoloration clearly occurred to the surface but did not proceed to the inside (the depth of the pitting corrosion was less than 1/10 of the thickness of the plate), the evaluation results was "○". When the pitting corrosion reached within half of the thickness of the plate, the evaluation results was "Δ". When a trace of pitting corrosion was observed at equal to or greater than half of the thickness of the plate, the evaluation results was "x".

Among the results of effect confirmation test 4 performed as described above, the resistance increasing value of the pressure-bonding section was as follows. As shown in Table 4, at least one of the connection structural body of comparative example 1 had a resistance increasing value of 10 mΩ or greater, and thus comparative example 1 was evaluated as "x". By contrast, all the connection structural bodies 501*a* of example 1A had a resistance increasing value of less than 5 mΩ, and thus example 1A was evaluated as "○". All the 10 samples of each of examples 1B through 1G had a resistance increasing value of less than 2 mΩ, and thus examples 1B through 1G were evaluated as "◎".

As described above, the test samples of examples 1A through 1G can suppress the resistance increasing value to be smaller than the test sample of comparative example 1. Thus, it was demonstrated that galvanic corrosion of the aluminum substrate 100A and the aluminum conductor tip part 203 can be prevented and high conductivity can be provided.

The corrosion state of the test sample of comparative example 1 was as follows. At the aluminum conductor tip part 203, pitting corrosion occurred and the evaluation result was "Δ". At the contact piece 2*a*, the box section 2, and the transitions 18 and 19, pitting corrosion proceeded by equal to or greater than half of the thickness of the plate, and the evaluation results was "x". Thus, it should be considered that the strength for supporting the contact parts or the pressure-bonding section is insufficient.

By contrast, the results of the connection structural bodies 501*a* of examples 1A through 1G were "◎" or "○" for each part. Namely, discoloration occurred only at the surface, or pitting corrosion occurred slightly (depth of the pitting corrosion was less than 10% of the thickness of the plate). This merely weakens the strength of the terminal by about 10%. It was demonstrated that the strength for supporting the contact parts or the pressure-bonding section is sufficient.

The corrosion state of the press-sheared edge 72 of the terminal are as shown in Table 4. In the test sample of comparative example 1, the press-shaped edge 72 of the terminal in contact with the plated part 540 was significantly corroded and damaged. In the test samples of examples 1A through 1E, the press-shaped edge 72 was corroded. By contrast, in the test samples of examples 1F and 1G, no corrosion was observed at the press-shaped edge 72.

From the above, it was confirmed that in order to prevent corrosion and damage on the crimp terminal including the press-sheared edge 72, it is especially effective to form the insulating cover 560 over the entire outer edge of the plated part 540.

(Effect Confirmation Test 5)

In effect confirmation test 5, the female terminal included in the test sample of example 1D used in effect confirmation test 4, namely, the crimp terminal 501 in Embodiment 4 were arranged as follows to produce nine types of aluminum female terminals of examples 2L1 through 2L3, 2M1 through 2M3 and 2S1 through 2S3. As shown in FIGS. 20A through 20D and FIGS. 21E through 21H, the width of the insulating cover 560, more specifically, referring to FIG. 11, width L1 of each of the front first insulating cover 561F, the second insulating cover 562 (562F, 562B) and the rear third insulating cover 563B was set to 1 mm, 3 mm and 5 mm. For each of the widths, overlapping width L2 on the plated part 540 was set to 0 mm, 0.5 mm and 1 mm.

The width L1 of the insulating cover 560 and the overlapping width L2 of examples 2L1 through 2L3, 2M1 through 2M3 and 2S1 through 2S3 are shown in Table 5.

Namely, the female terminals of examples 2L3, 2M3 and 2S3 have the overlapping width L2 of 0 mm like the crimp terminals 501 of Embodiment 4. The female terminals of examples 2L1, 2L2, 2M1, 2M2, 2S1 and 2S2 have a structure in which the insulating cover 560 overlaps the plated part 540 like the crimp terminal 501A of Embodiment 5.

Samples of the nine types of female terminals of examples 2L1 through 2L3, 2M1 through 2M3 and 2S1 through 2S3 were produced like in effect confirmation test 4, and subjected to the 5% saline solution spray test like in effect confirmation test 4 to measure the post-spray resistance increasing value of the pressure-bonding section and also to evaluate the corrosion state of each part of the connection structural body 501*a*.

The test results are shown in Table 5.

TABLE 5

Figure 20A:
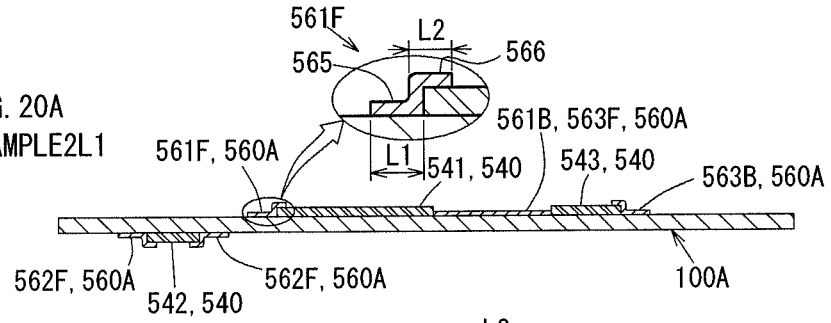
FIGS. 20A through 20D each show a substrate before a shape of the crimp terminal in still another embodiment is punched out.
Figure 20B:
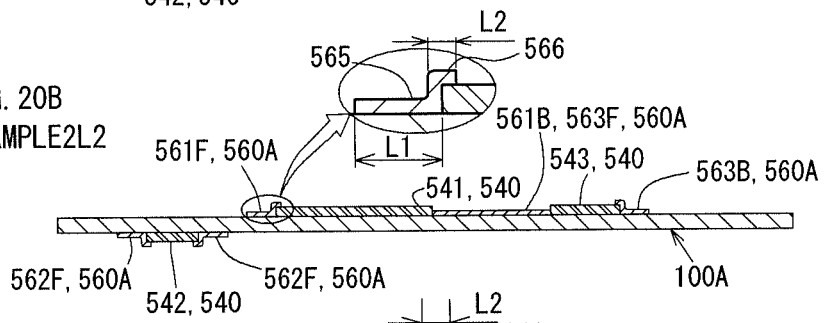
Figure 20C:
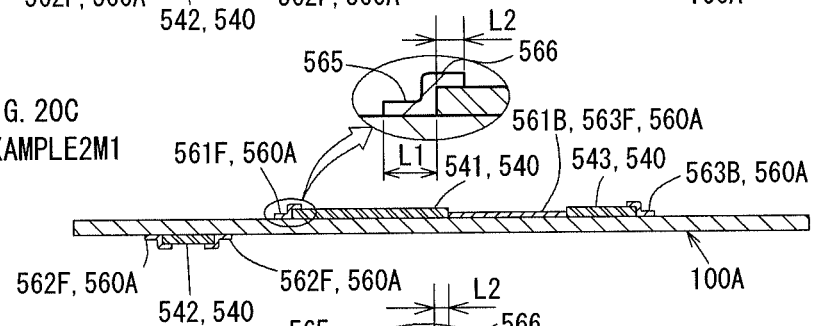
Figure 20D:
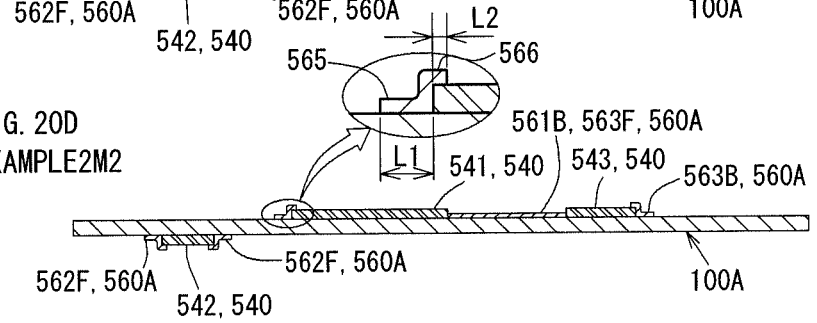
Figure 21E:
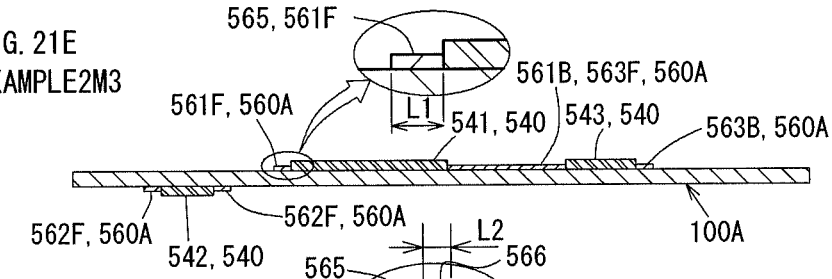
FIGS. 21E through 21H each show a substrate before a shape of the crimp terminal in still another embodiment is punched out.
Figure 21F:
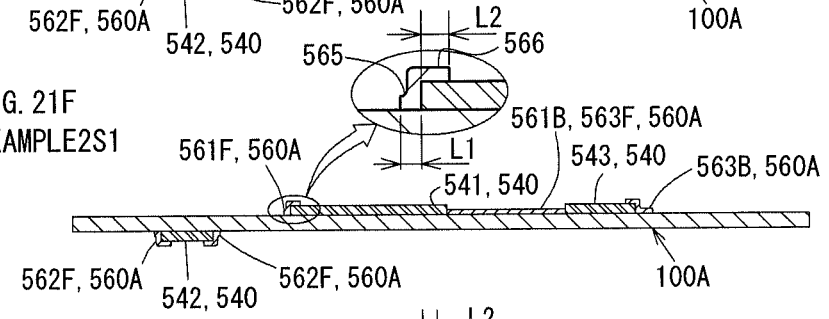
Figure 21G:
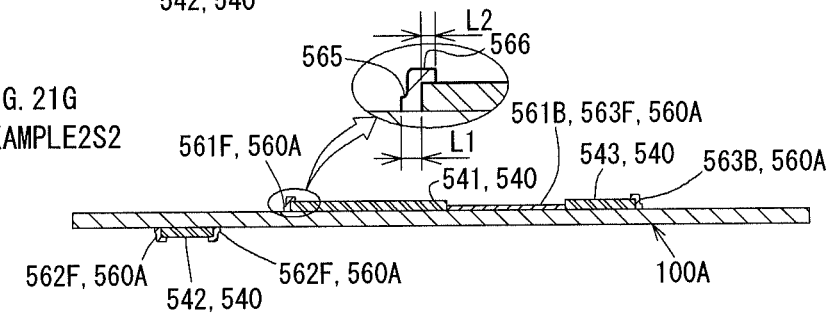
Figure 21H:
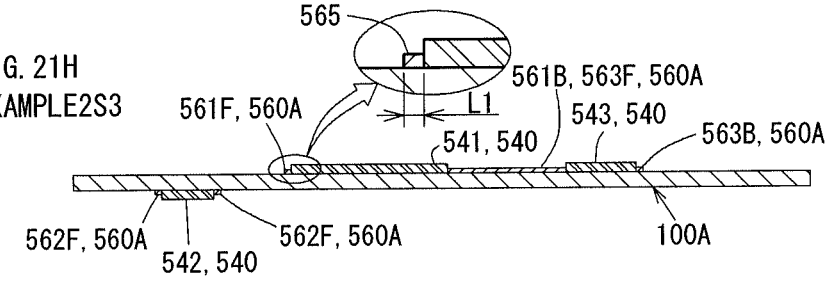

| | FIG. | Width (L1) | Overlapping width (L2) | Pressure-bonding section resistance | Contact piece | Box section | Transitions | Aluminum conductor tip part |
|---|---|---|---|---|---|---|---|---|
| Ex. 2L1 | FIG. 20(a) | Large (5 mm) | Large (1 mm) | ◎ | ◎ | ◎ | ◎ | ◎ |
| Ex. 2L2 | FIG. 20(b) | Large (5 mm) | Medium (0.5 mm) | ◎ | ◎ | ◎ | ◎ | ◎ |
| Ex. 2L3 | FIG. 11 | Large (5 mm) | None (0 mm) | ○ | ○ | ○ | ◎ | ◎ |
| Ex. 2M1 | FIG. 20(c) | Medium (3 mm) | Large (1 mm) | ◎ | ◎ | ◎ | ◎ | ◎ |
| Ex. 2M2 | FIG. 20(d) | Medium (3 mm) | Medium (0.5 mm) | ◎ | ◎ | ◎ | ◎ | ◎ |
| Ex. 2M3 | FIG. 21(e) | Medium (3 mm) | None (0 mm) | ○ | ○ | ○ | ◎ | ◎ |
| Ex. 2S1 | FIG. 21(f) | Small (1 mm) | Large (1 mm) | ○ | ○ | ○ | ◎ | ◎ |
| Ex. 2S2 | FIG. 21(g) | Small (1 mm) | Medium (0.5 mm) | Δ | Δ | Δ | ◎ | ◎ |
| Ex. 2S3 | FIG. 21(h) | Small (1 mm) | None (0 mm) | Δ | Δ | Δ | ◎ | ◎ |

The results of effect confirmation test 5 performed as described above were as follows. The test samples of examples 2S2 and 2S3, having the width L1 of 1 mm and the overlapping width L2 of 0.5 mm and 0 mm, had the resistance increasing value of less than 10 mΩ but 5 mΩ or greater, and evaluated as "Δ". Regarding the corrosion state, pitting corrosion occurred in some of the parts, and the evaluation result was "Δ".

From this, it was confirmed that when the width L1 is 1 mm and the overlapping width L2 is 0 or 0.5 mm, progress of the corrosion is not delayed sufficiently.

By contrast, the test sample of example 2S1 had the resistance increasing value of the pressure-bonding section of less than 5 mΩ and evaluated as "○". Regarding the corrosion state of the parts of the connection structural body 501*a*, the test samples were evaluated as "◎" or "○". From this, it was demonstrated that even when the width L1 is 1 mm, if the overlapping width L2 is at least 1 mm, the corrosion can be prevented and the resistance increasing value can be suppressed to less than 5 mΩ. Thus, the effectiveness of forming the insulating cover 560 to overlap the plated part 540 was confirmed.

Regarding the test samples of example 2L1 through 2L3 and 2M1 through 2M3, the results of the parts of the female terminals and the aluminum conductor tip part were "◎" or "○". Namely, discoloration occurred only at the surface, or pitting corrosion occurred slightly (depth of the pitting corrosion was less than 10% of the thickness of the plate). This merely weakens the strength of the terminal by about 10%. It was demonstrated that progress of the corrosion can be suppressed.

(Effect Confirmation Test 6)

In effect confirmation test 6, a plurality of male terminals of each of 4 types of terminal specifications and a plurality of female terminals of each of 6 types of specifications were produced. These terminals had the plated part 540 and the insulating cover 560 in accordance with the respective terminal specifications. Male connectors in which the male terminals were set and female connectors in which the female terminals were set were coupled together to form fit connectors, which were used as test samples. The corrosion state of each part of the connection structural body 501*a* after 3 days was evaluated.

This will be described in more detail. In effect confirmation test 6, as shown in Table 6, the plurality of samples for evaluation were grouped into 4 groups A through D in accordance with the 4 types of the male terminals. The test terminals in each of the groups A through D was further grouped into groups in accordance with 6 or 5 types of the female terminals.

In group A, test samples of examples 3A1 through 3A1 and comparative examples 3A1 and 3A2 were produced. In group B, test samples of examples 3B1 through 3B6 were produced. In group C, test samples of examples 3C1 through 3C6 were produced. In group D, test samples of examples 31D1 through 3D4 and comparative example 3D1 were produced.

Figure 22A:
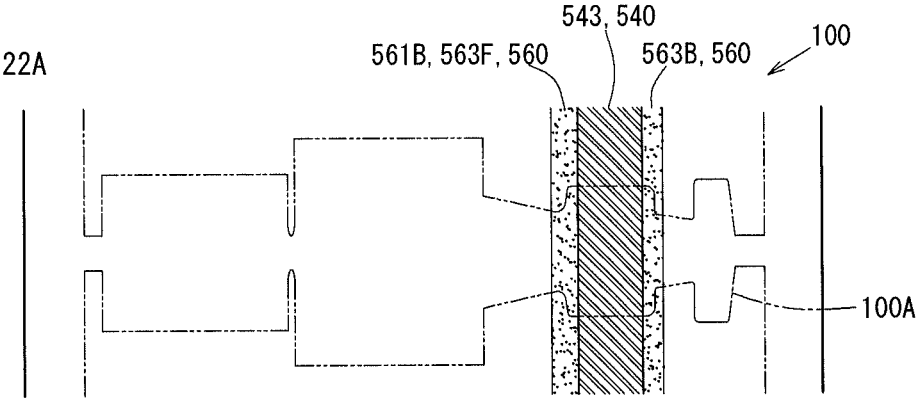
FIGS. 22A through 22C each show a substrate before a shape of the crimp terminal in still another embodiment is punched out.
Figure 22B:
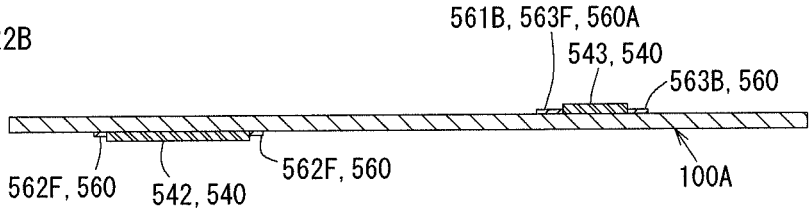
Figure 22C:
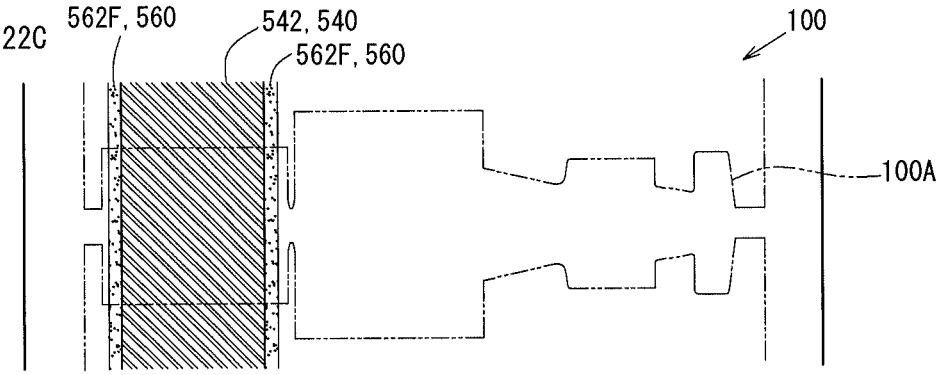

In group A, each male terminal has the plated part 540 in stripes but does not have the insulating cover 560, namely, is of the conventional specification. In group B, each male terminal has the plated part 540 in stripes and the insulating cover 560 in stripes as shown in FIGS. 22A, 22B and 22C, namely, is according to the present invention. In group C, each male terminal has the plated part 540 in stripes and the insulating cover 560 on the entirety thereof (not shown), namely, is according to the present invention. In group D, each male terminal has the plated part 540 in stripes but does not have the insulating cover 560, and is formed of a copper alloy plate, namely, is of the conventional specification.

In comparative examples 3A1, 3A2 and 3D1 and examples 3B1, 3B6, 3C1 and 3C6, each female terminal has substantially the same structure as that of the female terminal of comparative example 1 used in effect confirmation test 4 as shown in FIG. 24.

However, the female terminals of comparative example 3A2 and examples 3B6 and 3C6 are formed of a copper alloy plate instead of an aluminum plate.

In examples 3A1, 3B2, 3C2 and 3D1, each female terminal has substantially the same structure as that of the female terminal of example 1D used in effect confirmation test 4, namely, the crimp terminal 501 in Embodiment 4 as shown in FIG. 11.

In examples 3A2, 3B3, 3C3 and 3D2, each female terminal has substantially the same structure as that of the female terminal of example 1E used in effect confirmation test 4 as shown in FIG. 17.

In examples 3A3, 3B4, 3C4 and 3D3, each female terminal has substantially the same structure as that of the female terminal of example 1F used in effect confirmation test 4 as shown in FIG. 18.

In examples 3A4, 3B5, 3C5 and 3D4, each female terminal has substantially the same structure as that of the female terminal of example 1G used in effect confirmation test 4 as shown in FIG. 19.

In effect confirmation test, 10 female terminals were produced for each of the examples and comparative examples and each set in a female connector. 10 male terminals were produced for of each of the examples and comparative examples and each set in a male connector. Each female connector and each male connector were fit to each other to produce the test samples of the examples and comparative examples.

The 5% saline solution spray test was performed on these test samples like in effect confirmation tests 4 and 5 to measure the post-spray resistance increasing value of the pressure-bonding section and also to evaluate the corrosion state of each part of the connection structural body 501*a* after 3 days.

The results of the resistance increasing values were evaluated as follows. When all of the 10 samples had a resistance increasing value of less than 10 mΩ even after 15 days, the evaluation result was "◎◎". When at least one of the 10 samples had a resistance increasing value of 10 mΩ or greater after 15 days, the evaluation result was "◎". When at least one of the 10 samples had a resistance increasing value of 10 mΩ or greater after 7 days, the evaluation result was "○". When at least one of the 10 samples had a resistance increasing value of 10 mΩ or greater after 3 days, the evaluation result was "x".

The corrosion state of each part of the connection structural body 501*a* was evaluated as in effect confirmation test 4.

The results of effect confirmation test 6 are shown in Table 6.

TABLE 6

| | | | | | Resistance | Corrosion state after 3 days Evaluated part | | | |
|---|---|---|---|---|---|---|---|---|---|
| | Test sample Example/ comparative | Male terminal Terminal | Female terminal | | value Resistance increasing | Male, around contact | Female, around contact | Male, around | Female, around |
| Group | example | specifications | FIG. | Terminal specifications | value | part | part | wire | wire |
| A | Comparative ex. 3A1 | Plated part: stripes Insulating cover: absent | FIG. 24 | Plated part: stripes Insulating cover: absent | X | X | X | Δ | Δ |
| | Example 3A1 | | FIG. 11 | Plated part: stripes Insulating cover: stripes | ○ | X | ○ | ○ | ○ |
| | Example 3A2 | | FIG. 17 | Plated part: stripes Insulating cover: entire | ○ | Δ | ○ | ○ | ○ |
| | Example 3A3 | | FIG. 18 | Plated part: partial Insulating cover: partial | ○ | Δ | ○ | ○ | ○ |
| | Example 3A4 | | FIG. 19 | Plated part: partial Insulating cover: entire | ○ | Δ | ○ | ○ | ○ |
| | Comparative ex. 3A2 | | | Plated part: present Plate: copper alloy | X | X | | X | |
| B | Example 3B1 | Plated part: stripes Insulating cover: stripes | FIG. 24 | Plated part: stripes Insulating cover: absent | ○ | ○ | Δ | ○ | ○ |
| | Example 3B2 | | FIG. 11 | Plated part: stripes Insulating cover: stripes | ◎ | ○ | ○ | ○ | ○ |
| | Example 3B3 | | FIG. 17 | Plated part: stripes Insulating cover: entire | ◎ | ○ | ○ | ◎ | ◎ |
| | Example 3B4 | | FIG. 18 | Plated part: partial Insulating cover: partial | ◎ | ○ | ○ | ○ | ○ |

TABLE 6-continued

| Group | Test sample Example/ comparative example | Male terminal Terminal specifications | Female terminal FIG. | Female terminal Terminal specifications | Resistance value Resistance increasing value | Corrosion state after 3 days Evaluated part: Male, around contact part | Female, around contact part | Male, around wire | Female, around wire |
|---|---|---|---|---|---|---|---|---|---|
| | Example 3B5 | | FIG. 19 | Plated part: partial Insulating cover: entire | ◎◎ | ○ | ○ | ◎ | ◎ |
| | Example 3B6 | | | Plated part: present Plate: copper alloy | ○ | Δ | | ○ | |
| C | Example 3C1 | Plated part: stripes Insulating cover: entire | FIG. 24 | Plated part: stripes Insulating cover: absent | ○ | ○ | Δ | ○ | Δ |
| | Example 3C2 | | FIG. 11 | Plated part: stripes Insulating cover: stripes | ◎ | ○ | ○ | ○ | ○ |
| | Example 3C3 | | FIG. 17 | Plated part: stripes Insulating cover: entire | ◎◎ | ◎ | ◎ | ◎ | ◎ |
| | Example 3C4 | | FIG. 18 | Plated part: partial Insulating cover: partial | ◎◎ | ◎ | ○ | ◎ | ◎ |
| | Example 3C5 | | FIG. 19 | Plated part: partial Insulating cover: entire | ◎◎ | ◎ | ◎ | ◎ | ◎ |
| | Example 3C6 | | | Plated part: present Plate: copper: alloy | ○ | ○ | | ○ | |
| D | Comparative ex. 3D1 | Plated part: present Plate: copper alloy | FIG. 24 | Plated part: stripes Insulating cover: absent | X | | X | | X |
| | Example 3D1 | | FIG. 11 | Plated part: stripes Insulating cover: stripes | ○ | | Δ | | ○ |
| | Example 3D2 | | FIG. 17 | Plated part: stripes Insulating cover: entire | ○ | | ○ | | ○ |
| | Example 3D3 | | FIG. 18 | Plated part: partial Insulating cover: partial | ○ | | Δ | | ○ |
| | Example 3D4 | | FIG. 19 | Plated part: partial Insulating cover: entire | ○ | | ○ | | ○ |

The results of effect confirmation test 6 performed as described above are as follows regarding the resistance increasing value. The test samples of comparative examples (comparative examples 3A1, 3A2, 3D1) were evaluated "x". More specifically, in the test samples in which both of the male terminal and the female terminal have a structure different from the specifications of the present invention, for example, in the test samples in which both of the male terminal and the female terminal have the plated part 540 formed on the aluminum substrate 100A but do not include the insulating cover 560, the resistance increasing value was 10 mΩ or greater 3 days after the test; namely, the resistance was not kept low.

By contrast, the test samples of examples (examples 3A1 through 3A4, 3B1 through 3B6, 3C1 through 3C6, and 3D1 through 3D4) were evaluated as "◎" or "○". Namely, in the test samples in which at least either one of the male terminal and the female terminal fulfills the edge specification of the present invention of having the insulating cover 560 formed at least on a border between the plated part 540 and the aluminum substrate 100A, the resistance increasing value was kept less than 10 mΩ even 7 days after the test, which was satisfactory.

Regarding the corrosion state, the test samples of the comparative examples were evaluated as "x" or "Δ".

By contrast, the test samples of the examples were mostly evaluated as "◎" or "○" although partially being evaluated as "Δ". There was no test sample evaluated as "x". From this, it was confirmed that the test samples of the present invention exhibit good results; more specifically, the corrosion is limited to clear discoloration and slight pitting corrosion at the worst and that in some test samples, discoloration occurs merely slightly. The results are influenced by whether the male terminal fulfills the specifications of the present invention. It was confirmed that when neither the male terminal nor the female terminal fulfills the specifications of the present invention as in the comparative examples, corrosion is not prevented with certainty.

(Effect Confirmation Test 7)

In effect confirmation test 7, female terminals having a structure in the above-described embodiments and including the aluminum substrate 100A and the insulating cover 560 formed thereon were produced. The insulating cover 560 was formed of an insulating resin containing thermoplastic microparticles 69 dispersed in an ultraviolet-curable resin. Regarding such female terminals, the degree of delamination and cracking of the edge of the terminal in accordance with the particle size of the resin and the volumetric ratio of the particles were examined.

This will be described in more detail. In effect confirmation test 7, as shown in, for example, FIGS. 23A, 23B, 23C and 23D, a denatured olefin particle-containing resin containing microparticles of a thermoplastic resin (denatured olefin particles; melting point: 200°) dispersed in an ultraviolet-curable resin was used as the insulating resin. The size of the microparticles was set to 1 to 3 μm, about 10 μm, about 50 μm. For each of the three sizes, the volumetric ratio was set to 10%, 30%, 50%, 70% and 90%.

Figure 23A:
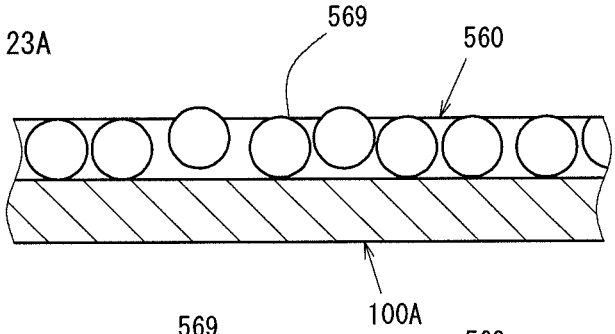
FIGS. 23A through 23D provides schematic cross-sectional views showing insulating covers containing a thermoplastic resin.
Figure 23B:
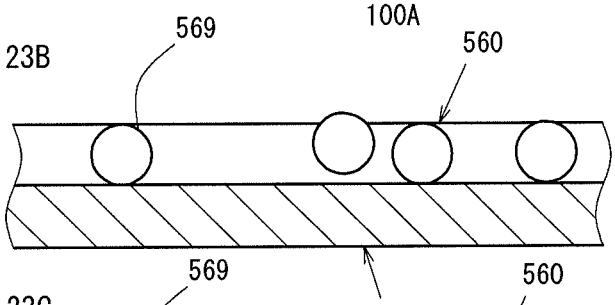
Figure 23C:
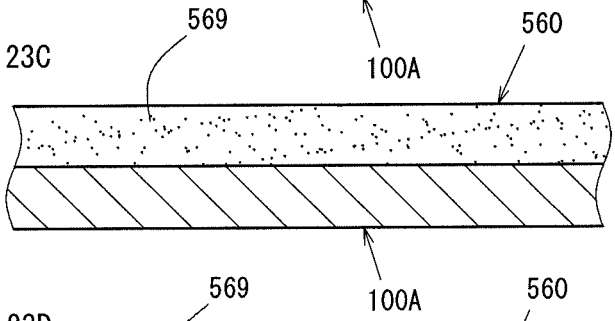
Figure 23D:
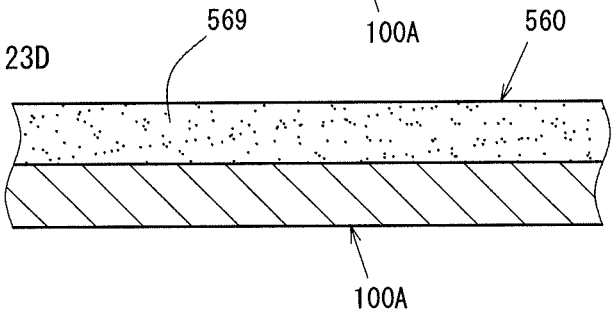

FIG. 23A is a schematic cross-sectional view of the insulating cover 560 having a volumetric ratio of the microparticles 69 of the thermoplastic resin of about 90%, a particle diameter of about 50 μm, and a layer thickness of f50 μm. FIG. 23B is a schematic cross-sectional view of the insulating cover 560 having a volumetric ratio of the microparticles 69 of the thermoplastic resin of about 10%, a particle diameter of about 50 μm, and a layer thickness of 50 μm. FIG. 23C is a schematic cross-sectional view of the insulating cover 560 having a volumetric ratio of the microparticles 69 of the thermoplastic resin of about 90%, a particle diameter of about 2 μm, and a layer thickness of 50 μm. FIG. 23D is a schematic cross-sectional view of the insulating cover 560 having a volumetric ratio of the microparticles 69 of the thermoplastic resin of about 10%, a particle diameter of about 2 μm, and a layer thickness of 50 μm.

The particles of denatured olefin used as the thermoplastic resin were produced by the method disclosed in Japanese Laid-Open Patent Publications Nos. 2000-143823 and 2008-285531.

The female terminals having a structure in the above-described embodiments were produced by use of the denatured olefin resin containing the microparticles 69 dispersed in an ultraviolet-curable resin by the 2-A method described above.

The thickness of the layer of the denatured olefin particle-containing resin formed in the resin coating sub-step was set to 50 μm.

The thermal treating step was performed at 200° C. for 0.5 hours in consideration of the melting of the resin particles.

Regarding the terminals thus produced, the degree of delamination and cracking of the resin at the corner edge 71 and the press-sheared edge 72 were examined by observation with a microscope. The results are shown in Table 7.

TABLE 7

| Thermoplastic resin Particle diameter (micrometer) | Ratio (%) | Observation with microscope: Edge (corner) | Observation with microscope: Press-sheared edge |
|---|---|---|---|
| 1-3 | 10 | X Aluminum substrate exposed | X Not covered |
| | 30 | X Aluminum substrate exposed | X Not covered |
| | 50 | X Aluminum substrate exposed | X Not covered |
| | 70 | ○ Filled with resin | ○ Covered |
| | 90 | ○ Filled with resin | ○ Covered |
| 10 | 10 | X Aluminum substrate exposed | X Not covered |
| | 30 | X Aluminum substrate exposed | X Not covered |
| | 50 | ○ Filled with resin | ○ Covered |
| | 70 | ○ Filled with resin | ○ Covered |
| | 90 | ○ Filled with resin | ○ Covered |
| 50 | 10 | X Aluminum substrate exposed | X Not covered |
| | 30 | ○ Filled with resin | ○ Covered |
| | 50 | ○ Filled with resin | ○ Covered |
| | 70 | ○ Filled with resin | ○ Covered |
| | 90 | ○ Filled with resin | ○ Covered |
| Not incorporated | 0 | X Aluminum substrate exposed | X Not covered |

As shown in Table 7, when the resin particle diameter was 1 to 3 μm and the ratio was 10%, 30% and 50%, when the resin particle diameter was 10 μm and the ratio was 10% and 30%, and when the resin particle diameter was 50 μm and the ratio was 10%, it was confirmed that the aluminum substrate 100A was exposed at the corner edge 71 and the press-sheared edge 72 was not covered with the denatured olefin particle-containing resin.

As described above, it was made clear that when the combination of the resin particle diameter and the volumetric ratio of the particles is inappropriate, the resin is delaminated or cracked. When the resin is delaminated or cracked, the aluminum substrate 100A is corroded from such a position. Therefore, it is preferable that the aluminum substrate 100A is covered as much as possible.

By contrast, when the resin particle diameter was 1 to 3 μm and the ratio was 70% and 90%, when the resin particle diameter was 10 μm and the ratio was 50%, 70% and 90%, and when the resin particle diameter was 50 μm and the ratio was 30%, 50%, 70% and 90%%, it was confirmed that gaps made by the cracking of the resin were filled with the denatured olefin particle-containing resin at the corner edge 71 and the press-sheared edge 72 was covered with the denatured olefin particle-containing resin.

Therefore, it was demonstrated that when the combination of the resin particle diameter and the volumetric ratio of the particles is appropriate, even if the resin is cracked at the corner edge 71, the gaps made by the cracking are filled with the denatured olefin particle-containing resin, and also the press-sheared edge 72 is covered with the denatured olefin particle-containing resin, and thus the aluminum substrate 100A can be covered with certainty.

The connection section of the present invention corresponds to the box section 2 in the embodiments; and similarly, the pressure-bonding section corresponds to the wire barrel section 10 and the insulation barrel section 15;

the border between the aluminum substrate and the conductive contact body along the outer periphery of the conductive contact body corresponds to the border, as seen in a plan view, between the plated part 40 and the aluminum substrate 100A;

the conductive contact body corresponds to the plated part 40, 540;

the anodized part corresponds to the anodized film 60;

the conductive contact body insulating cover corresponds to the plated part insulating cover 566;

the another conductive member corresponds to the aluminum conductive tip part 203;

the connectable aluminum conductive member corresponds to the male terminal;

the nobler metal material than the aluminum material corresponds to tin;

the conductive contact body-forming step corresponds to the plating step;

the insulating cover-forming step corresponds to the resin application step; and the punching-out step and the bending step correspond to the press step.

However, the present invention is not limited to the above-described embodiments and may be implemented in any of various other embodiments.

REFERENCE SIGNS LIST

1, 1A, 1B, 501, 501A . . . Crimp terminal
1*a*, 1Aa, 1Ba, 501*a* . . . Connection structural body
2 . . . Box section
10 . . . Wire barrel section
15 . . . Insulation barrel section
40 . . . Plated part
41 . . . Wire barrel-side plated part
42 . . . Contact piece-side plated part
43 . . . Bead part-side plated part
60 . . . Anodized film
72 . . . Press-sheared edge
80 . . . Contact part
100A . . . Aluminum substrate
200 . . . Insulated wire
201 . . . Aluminum conductor
202 . . . Conductor cover
203 . . . Aluminum conductor tip part
204 . . . Conductor-exposed part
504 . . . Plated part
541 . . . First plated part
542 . . . Second plated part
543 . . . Third plated part

560, 560A . . . Insulating cover
561 . . . First insulating cover
562 . . . Second insulating cover
563 . . . Third insulating cover
565 . . . Aluminum substrate insulating cover
566 . . . Plated part insulating cover

The invention claimed is:

1. A crimp terminal, which is formed of an aluminum substrate of an aluminum material and includes a connection section and a pressure-bonding section including a wire barrel section and an insulating barrel section, the connection section, the wire barrel section and the insulating barrel section being located in this order, wherein:

a plated part formed of a plating material containing a nobler metal material than the aluminum material is provided on a contact part of a surface of the aluminum substrate where the aluminum substrate contacts another conductive member;

an insulating body is formed on a border between the aluminum substrate and the plated part along an outer periphery of the plated part;

the insulating body is formed of an insulating resin cover which is formed of an insulating resin;

the insulating resin cover is formed on an area of the aluminum substrate that is exposed outside the outer periphery of the plated part;

the insulating resin cover includes:

an aluminum substrate insulating resin cover located on the surface of the aluminum substrate; and a plated part insulating resin cover located on a surface of the plated part; and the aluminum substrate insulating resin cover and the plated part insulating resin cover are formed integrally as striding over the border between the aluminum substrate and the plated part along the outer periphery of the plated part.

2. The crimp terminal according to claim 1, wherein the insulating resin cover is formed on the aluminum substrate including a press-sheared edge thereof generated as a result of press shearing.

3. The crimp terminal according to claim 1, wherein:

the conductive member is a connectable aluminum conductive member connected to the connection section and formed of an aluminum material; and the contact part is provided on the connection section.

4. The crimp terminal according to claim 1, wherein:

the conductive member is the insulated wire having an aluminum conductor tip part which is obtained as a result of stripping a front part of a conductive cover for covering an aluminum conductor to expose a front part of the aluminum conductor; and the contact part is provided in the wire barrel section to which the aluminum conductor tip part is pressure-bonded.

5. A connection structural body, comprising:

a crimp terminal that is formed of an aluminum substrate of an aluminum material and includes a connection section and a pressure-bonding section including a wire barrel section and an insulating barrel section, the connection section, the wire barrel section and the insulating barrel section being located in this order; and an insulated wire having an aluminum conductor tip part which is obtained as a result of stripping a front part of a conductive cover for covering an aluminum conductor to expose a front part of the aluminum conductor; wherein a plated part formed of a plating material containing a nobler metal material than the aluminum material is provided on a contact part of a surface of the aluminum substrate where the aluminum substrate contacts another conductive member, an insulating body is formed on a border between the aluminum substrate and the plated part along an outer periphery of the plated part, the insulating body is formed of an insulating resin cover which is formed of an insulating resin, the insulating resin cover is formed on an area of the aluminum substrate that is exposed outside the outer periphery of the plated part, the insulating resin cover includes an aluminum substrate insulating resin cover located on the surface of the aluminum substrate, and a plated part insulating resin cover located on a surface of the plated part, the aluminum substrate insulating resin cover and the plated part insulating resin cover are formed integrally as striding over the border between the aluminum substrate and the plated part along the outer periphery of the plated part, and the aluminum conductor tip part is connected to the wire barrel section by pressure bonding.

* * * * *